US008220790B2

(12) United States Patent
Iguchi et al.

(10) Patent No.: US 8,220,790 B2
(45) Date of Patent: Jul. 17, 2012

(54) SHEET PROCESSING APPARATUS AND SHEET PROCESSING METHOD

(75) Inventors: Ken Iguchi, Shizuoka-ken (JP); Chiaki Ilzuka, Shizuoka-ken (JP); Takahiro Kawaguchi, Shizuoka-ken (JP); Shinichiro Mano, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/089,254

(22) Filed: Apr. 18, 2011

(65) Prior Publication Data

US 2011/0193283 A1 Aug. 11, 2011

Related U.S. Application Data

(63) Continuation of application No. 12/140,136, filed on Jun. 16, 2008, now Pat. No. 7,946,564.

(60) Provisional application No. 60/944,828, filed on Jun. 19, 2007, provisional application No. 60/944,940, filed on Jun. 19, 2007, provisional application No. 60/944,966, filed on Jun. 19, 2007, provisional application No. 60/944,969, filed on Jun. 19, 2007, provisional application No. 60/945,372, filed on Jun. 21, 2007, provisional application No. 60/945,375, filed on Jun. 21, 2007, provisional application No. 60/968,860, filed on Aug. 29, 2007, provisional application No. 60/968,861, filed on Aug. 29, 2007.

(51) Int. Cl.
*B65H 37/04* (2006.01)

(52) U.S. Cl. ..... 270/37; 270/32; 270/58.07; 270/58.08

(58) Field of Classification Search ..... 270/32, 270/37, 58.07, 58.08, 58.12, 58.17
See application file for complete search history.

(56) References Cited

U.S. PATENT DOCUMENTS

| | | | | |
|---|---|---|---|---|
| 6,199,853 | B1 | 3/2001 | Andoh et al. | |
| 6,264,194 | B1 | 7/2001 | Hayashi et al. | |
| 6,575,446 | B2 | 6/2003 | Wakabayashi et al. | |
| 7,014,183 | B2 | 3/2006 | Tamura et al. | |
| 7,413,176 | B2 * | 8/2008 | Hirata et al. | 270/58.08 |
| 7,686,291 | B2 * | 3/2010 | Miyazawa | 271/117 |
| 2004/0178554 | A1 | 9/2004 | Ishida | |

FOREIGN PATENT DOCUMENTS

| | | |
|---|---|---|
| JP | 04-169292 | 6/1992 |
| JP | 09-216764 | 8/1997 |
| JP | 2003-212433 | 7/2003 |
| JP | 2005-193990 | 7/2005 |
| JP | 2006-219302 | 8/2006 |

* cited by examiner

*Primary Examiner* — Leslie A Nicholson, III
(74) *Attorney, Agent, or Firm* — Patterson & Sheridan, LLP

(57) ABSTRACT

There is provided a technique in which in a case where a sheet folding process or a staple process is performed, even in the case where the size precision of a sheet used is not satisfactory, the high-precision staple process and folding process can be performed to the sheet. In a sheet processing method of a sheet processing apparatus to perform a specified process to a sheet, a relatively moved sheet is detected, the size of the sheet is calculated based on the detection result, and a position where the specified process is performed to a bundle of sheets as an object of the specified process is adjusted based on the calculated sheet size.

13 Claims, 40 Drawing Sheets

SHEET PROCESSING APPARATUS AND SHEET PROCESSING METHOD

This application is a continuation of U.S. patent application Ser. No. 12/140,136, filed Jun. 16, 2008, which claims the benefit of U.S. Provisional Application No. 60/944,828 filed Jun. 19, 2007, U.S. Provisional Application No. 60/944,940 filed Jun. 19, 2007, U.S. Provisional Application No. 60/944,966 filed Jun. 19, 2007, U.S. Provisional Application No. 60/944,969 filed Jun. 19, 2007, U.S. Provisional Application No. 60/945,372 filed Jun. 21, 2007, U.S. Provisional Application No. 60/945,375 filed Jun. 21, 2007, U.S. Provisional Application No. 60/968,860 filed Aug. 29, 2007 and U.S. Provisional Application No. 60/968,861 filed Aug. 29, 2007.

BACKGROUND OF THE INVENTION

1. Field of the Invention

The present invention relates to a sheet processing technique to perform a specific process to a sheet.

2. Description of the Related Art

In general, in the case where a staple process or a folding process is performed to a bundle of sheets, the size of a sheet, in a transport direction, constituting the bundle of sheets as an object of the process is calculated based on the prescribed value (for example, A3, A4, B4, B5, etc.) of the sheet size, and in the case where it is determined that the sheet size deviates from the prescribed value, an error notification is made.

In a conventional sheet processing apparatus, in the case where a user supplies a sheet of a size outside of the regulation as the object of the staple process or the folding process, there is a case where these processes can not be executed.

SUMMARY OF THE INVENTION

An embodiment of the invention has an object to provide a technique in which in a case where a sheet folding process or a staple process is performed, even in the case where the size precision of a sheet used is not satisfactory, the high-precision staple process and folding process can be performed to the sheet.

In order to achieve the object, according to an aspect of the invention, a sheet processing apparatus includes an information acquisition unit to acquire at least one of information relating to a bundle of sheets as an object of a folding process by a folding blade and information relating to an environment in which the folding process is performed, and a folding position adjustment unit to adjust, based on the information acquired by the information acquisition unit, a position where the folding blade is brought into contact with the bundle of sheets as the object of the folding process.

In order to achieve the object, according to another aspect of the invention, a sheet processing apparatus includes a stacker that holds a bundle of sheets as an object of a staple process and can move substantially in parallel to a surface direction of the sheet at a time when the staple process is performed, a stapler to perform the staple process to the bundle of sheets moved to a specified position by the stacker, an alignment roller that can come in contact with and separate from a sheet surface of the sheet held by the stacker, and strikes the sheet against a reference position in the stacker to align it by bringing a rotating roller surface into contact with the sheet, and a drive control unit that causes the alignment roller to come in contact with the bundle of sheets held by the stacker and to assist movement of the bundle of sheets when the bundle of sheets subjected to the staple process is moved in a direction of retracting from the stapler by the stacker.

In order to achieve the object, according to another aspect of the invention, a sheet processing apparatus includes a staple unit that performs a staple process to a bundle of sheets transported to a specific staple position in a sheet transport path, and staples the bundle of sheets by causing a press unit that presses a sheet surface of the bundle of sheets when the staple process is performed to cooperate with a reception unit that is disposed to face the inside of the sheet transport path through a hole provided in an inner wall of the sheet transport path and receives the bundle of sheets pressed by the press unit, and an elastic member that is supported by one of a wall surface of the sheet transport path and the reception unit and covers a vicinity of an upstream side edge of the reception unit in a sheet transport direction on the sheet transport path.

In order to achieve the object, according to another aspect of the invention, a sheet processing apparatus includes a pair of rollers that can perform sheet transport at a first transport speed and a second transport speed higher than the first transport speed, a folding blade that moves from a waiting position to a nip of the pair of rollers and presses a bundle of sheets as an object of a folding process into the nip of the pair of rollers driven at the first transport speed, and a transport control unit that changes a sheet transport speed of the pair of rollers from the first transport speed to the second transport speed at a specified timing between when the folding blade starts a return operation to the waiting position after completion of the pressing operation of the bundle of sheets and when a rear edge of the bundle of sheets pressed into the nip of the pair of rollers by the folding blade passes through the nip of the pair of rollers.

In order to achieve the object, according to another aspect of the invention, a sheet processing apparatus includes a sensor to detect a relatively moved sheet, a size calculation unit to calculate a size of the sheet based on a detection result of the sensor, and a process position adjustment unit to adjust, based on the sheet size calculated by the size calculation unit, a position where a specified process is performed to a bundle of sheets as an object of the specified process.

In order to achieve the object, according to another aspect of the invention, a sheet processing apparatus includes a first sheet transport path for transporting a sheet, a second sheet transport path that is for performing switchback transport of the sheet transported in the first sheet transport path and includes at least one of a hole, a projection and a recess in the vicinity of a meeting position between the second transport path and the first sheet transport path, and a slide unit that can pull out the first sheet transport path and the second sheet transport path integrally to the outside of the apparatus.

DESCRIPTION OF THE DRAWINGS

FIG. 24 is a timing chart showing drive timings of an assist roller and the like.

DESCRIPTION OF THE EMBODIMENTS

Hereinafter, embodiments of the present invention will be described with reference to the drawings.

First Embodiment

First, a first embodiment of the invention will be described.

Figure 1:
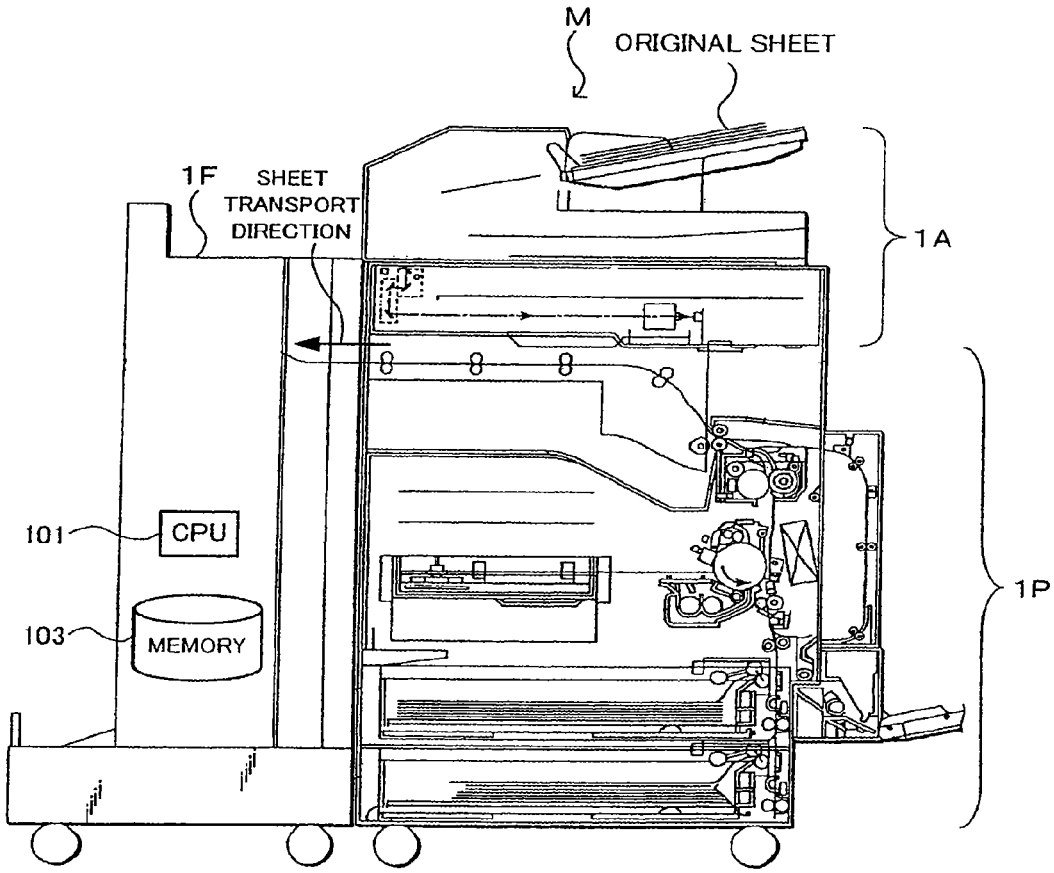
FIG. 1 is a view for explaining a rough structure of a sheet processing apparatus 1F of a first embodiment and an image processing apparatus M including the same.

FIG. 1 is a view for explaining a rough structure of a sheet processing apparatus 1F of a first embodiment of the invention and an image processing apparatus M including the same.

As shown in the drawing, the image processing apparatus M of the embodiment includes an image reading apparatus 1A to read an image of an original document, an image forming apparatus 1P to form an image on a sheet, and the sheet processing apparatus 1F to perform a specified post-process to the sheet on which the image is formed by the image forming apparatus 1P. In the structural example shown in the drawing, the sheet on which the image is formed by the image forming apparatus 1P is transported in a sheet transport direction (arrow direction) in the drawing and is supplied to the sheet processing apparatus 1F.

Next, the details of the sheet processing apparatus 1F of the embodiment will be described.

Figure 2:
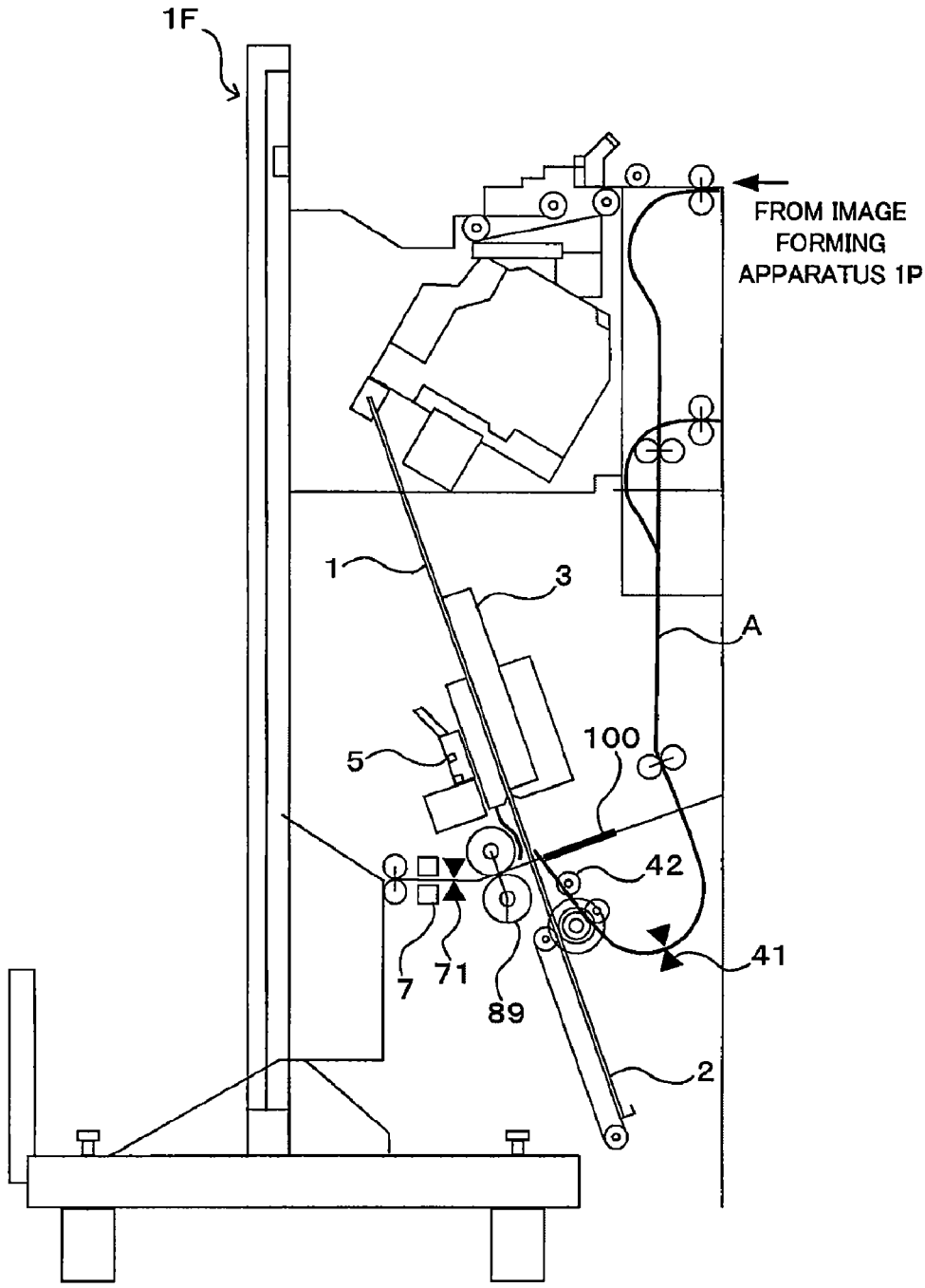
FIG. 2 is a longitudinal sectional view showing a basic structure of the sheet processing apparatus 1F of the first embodiment of the invention.

FIG. 2 is a longitudinal sectional view showing the basic structure of the sheet processing apparatus 1F of the first embodiment of the invention. The sheet processing apparatus 1F of the embodiment has a folding process function to perform a folding process to a sheet supplied from the image forming apparatus 1P while the center position of the sheet in the transport direction is made a folding position, and a staple function to use a staple 5 to stitch a bundle of sheets moved to a specified position by a stacker (hold means) 2. Hereinafter, a unit to perform the folding process and a unit to perform the staple process are generically called a saddle unit.

Incidentally, in the sheet processing apparatus 1F of the embodiment and the image processing apparatus M, although not only a paper medium such as a standard paper or a thick paper, but also a sheet such as an OHP film can be handled as a medium, for convenience of explanation, a case where a sheet as an object of a process in the sheet processing apparatus 1F and the image processing apparatus M is a paper medium will be described as an example.

The saddle unit in the sheet processing apparatus 1F is disposed at the lowest possible position of the sheet processing apparatus 1F in the up-and-down direction. The sheet ejected from the image forming apparatus 1P is temporarily loaded and contained in a stack tray 1 through a transport path A. The stack tray 1 in this embodiment is disposed to be inclined with respect to the vertical direction. The sliding down of the sheet loaded and contained in the stack tray 1 is assisted by an assist roller 42 rotated and driven, and the lower edge of the sheet is struck against a stacker pawl (so-called stopper) of the stacker 2 and is aligned.

A timing when the movement of the sheet is assisted by the assist roller 42 is decided based on a sheet detection timing of a discharge roller sensor (detector means; having a function as an optical sensor and a media sensor and capable of detecting reflectivity, surface roughness, thickness and the like of the sheet surface) 41 provided on the transport path A. In this way, a bundle of sheets temporarily loaded and contained in the stack tray 1 are held by a lateral alignment mechanism 3 at the positions of both ends thereof in the direction orthogonal to the sheet transport direction and are aligned.

The bundle of sheets on the stack tray 1 aligned as stated above are subjected to a staple process by a stapler 5 provided in the vicinity of both edges in the direction orthogonal to the sheet transport path.

The bundle of sheets subjected to the staple process by the stapler 5 is subjected to a folding process by a folding blade 100 and a pair of folding rollers 89.

The bundle of sheets, which is subjected to the folding process and the folded portion of which is transported to a nip position of an additional folding roller 7, is subjected to an additional folding process by the additional folding roller 7.

Figure 3:
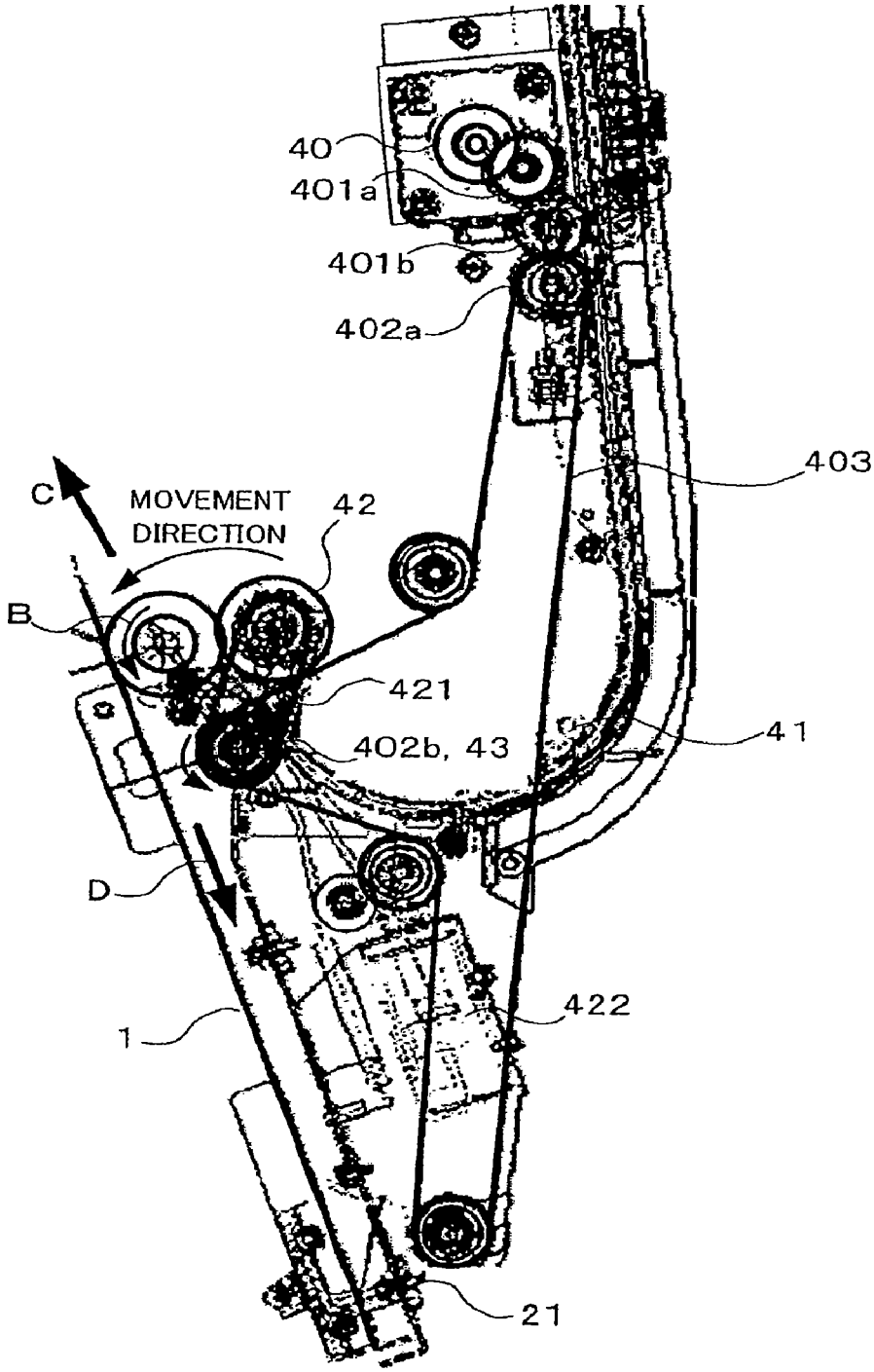
FIG. 3 is a structural view for explaining an operation in which a sheet transported in a transport path A is struck against a stacker pawl of a stacker 2 and is aligned.

FIG. 3 is a structural view for explaining an operation in which a sheet transported in the transport path A is struck against a stacker pawl 21 of the stacker 2 and is aligned.

In a transport mechanism for transporting the sheet ejected from the image forming apparatus 1P to the stack tray 1, a driving force from a transport motor 40 is transmitted through gear trains 401*a* and 401*b* to a gear/pulley 402*a*. The driving force transmitted to the gear/pulley 402*a* is transmitted to each transport roller by a timing belt 403 wound around the gear/pulley 402*a*.

Since the assist roller 42 strikes the sheet against the stacker pawl 21 as the reference stopper and performs alignment, a certain degree of elasticity and frictional force are required. Besides, it is desirable that the assist roller 42 is made of a material which absorbs an excessive force applied to the sheet to a certain degree and can suppress the occurrence of buckling of the sheet even in the case where the amount of rotation driving of the assist roller 42 exceeds a proper amount when the sheet striking operation against the stacker pawl 21 is performed in the state where the sheet is completely nipped by the assist roller 42. Then, in this embodiment, for example, a roller made of sponge is adopted as the assist roller 42. Of course, as the material of the assist roller 42, it is needless to say that another material may be used as long as it has the required characteristic.

The driving force from the transport motor 40 is transmitted by the timing belt 421 wound around the gear/pulley 402*b* wound around the timing belt 403 and the assist roller 42 is rotated. The assist roller 42 is moved in the movement direction shown in FIG. 3 so as to come in contact with the sheet loaded on the stack tray 1 by an assist roller solenoid 422 provided below the transport path while a support shaft connected to the gear/pulley 402*b* is made a fulcrum point.

The assist roller 42 is rotated in an arrow B direction which is the same rotation direction as the discharge roller 43 supported, together with the gear/pulley 402*b*, by the support shaft. By this, in the state where the assist roller solenoid 422 is turned on and the assist roller 42 is in contact with the stack tray 1, the sheet transported in an arrow C direction shown in FIG. 3 is transported in such a way as to assist the sliding down of the sheet by its own weight toward an arrow D direction in the stack tray 1, and the edge of the sheet is struck against the stacker pawn 21 as the reference stopper and can be aligned.

Figure 4:
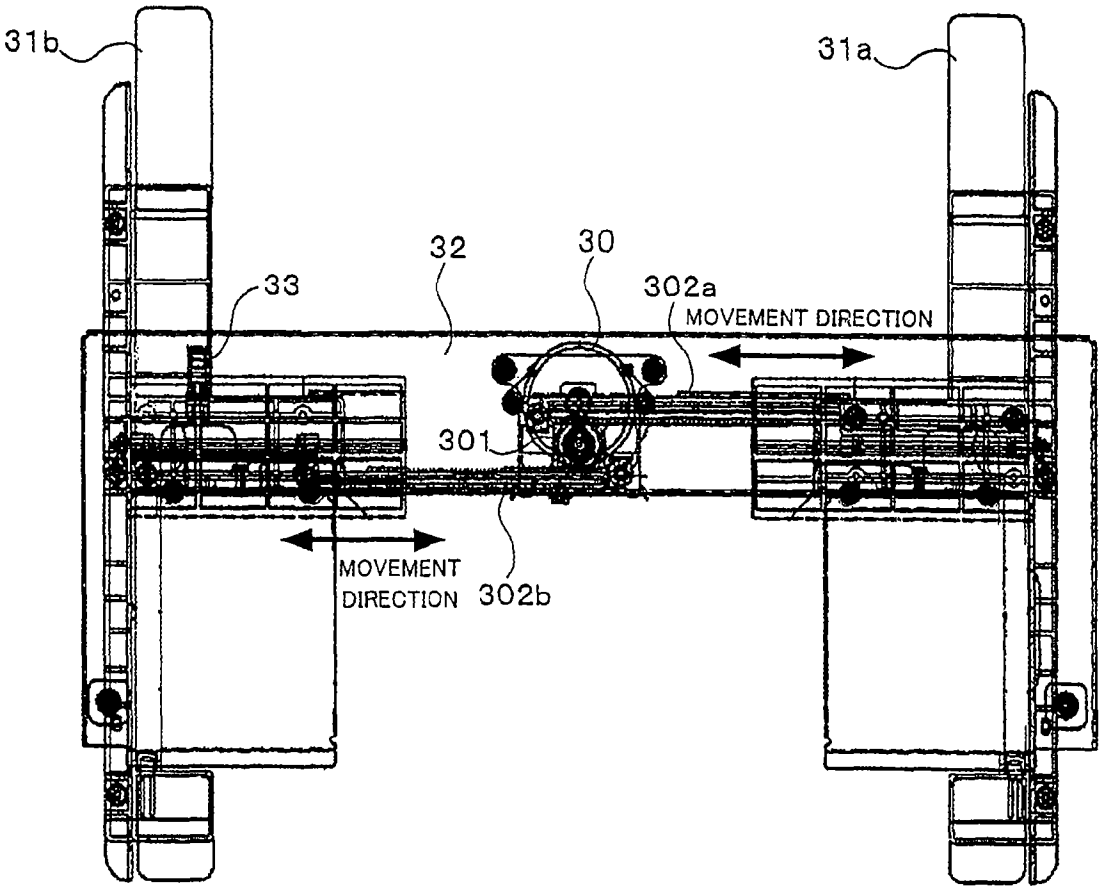
FIG. 4 is a structural view for explaining a lateral alignment unit to align a side edge of a sheet on a stack tray 1.

FIG. 4 is a structural view for explaining a lateral alignment unit to align the side edge of a sheet on the stack tray 1.

The lateral alignment unit here has a function to align the edge of a bundle of sheets loaded on the stack tray 1 in the direction orthogonal to the transport direction. The lateral alignment unit is constructed of a drive unit including a lateral alignment motor 30 which is a stepping motor, a gear 301, a lack 302*a* and a lack 302*b*, a lateral alignment plate 31*a*, a lateral alignment plate 31*b*, and a frame 32 as a support frame body to support these.

The driving force from the lateral alignment motor 30 is transmitted to the gear 301. The gear 301 is engaged with the lacks 302*a* and 302*b*, and the lacks 302*a* and 302*b* are moved in an arrow direction shown in FIG. 4 in synchronization with the rotation of the gear 301. The lacks 302*a* and 302*b* are respectively attached to the lateral alignment plates 31*a* and 32*b*, and the lateral alignment plates 31*a* and 31*b* are moved in the direction orthogonal to the sheet transport direction by the movement of the lacks 302*a* and 302*b*.

Besides, the positions of the lateral alignment plates 31*a* and 31*b* in the movement direction are managed by pulses of the lateral alignment motor 30 based on the detection result of a lateral alignment motor HP sensor 33 provided on the frame 32. Incidentally, the HP here denotes a home position.

Figure 5:
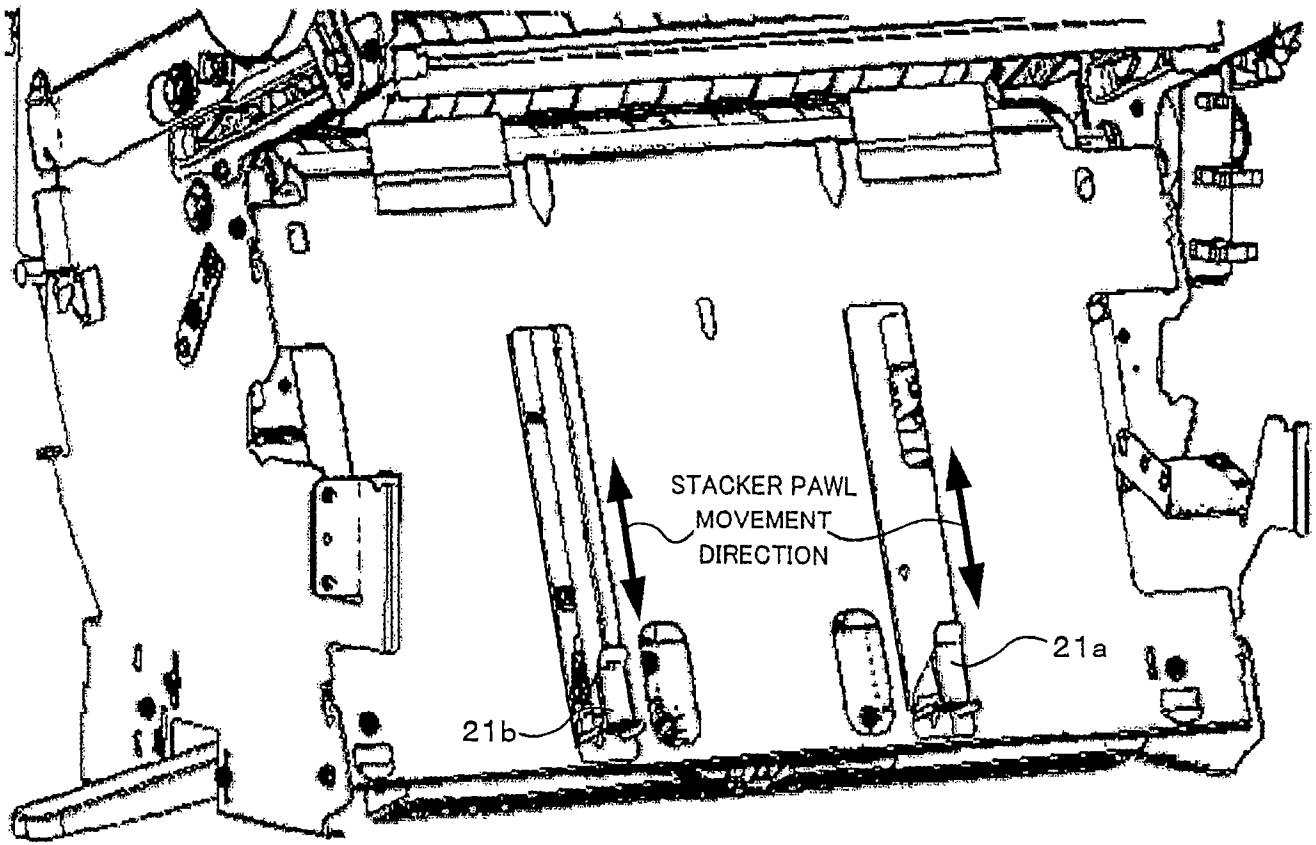
FIG. 5 is a perspective view for explaining a structure in the vicinity of the stack tray 1.
Figure 6:
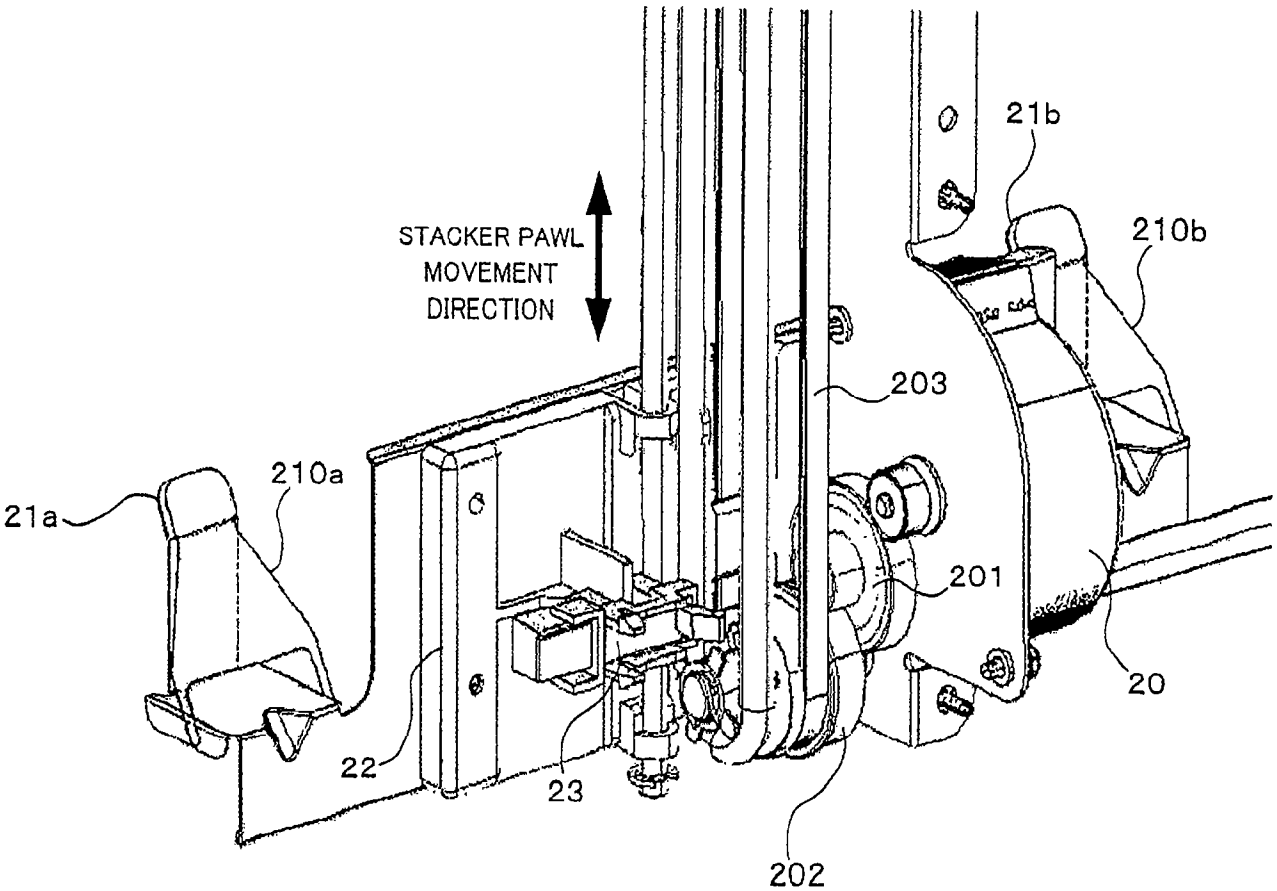
FIG. 6 is a perspective view for explaining the structure in the vicinity of the stack tray 1.

FIG. 5 and FIG. 6 are perspective views for explaining the structure in the vicinity of the stack tray 1.

A stacker unit as a positioning stopper of the lower edge of a bundle of sheets loaded on the stack tray 1 is constructed of a driving unit including a stacker motor 20 which is a stepping motor, a gear 201, a gear/pulley 202, and a timing belt 203, a stacker pawl 21*a*, stacker pawl 21*b*, and a support unit 22 to support these.

The driving force from the stacker motor 20 is transmitted to the gear/pulley 202 through the gear 201, and is transmitted to a timing belt 203 wound around the gear/pulley 202. By this, the support unit 22 fixedly connected to the timing belt 203 is moved in an arrow direction (up-and-down direction in the drawing) shown in FIG. 6.

The support unit 22 includes the stacker pawls 21*a* and 21*b*, and is moved in the arrow direction shown in FIG. 5 and FIG. 6 in accordance with the movement of the support unit 22.

As stated above, the stacker unit in the embodiment holds the bundle of sheets when the folding blade 100 is brought into contact with the bundle of sheets in the folding process, and can move substantially in parallel to the surface direction of the sheet at the time when the folding blade 100 is brought into contact.

Besides, the stacker pawls 21*a* and 21*b* are respectively provided with flexible members 210*a* and 210*b*, and the bundle of sheets struck against the stacker pawls 21*a* and 21*b* is pressed to the reference surface by these flexible members and is held.

Besides, the positions of the stacker pawls 21*a* and 21*b* in the moving direction are managed by pulses of the stacker motor 20 based on the detection result of a stacker motor HP sensor 23.

Next, a folding mechanism in the embodiment will be described.

Figure 7:
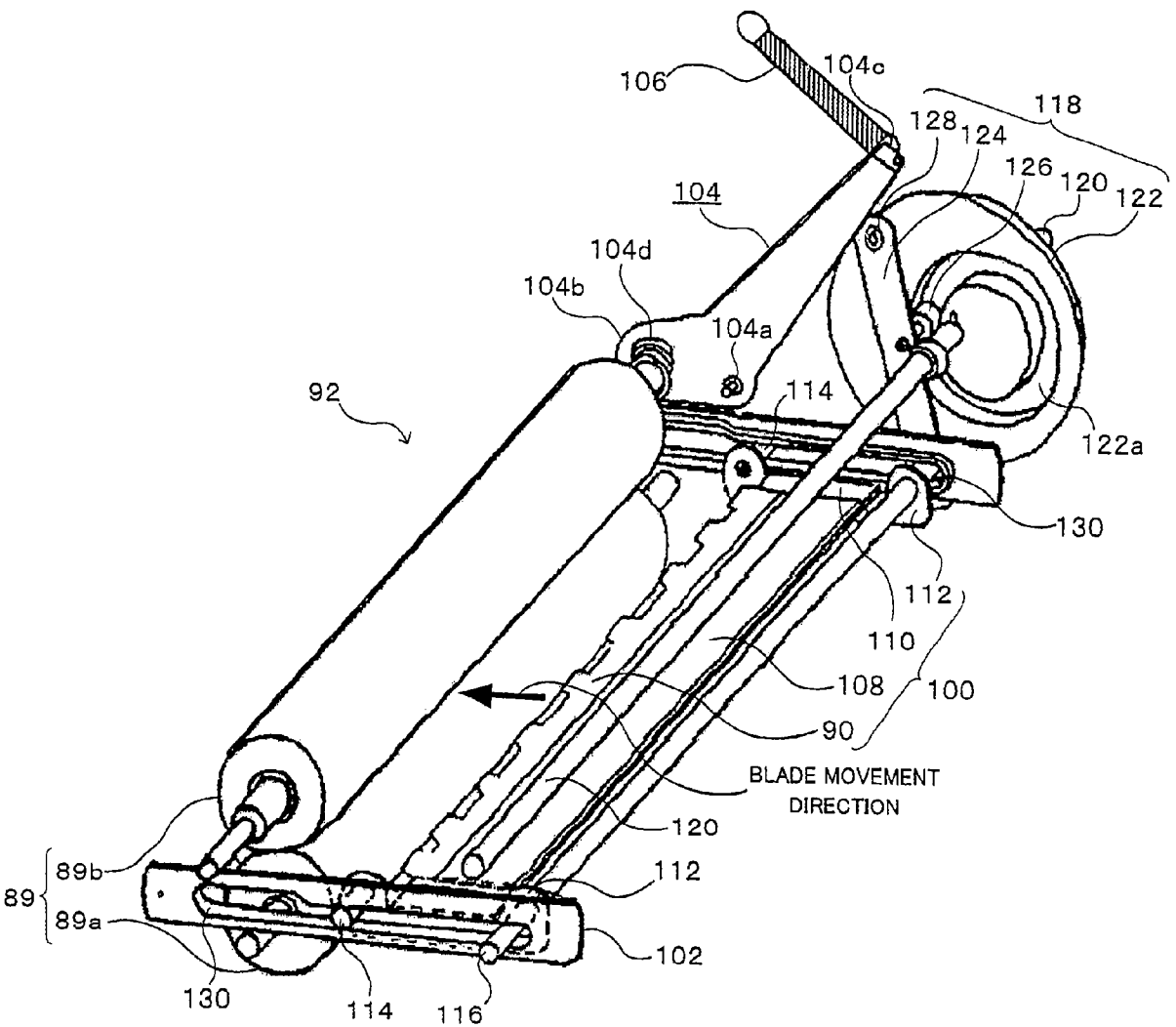
FIG. 7 is a view for explaining the details of a sheet folding mechanism in the sheet processing apparatus of the first embodiment of the invention.
Figure 8:
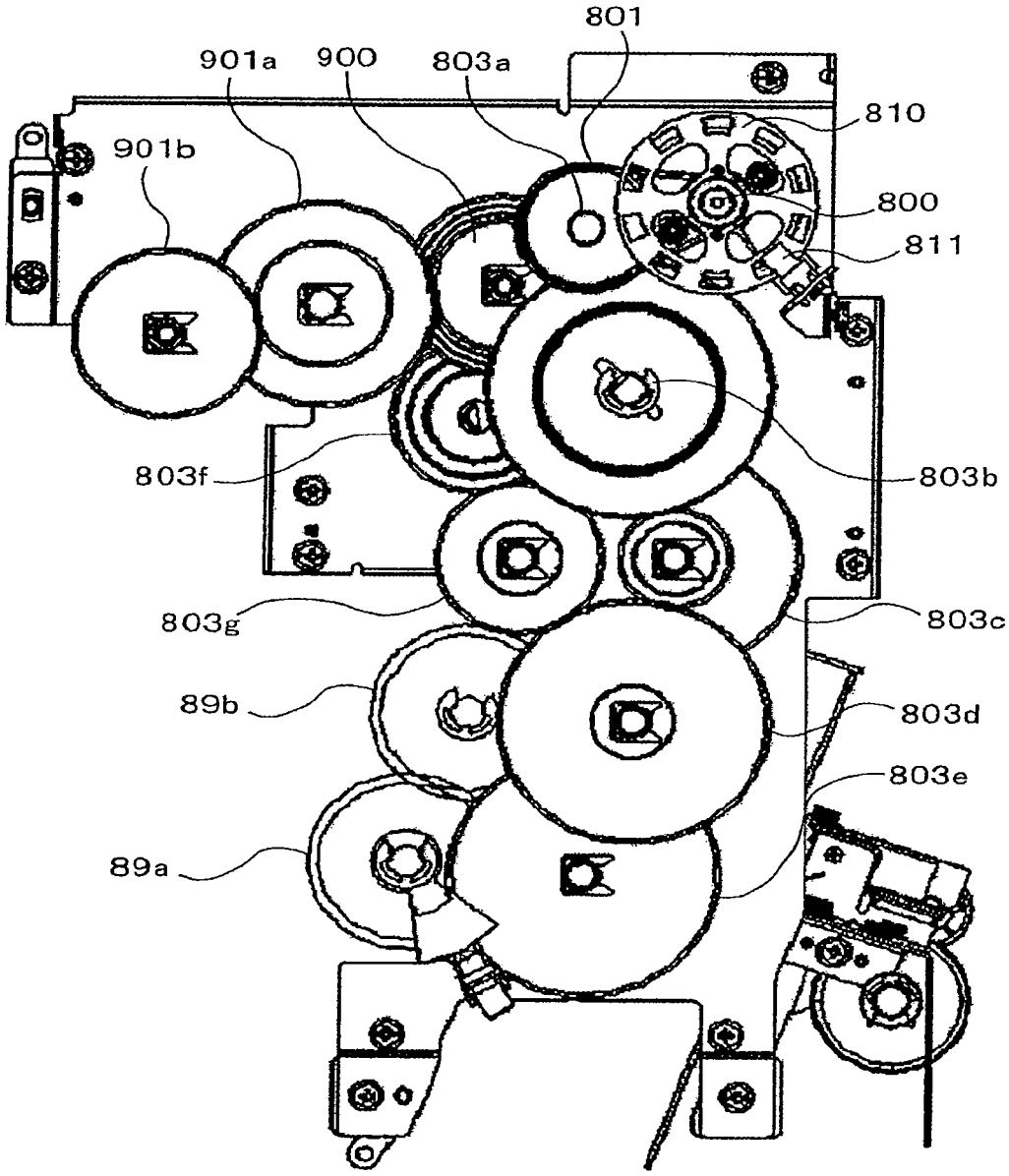
FIG. 8 is a view for explaining the details of the sheet folding mechanism in the sheet processing apparatus of the first embodiment of the invention.
Figure 9:
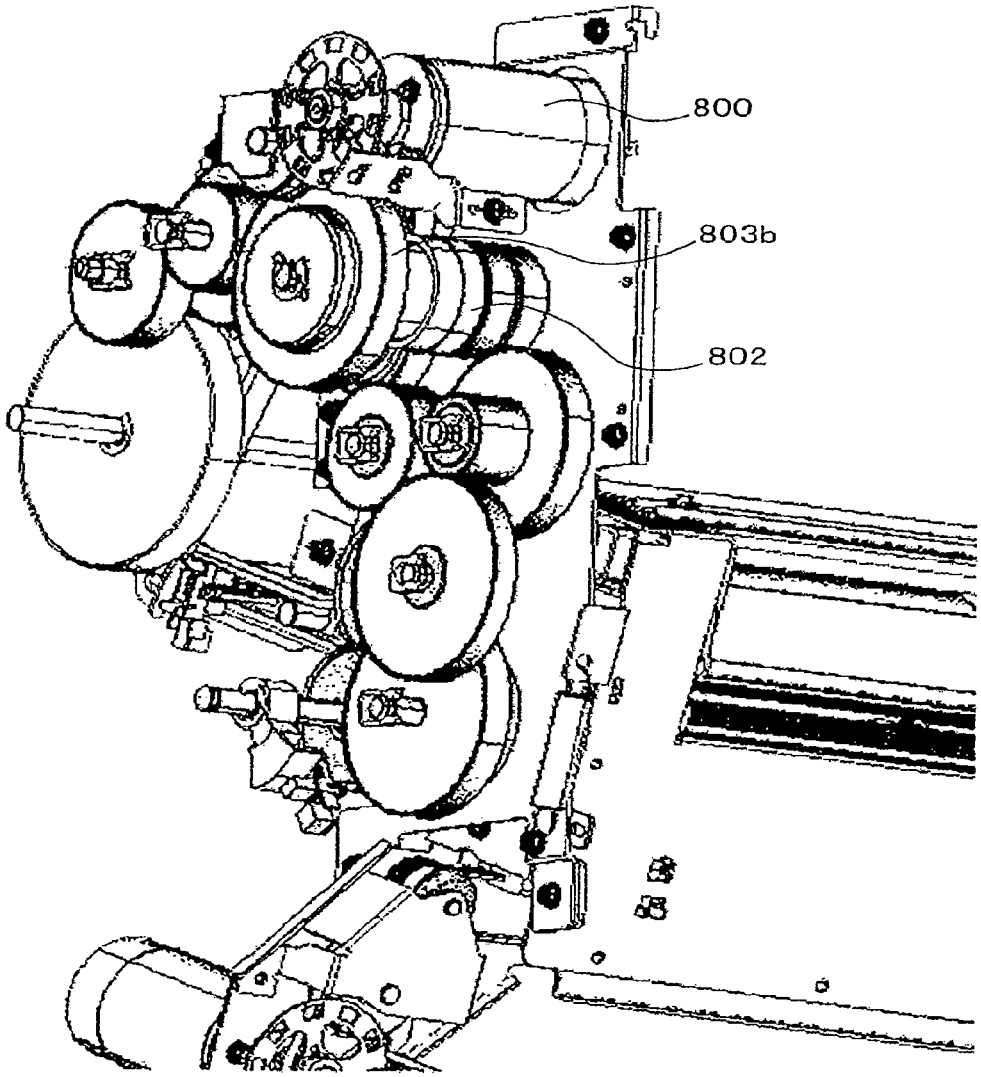
FIG. 9 is a view for explaining the details of the sheet folding mechanism in the sheet processing apparatus of the first embodiment of the invention.

FIG. 7 to FIG. 9 are views for explaining the details of the sheet folding mechanism in the sheet processing apparatus of the first embodiment of the invention.

As shown in FIG. 7, sheet folding means 92 includes a pair of folding rollers 89 to fold a bundle of sheets held in a nip in two, a folding blade 100 as a pressing member to press the bundle of sheets into the nip part of the pair of folding rollers 89, and a guide member (regulating means) 102 that holds the folding blade 100 to be capable of moving it to the pair of folding rollers 89 and regulates the fluctuation in the direction crossing the movement direction of the folding blade 100 before the bundle of sheets is pressed into the nip part.

The pair of folding rollers 89 includes a fixed folding roller (first roller) 89*a* and a movable folding roller (second roller) 89*b*.

The movable folding roller 89*b* is rotatably fixedly disposed to a not-shown apparatus frame. Besides, the movable folding roller 89*b* is rotatably supported by one end 104*b* of an arm 104 supported to the not-shown apparatus frame to be rotatable around a fulcrum point 104*a*, and moves in the direction substantially orthogonal to the movement direction of the folding blade 100, so that it can contact with and separate from the fixed folding roller 89*a*.

A spring 106 is attached to the other end 104*c* of the arm 104, and the movable folding roller 89*b* urged by the arm 104 rotated around the fulcrum point 104*a* comes in press contact with the fixed folding roller 89*a* and forms the nip part. Besides, the one end 104*b* of the arm 104 is provided with a first support hole 104*d* to enable the movable folding roller 89*b* to straightly move without drawing an arc when the arm 104 is rotated. Incidentally, the fixed folding roller 89*a* and the movable folding roller 89*b* are rotated and driven by a not-shown drive motor.

The folding blade 100 includes a blade part 90 to push the bundle of sheets, a first holding member 108 and a second holding member 110 to put the blade 90 therebetween and hold it, and side plates 112 attached to both ends of the second holding member 110 in the direction orthogonal to the blade movement direction.

A stud 114 is provided at the front of the side plate 112, that is, at the side of the pair of folding rollers 89, a shaft 116 is provided at the rear part (the first projection 114 and the second projection 116), and the folding blade 100 is slidably supported by the guide member 102 through the stud 114 and the shaft 116. Besides, as the interval between the stud 114 and the shaft 116 becomes long, the posture of the folding blade 100 becomes stable, and accordingly, in this embodiment, the attachment position of the stud 114 is set at the side of the pair of folding rollers 89 with respect to the leading edge of the blade unit 90.

Incidentally, the stud 114 and the shaft 116 as the sliding member are not limited to the above structure, and both the first and the second projections 114 and 116 may be studs or shafts, or may be rotatable rollers. Besides, the attachment position of the stud 114 to the side plate 112 is not limited to the above structure.

Besides, drive means 118 for sliding the folding blade 100 is provided at both ends of the shaft 116. The drive means 118 includes a cam shaft 120, a groove cam 122 provided with a groove part 122*a* and rotatable around the cam shaft 120, and a driven member 124. For example, a roller 126, such as a roller follower, as a contact is rotatably guided in the groove part 122*a* of the groove cam 122, and the roller 126 is attached to the driven member 124.

A driven member rotation shaft 128 is provided at one end of the driven member 124, and the driven member rotation shaft 128 is attached to a not-shown apparatus frame. Besides, the groove cam 122 is rotated and driven by a not-shown drive motor connected to one end of the cam shaft 120. When the roller 126 is guided along the groove part 122*a* by the rotation of the groove cam 122, the driven member 124 repeats a reciprocal operation, like a pendulum, around the driven member rotation shaft 128 according to the eccentricity of the groove part 122*a*.

Next, a drive mechanism of the pair of folding rollers 89 and the folding blade 100 will be described in detail.

A folding mechanism unit includes a folding motor 800 which is a DC motor, a timing belt 801, a one-way clutch 802, gears 803*a*, 803*b*, 803*c*, 803*d*, 803*e*, 803*f*, 803*g*, 901*a* and 901*b*, and an electromagnetic clutch 900 (see FIG. 8 and FIG. 9).

First, a driving force from the folding motor 800 is transmitted to the gear 803*a* through the timing belt 801 extending to the gear 803*a*. In accordance with the rotation of the gear 803*a*, the electromagnetic clutch 900 and the gear 803*b* are rotated and driven. The gear 803*b* is provided with the one-way clutch 802, and when the folding motor 800 is rotated in the normal direction, the rotation driving force is transmitted from the gear 803*b* to the folding roller 89*a* through the gear 803*c*, the gear 803*d* and the gear 803*e*. On the other hand, when the folding motor 800 is rotated in the reverse direction, the rotation driving force is transmitted from the gear 803*b* to the folding roller 89*a* through the gear 803*f*, the gear 803*g*, the gear 803*d*, and the gear 803*e*.

In this embodiment, the driving force from the folding motor 800 is used also for the driving of the folding blade 100, and when the electromagnetic clutch 900 is turned on, the driving force is transmitted to the gear 901*a* and the gear 901*b*, and the driving means 118 connected to the gear 901*b* in FIG. 7 is rotated, so that the folding blade 100 is driven.

Besides, the rotation speed of the pair of folding rollers 89 and the movement position of the folding blade 100 are managed by encode pulses of the folding motor 800 through an encoder actuator 810 connected to the folding motor 800 and based on the detection result of a folding motor encoder sensor 811.

FIG. 10 to FIG. 16 are views for explaining a flow of an operation in the sheet processing apparatus of the first embodiment of the invention.

First, the operation flow at the time when sheets are loaded and contained in the stack tray 1 will be described.

When an ejection signal of the first sheet in the folding operation is issued from the image forming apparatus, the driving of the transport motor 40 is started (S1), and the stacker 2 and the lateral alignment plates 31*a* and 31*b* are moved to a waiting position (S2, S3).

Thereafter, the sheet is detected by the discharge roller sensor 41, and after the off of the sensor is detected (S4*a*, Yes), when driving is performed for a prescribed number of pulses in which the sheet reaches the stack tray 1 (S4*b*, yes), the assist roller solenoid 422 is turned on (S5).

The assist roller solenoid 422 is turned on, so that the assist roller 42 transports the sheet, which is transported to the stack tray 1, to the stacker 2.

When the transport motor 40 is driven for the specified number of pulses after the assist roller solenoid 422 is turned on (S6, Yes), the driving of the lateral alignment motor 30 is started, and the lateral alignment operation of the sheet is performed (S7).

When the transport motor 40 is driven for a specified number of pulses from the start of the driving of the lateral alignment motor 30, the assist roller solenoid 422 is turned off (S8), and then, when the lateral alignment operation is ended, the lateral alignment motor 30 is rotated in the opening direction as the reverse direction, and the lateral alignment plates 31*a* and 31*b* are driven to the waiting position (S9).

Figure 10:
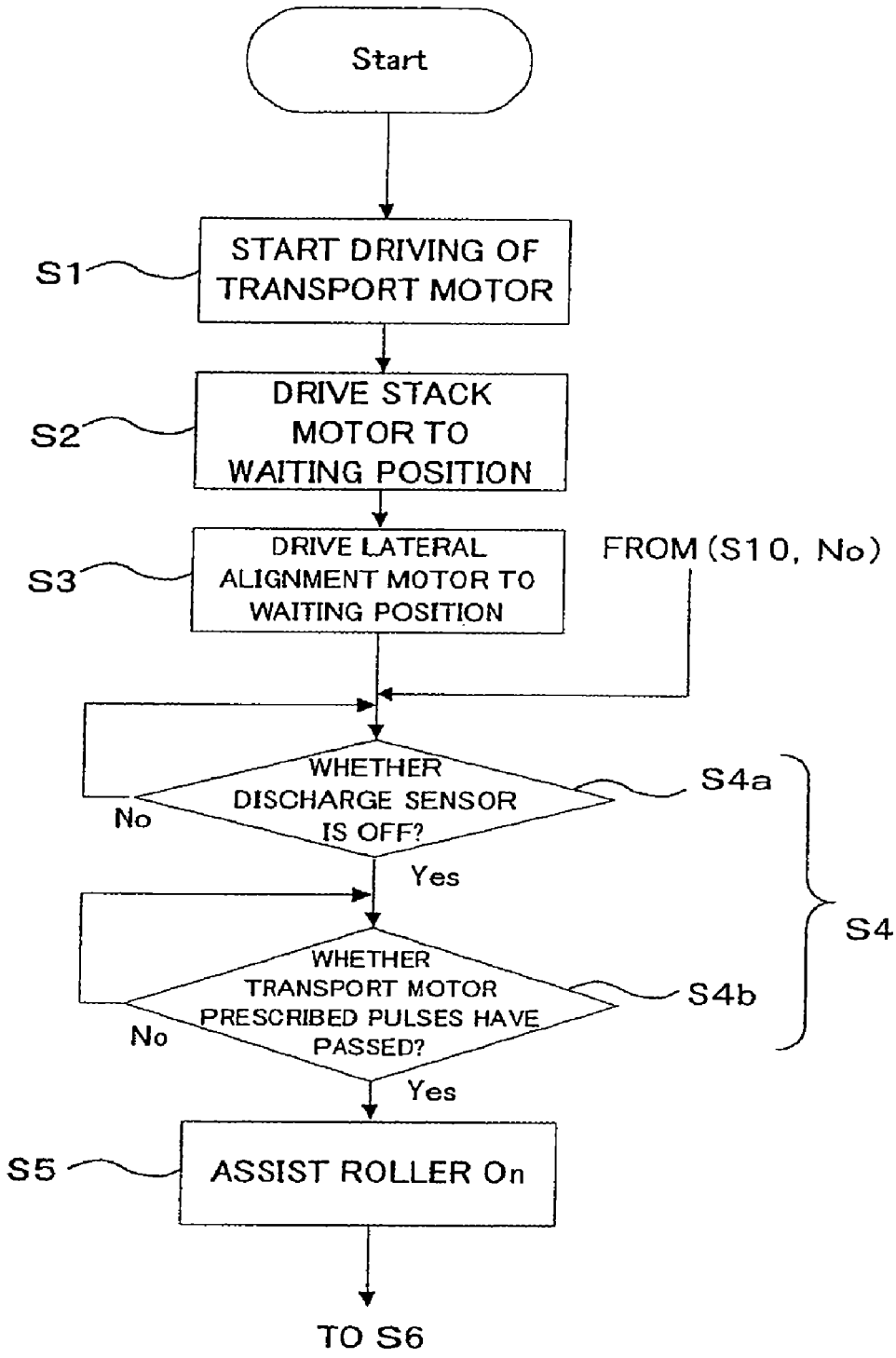
FIG. 10 is a view for explaining a flow of an operation in the sheet processing apparatus of the first embodiment of the invention.

Incidentally, after the discharge roller sensor 41 detects the rear edge of the sheet at S4 shown in FIG. 10, when the sheet subjected to the process currently (the sheet whose rear edge is detected) is the first sheet, the transport speed is reduced. This is because, in the case of the first sheet, since there is no sheet on the stack tray 1, friction force applied to the sheet is small, and when the sheet is discharged from the discharge roller 43 as the final roller of the transport path A onto the stack tray 1, there is a case where the sheet is excessively moved up. Thus, when there is only one sheet on the stack tray like the second or subsequent sheet, the sheets rub with each other, and accordingly, there does not occur a problem that the sheet is excessively moved up.

Figure 11:
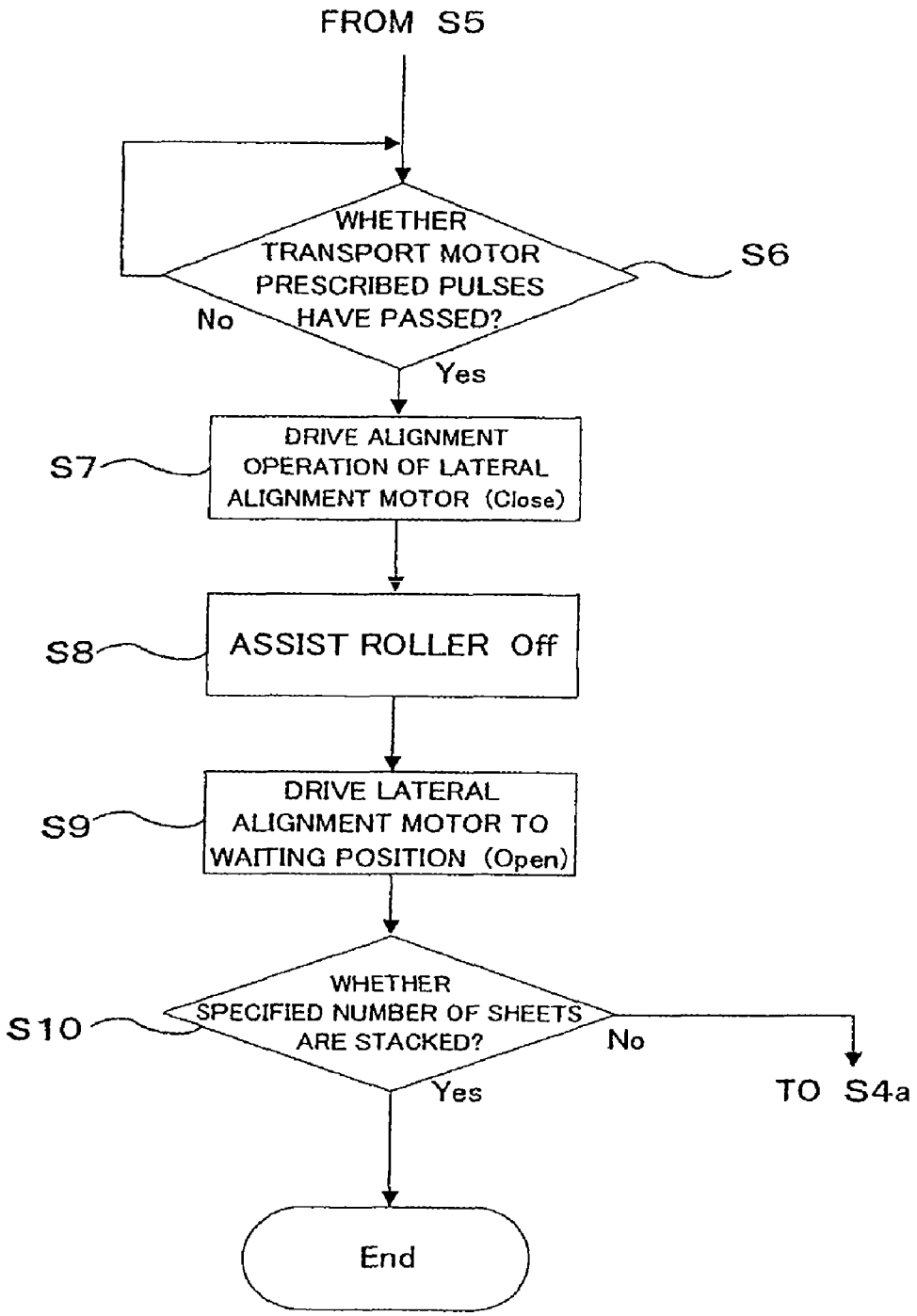
FIG. 11 is a view for explaining the flow of the operation in the sheet processing apparatus of the first embodiment of the invention.
Figure 12:
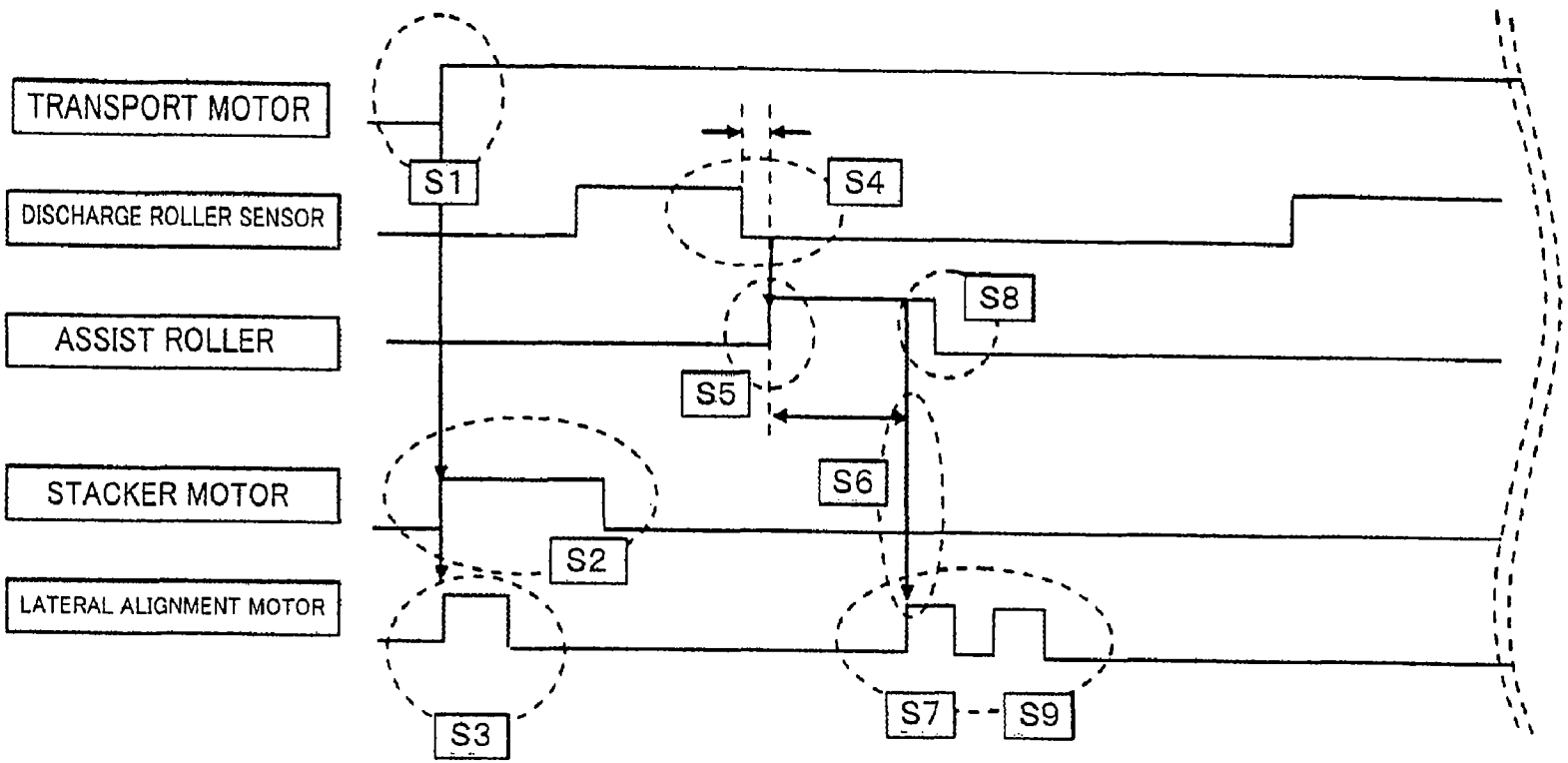
FIG. 12 is a view for explaining the flow of the operation in the sheet processing apparatus of the first embodiment of the invention.

The specified pulse to turn on the assist roller 42 in the period between S5 shown in FIG. 10 and S8 shown in FIG. 11 varies for each sheet size like the waiting position of the stacker 2 varies for each sheet size specified from the image forming apparatus.

The specified pulse at S6 shown in FIG. 11 varies according to the sheet transport speed of the first sheet or the second or subsequent sheet. This is because, in the lateral alignment operation by the lateral alignment plates 31*a* and 31*b*, it is necessary to bring the lateral alignment plate into contact with the edge of the sheet in the direction orthogonal to the transport direction in the state where the assist roller 42 is at the waiting position, and the driving of the lateral alignment operation (S7) is ended a specified time before a timing (S8) when the assist roller 42 is turned off.

Next, the flow of the operation at the time when the staple process and the folding process are performed to the bundle of sheets loaded and contained in the stack tray 1 will be described.

When the operation till S9 of FIG. 11 in which the loading and containing to the stack tray 1 is carried out is completed, in the case where the number of stacked sheets reaches a level on which the folding process is to be performed (S10, Yes), the lateral alignment motor 30 is again driven in the alignment direction and the lateral alignment operation is performed (S11).

Thereafter, the lateral alignment motor 30 is driven in the opening direction, and the lateral alignment plate is driven to the guide position where the staple operation is performed (S12).

At the same time as the start of the operation of S12, the first staple motor on the depth side in the right and left staples is driven and the staple process is performed (S13).

After a specified time since the start of the driving of the first staple motor at S13 (S14), the second staple motor at the near side is driven and the staple process is completed (S15).

When the staple process of the stapler 5 to the sheet is completed, the lateral alignment motor 30 is driven in the opening direction, and the lateral alignment plate is moved from the staple guide position to the waiting position (S16).

After a specified time since the start of the driving of the lateral alignment motor at S16 (S17), the stacker motor 20 is driven to move the stacker position from the staple position to the fold position, and a bundle transport operation is performed (S18).

After the bundle transport operation is ended, the lateral alignment motor 30 is again driven in the alignment direction to perform the lateral alignment operation (S19), and then is driven in the opening direction, and driving is performed to the guide position where the folding operation is performed (S20).

At the same time as the start of the driving of the lateral alignment motor 30 at S20, the folding motor 800 and the electromagnetic clutch 900 are turned on to start the folding operation (S21). Incidentally, a very high torque is required at the time of the folding operation of the folding motor 800, and a load applied to the electromagnetic clutch 900 is also large, and accordingly, waiting is made for lapse of a specified time after the electromagnetic clutch 900 is turned on, and then, driving of the folding motor 800 may be started.

The folding process is performed, the ejection transport by the pair of folding rollers 89 is performed and when the additional folding position detection sensor 71 detects the bundle of sheets (S22), the stacker motor 20 and the lateral alignment motor 30 are driven and a movement is made to the home position (S23, S24).

On the other hand, the pair of folding rollers 89 are driven for a specified number of pulses from the timing of the detection of the bundle of sheets by the additional folding position detection sensor 71 (see FIG. 2) at S22, and when the leading edge of the bundle of sheets reaches the additional folding position (S25, Yes), the driving of the folding motor 800 is stopped, and the bundle of sheets is stopped at the additional folding position (S26).

When the bundle of sheets is stopped at the additional folding position, the additional folding motor is driven to drive the additional folding roller 7 from the home position toward the near side direction (S27), and next is driven from the near side direction to the home position (S28), and the additional folding process is performed.

In the case where there is continuously a next job, the stacker motor 20 is driven in the middle of execution of the additional folding operation at S28, and the stacker is moved to the next sheet reception position (S29).

When the additional folding process is completed, the folding motor 800 is driven, and the ejection transport operation is started (S30).

After driving for the specified number of pulses is performed from the start of the driving of the folding motor at S30 (S31), in the case where there is continuously a next job similarly to the stacker, the lateral alignment motor 30 is driven, and the lateral alignment plate is moved to the next sheet reception position (S32).

In the case where it is detected that the ejection sensor is turned off by performing the ejection transport operation (S33, Yes), the folding motor 800 is driven for a specified number of pulses (S34), and then is stopped (S35).

In the case where there is continuously a next job, the process is continued from S4 shown in FIG. 9, and in the case where there is no next job, the process is ended, and waiting is made for a stop instruction from the image forming apparatus.

(Control of Stacker Waiting Position at the Time of a Folding Process)

In the structure as stated above, when the folding process is performed to a bundle of sheets, in the case where the number of sheets constituting the bundle of sheets to which the folding process is performed is large, or in the case where the folding process is performed to a sheet having a large mass such as a thick paper, even if the stacker performs positioning of the bundle of sheets at a prescribed position, there is a case where the bundle of sheets slides down during the folding process by the influence of gravidity or friction force, and an error occurs in the precision of the folding process.

FIG. 17 to FIG. 20 are views for explaining the above problem in the folding process of the bundle of sheets in detail.

Figure 13:
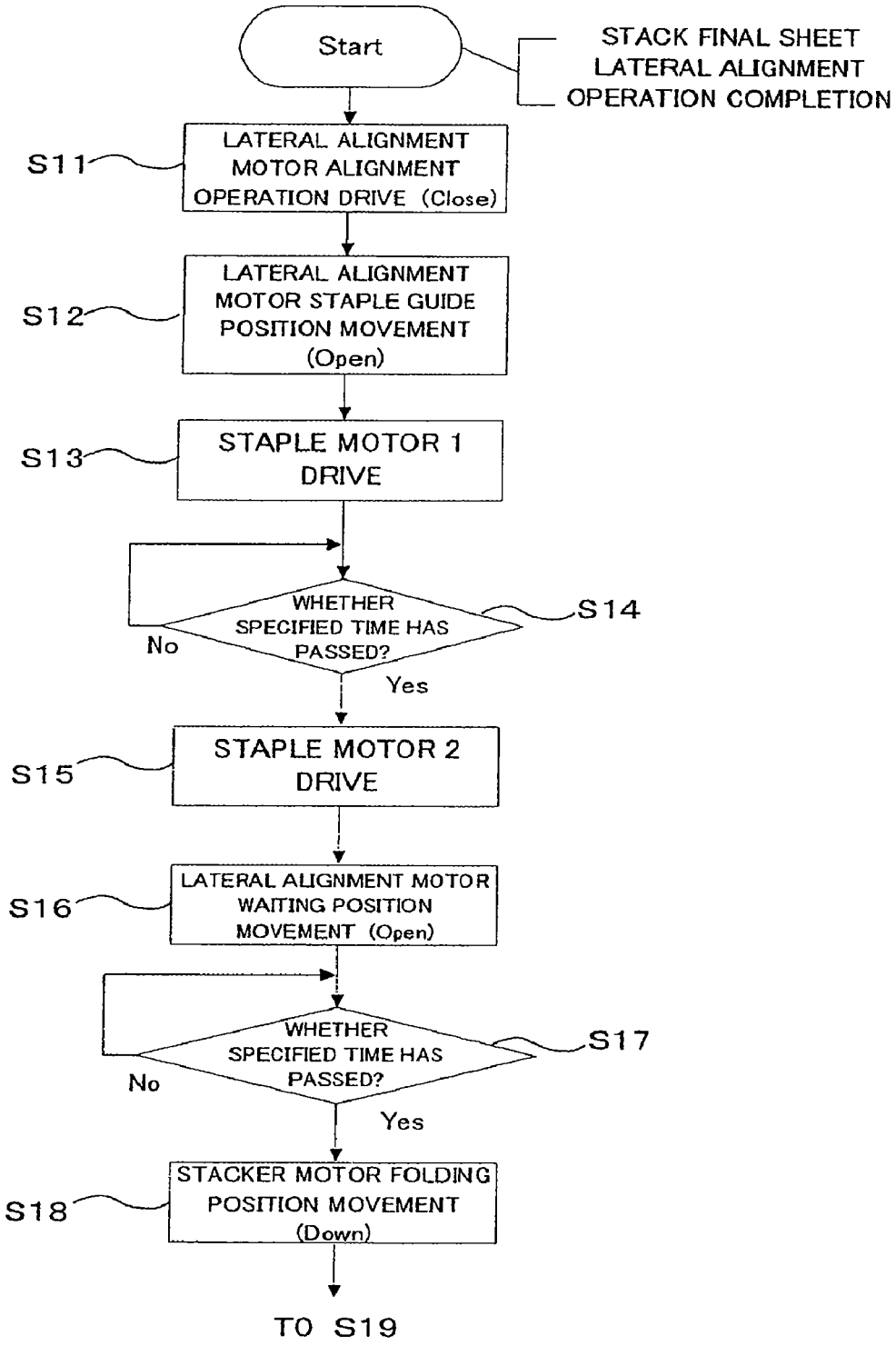
FIG. 13 is a view for explaining the flow of the operation in the sheet processing apparatus of the first embodiment of the invention.
Figure 14:
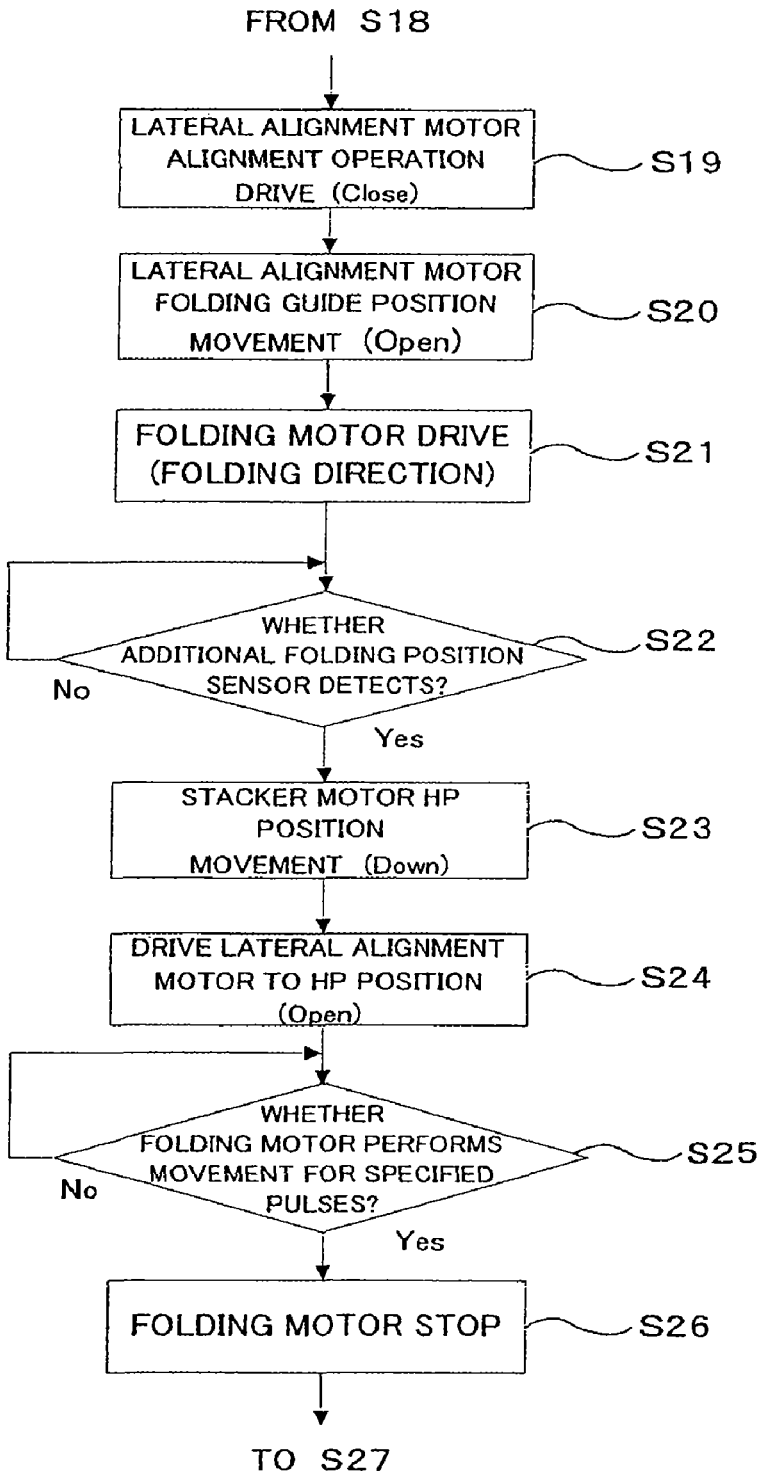
FIG. 14 is a view for explaining the flow of the operation in the sheet processing apparatus of the first embodiment of the invention.
Figure 15:
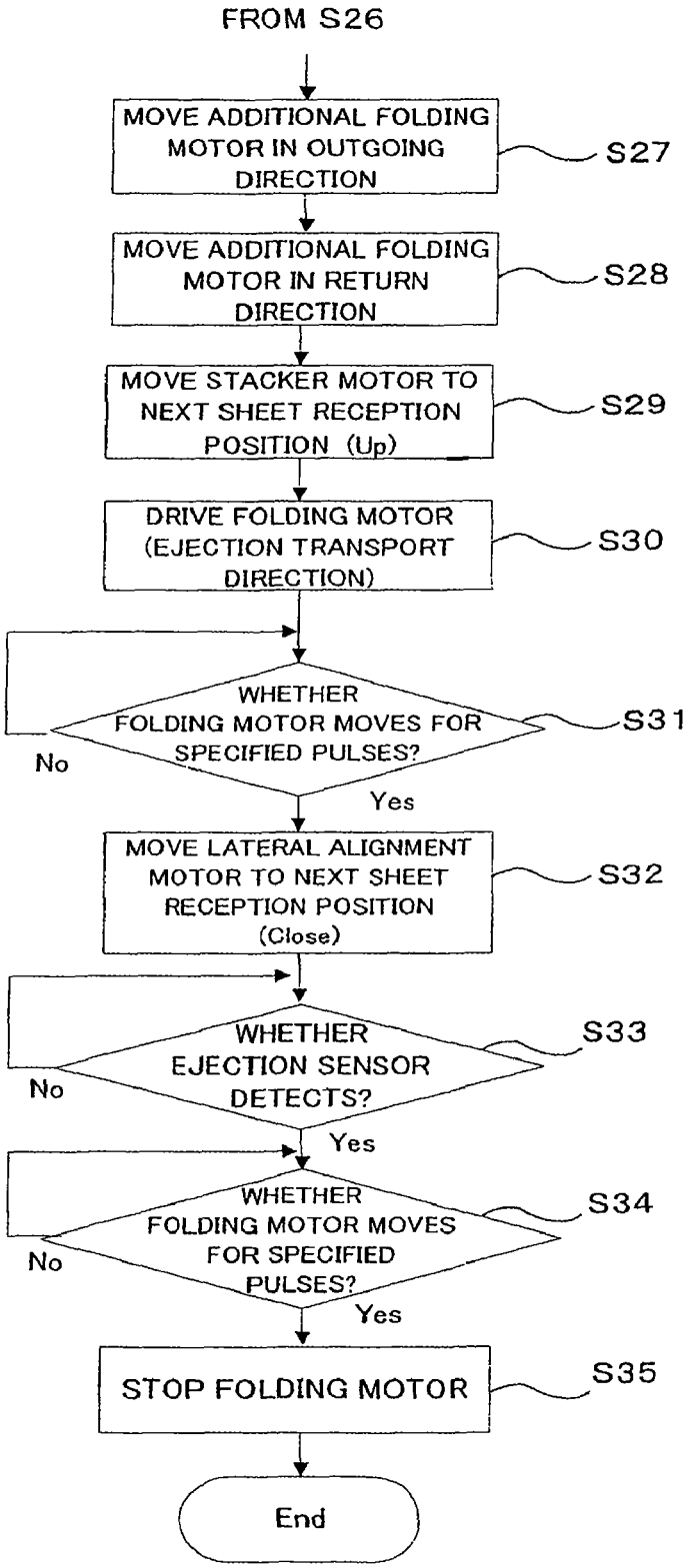
FIG. 15 is a view for explaining the flow of the operation in the sheet processing apparatus of the first embodiment of the invention.
Figure 16:
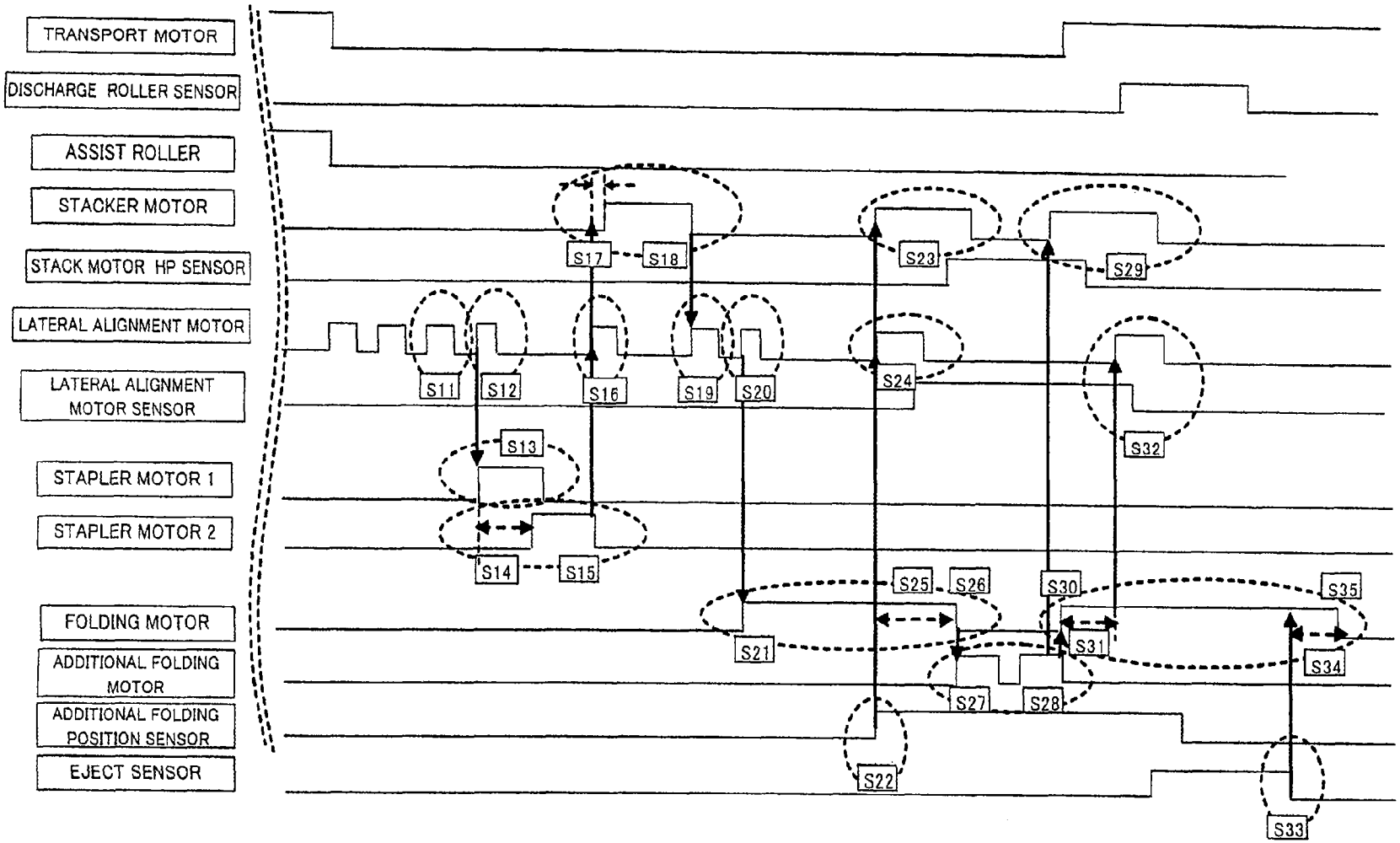
FIG. 16 is a view for explaining the flow of the operation in the sheet processing apparatus of the first embodiment of the invention.
Figure 17:
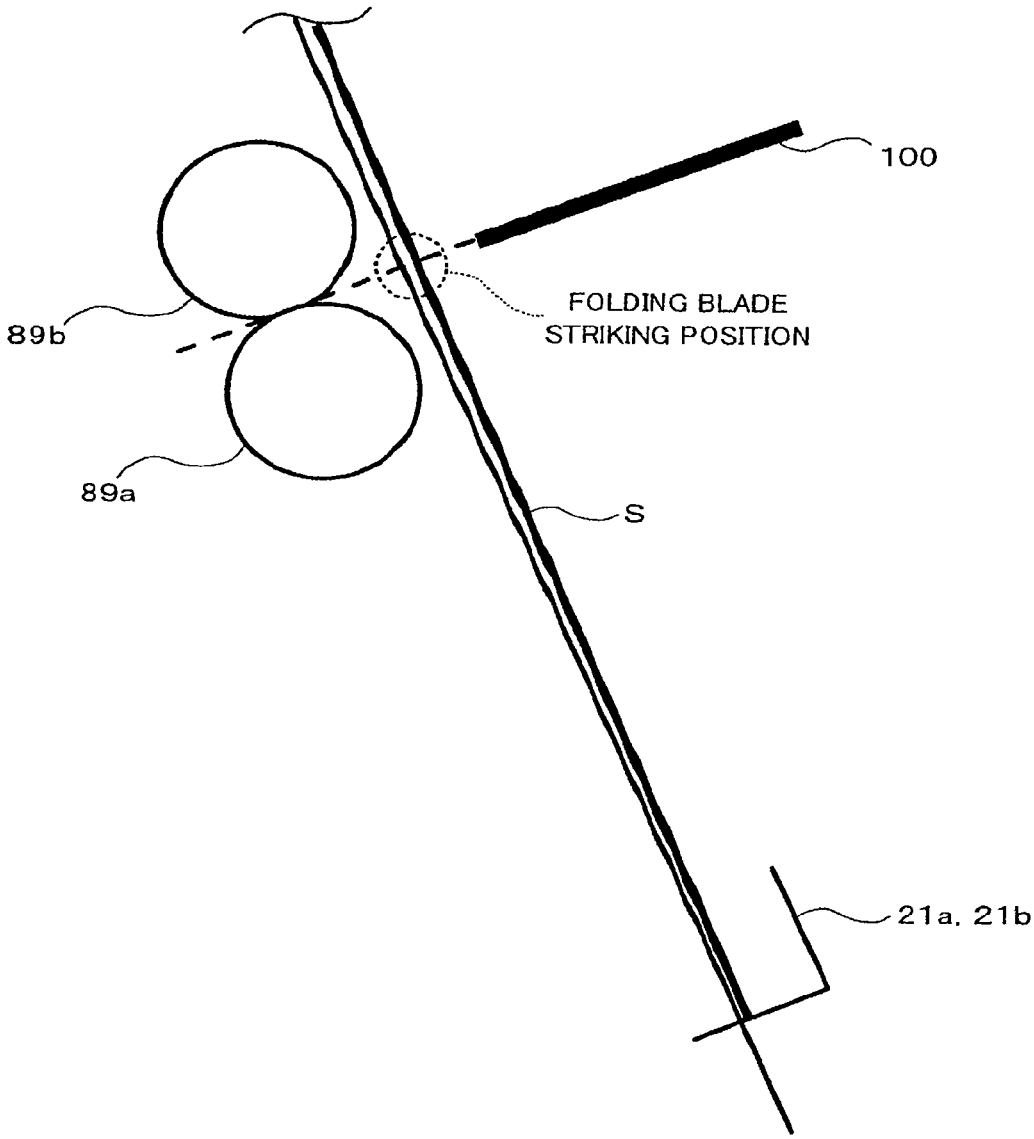
FIG. 17 is a view for explaining a problem in a folding process of a bundle of sheets in detail.
Figure 18:
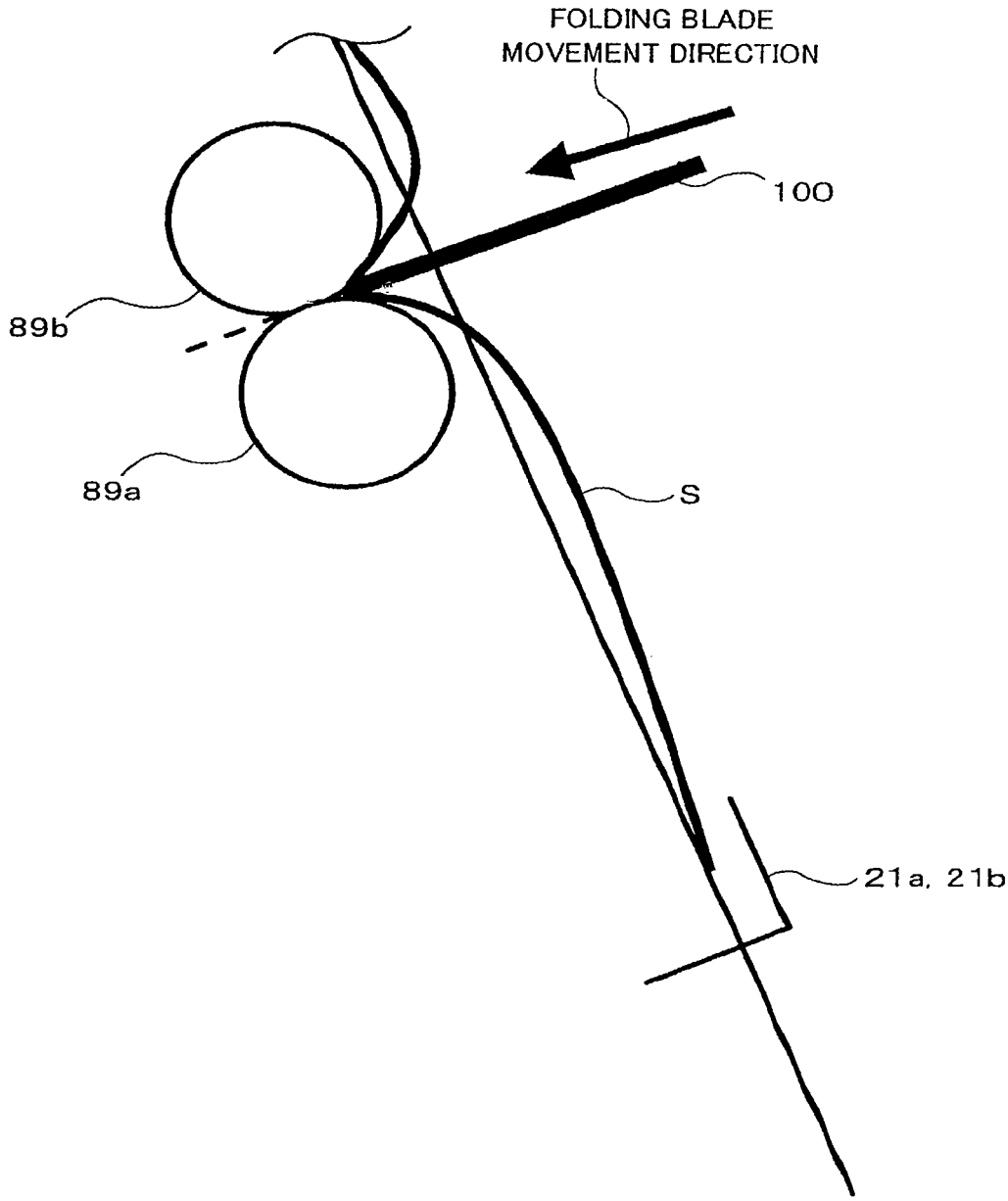
FIG. 18 is a view for explaining the problem in the folding process of the bundle of sheets in detail.

As shown in FIG. 17, for example, in the case where the number of sheets constituting the bundle of sheets S to which the folding process is performed is small, when the stacker pawl is aligned to the folding position at S18 shown in FIG. 13, the folding process after S21 is performed in the state where the sheet center part is aligned to the position of the folding blade 100, and the precision of the folding position is ensured (a fold is formed at the center position of the sheet and folding can be performed) as shown in FIG. 18.

Figure 19:
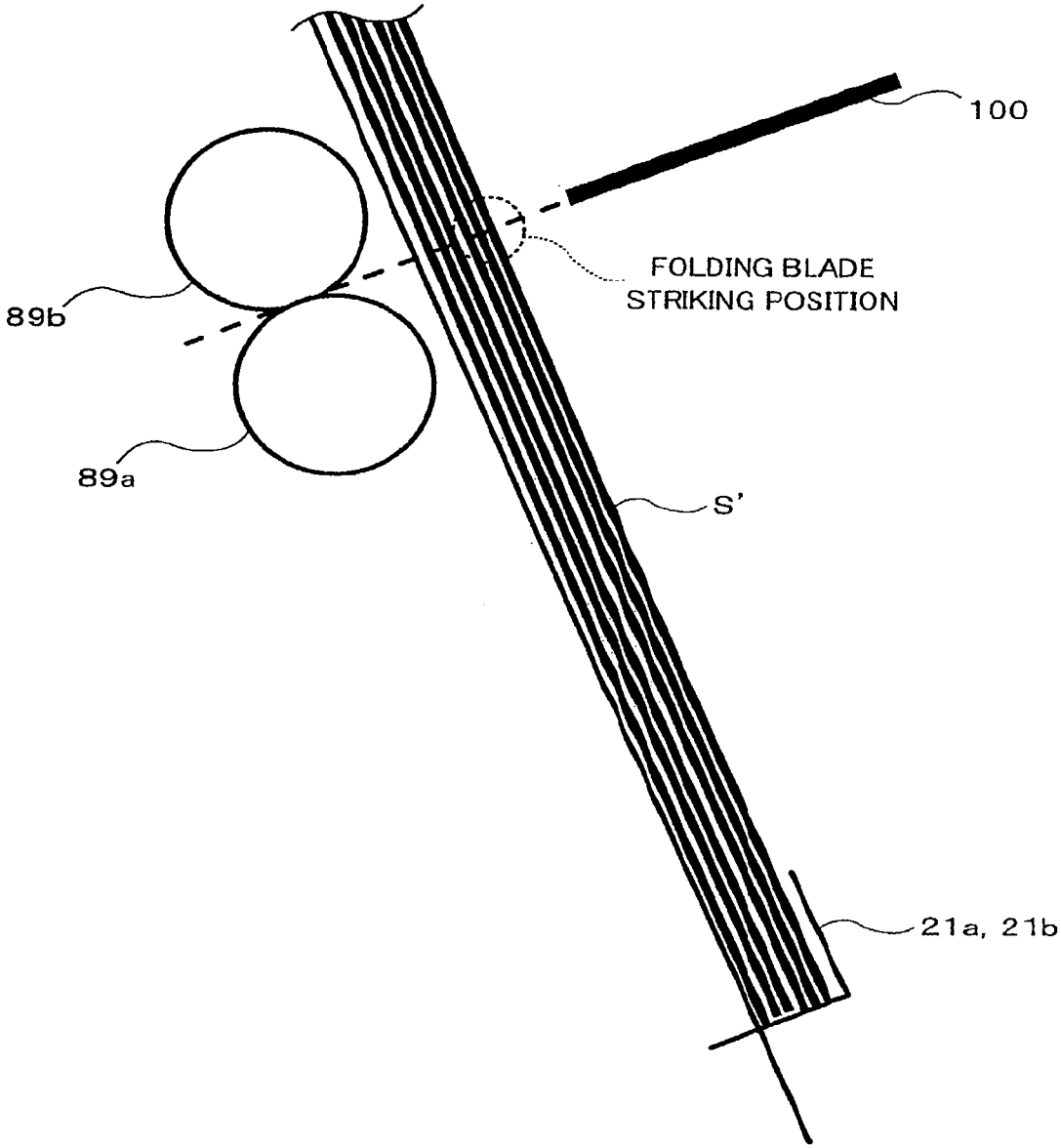
FIG. 19 is a view for explaining the problem in the folding process of the bundle of sheets in detail.
Figure 20:
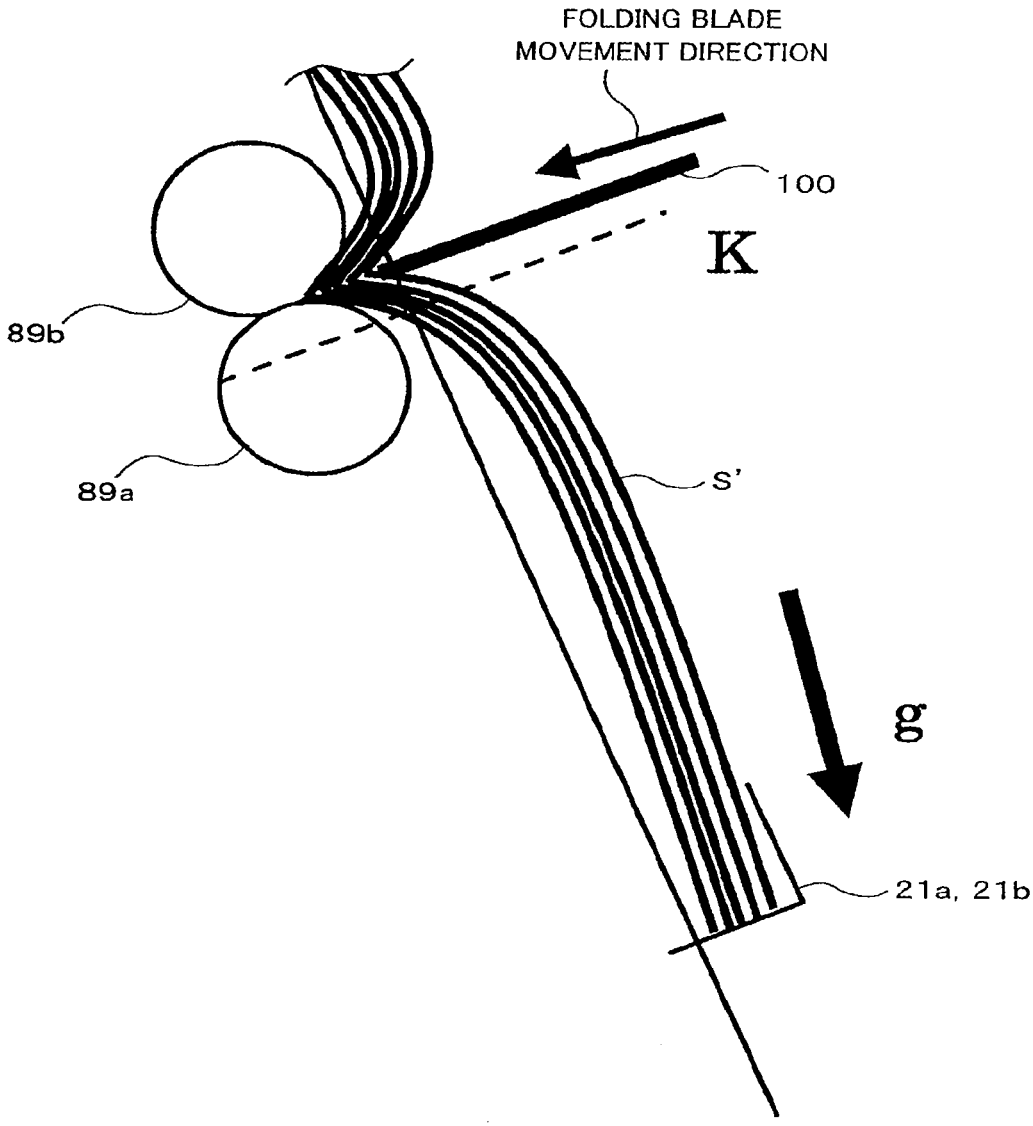
FIG. 20 is a view for explaining the problem in the folding process of the bundle of sheets in detail.

However, as shown in FIG. 19, for example, in the case where the number of sheets constituting the bundle of sheet S' to which a process is performed is large, even if the sheet center part is aligned to the position of the folding blade 100 in the process of S18 and the folding process is performed similarly to the case of FIG. 17, since the weight of the whole bundle of sheets S' is large, when the folding blade 100 presses them into the pair of folding rollers 89, the bundle of sheets S' do not follow. That is, the bundle of sheets S' slides down by the influence of gravity g in the middle of the folding process, the pair of folding rollers 89 nip a portion above the original center position K of the bundle of sheets S', and the bundle of sheets can not be folded at the proper folding position (see FIG. 20).

Then, in the sheet processing apparatus of this embodiment, in order to solve the problem as stated above, the following structure is adopted.

Figure 21:
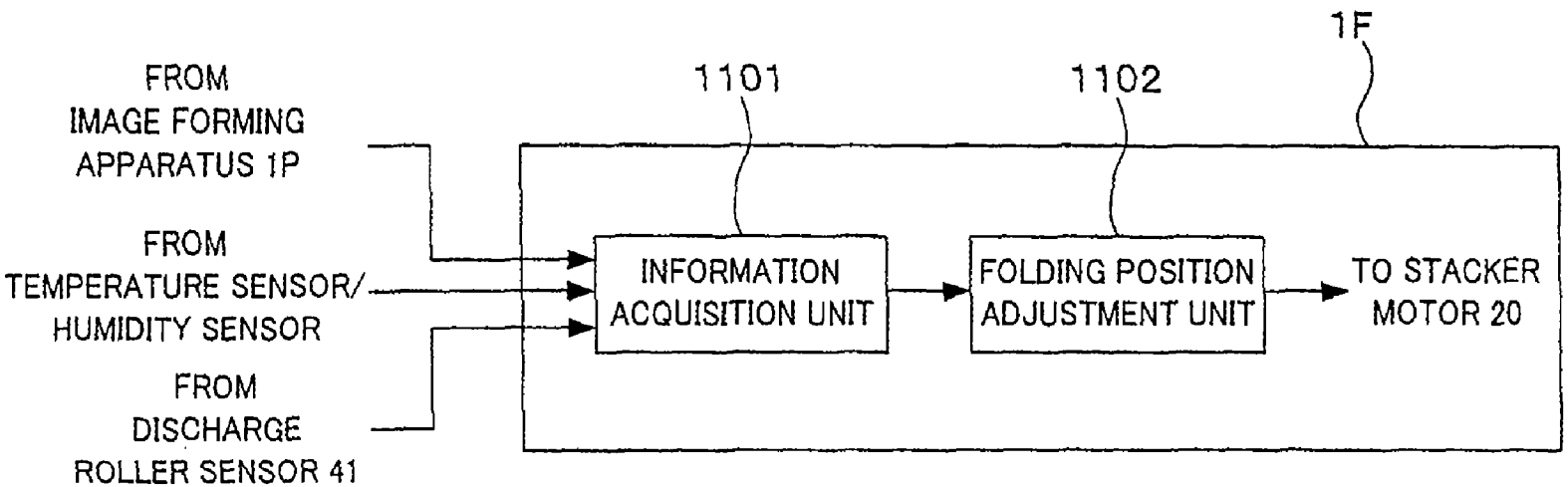
FIG. 21 is a functional block diagram of the sheet processing apparatus of the first embodiment of the invention.

FIG. 21 is a functional block diagram of the sheet processing apparatus according to the first embodiment of the invention. The sheet processing apparatus 1F of this embodiment includes an information acquisition unit 1101 and a folding position adjustment unit 1102. Incidentally, the fold position adjustment unit 1102 may be hardware independent of a CPU 801, may be a combination of the CPU 801 and software, or may be a combination of a processor different from the CPU 801 and software. For example, although the fold position adjustment unit 1102 may be one realized such that the CPU 801 executes a program stored in a MEMORY 802, no limitation is made to this.

The information acquisition unit 1101 acquires at least one of information relating to a bundle of sheets as an object of a folding process by the folding blade 100 and information relating to an environment in which the folding process is performed.

Specifically, the information acquisition unit 1101 acquires at least one of, for example, the number of sheets constituting the bundle of sheets as the object of the folding process (acquired from, for example, the image forming apparatus 1P), the material of a sheet constituting the bundle of sheets as the object of the folding process (acquired from, for example, the discharge roller sensor 41), the thickness of a sheet constituting the bundle of sheets as the object of the folding process (acquired from, for example, the discharge roller sensor 41), the type of a sheet constituting the bundle of sheets as the object of the folding process (acquired from, for example, the image forming apparatus 1P), the direction of a sheet constituting the bundle of sheets at the time when the folding process is performed (acquired from, for example, the image forming apparatus 1P), a temperature and a humidity (acquired from, for example, a not-shown temperature sensor and humidity sensor provided in the image forming apparatus 1P or the sheet processing apparatus 1F).

Incidentally, it is not always necessary that various information to be acquired in the information acquisition unit 1101 is acquired only in the sheet processing apparatus 1F, and the information can also be acquired from an external equipment communicably connected to the image forming apparatus 1P or the image processing apparatus M according to circumstances.

The folding position adjustment unit 1102 controls the stacker motor 20 based on the information acquired by the information acquisition unit 1101, changes the position of the stacker pawl 21, and adjusts the position where the folding blade 100 is brought into contact with the bundle of sheets as the object of the folding process.

Specifically, in the case where the information acquisition unit 1101 acquires the information relating to the number of sheets constituting the bundle of sheets as the object of the folding process, as the number of sheets constituting the bundle of sheets as the object of the folding process becomes large, the folding position adjustment unit 1102 lowers the position where the folding blade 100 is brought into contact with the bundle of sheets as the object of the folding process (the stacker pawl 21 is raised). Incidentally, when the number of sheets constituting the bundle of sheets is very small, for example, one or two, in the case where the influence exerted on the folding position is small, the adjustment of the contact position of the folding blade 100 is not performed till a specified number of sheets (for example, five sheets), and the adjustment may be performed only in the case where the number of sheets constituting the bundle of sheets is six or more.

Besides, in the case where the information acquisition unit 1101 acquires the information relating to the friction coefficient of a sheet constituting the bundle of sheets as the object of the folding process, as the friction coefficient of the sheet constituting the bundle of sheets as the object of the folding process becomes low, the bundle of sheets becomes liable to slide down at the time of the folding process, and accordingly, the folding position adjustment unit 1102 may lower the position where the folding blade 100 is brought into contact with the bundle of sheets as the object of the folding process.

Besides, in the case where the information acquisition unit 1101 acquires the information relating to the type of a sheet constituting the bundle of sheets as the object of the folding process, as the size of the sheet constituting the bundle of sheets as the object of the folding process becomes large, the weight of the whole bundle of sheets increases, and the bundle of sheets becomes liable to slide down at the time of the folding process. Accordingly, it is preferable that the folding position adjustment unit 1102 lowers the position where the folding blade 100 is brought into contact with the bundle of sheets as the object of the folding process.

As stated above, based on the information acquired in the information acquisition unit 1101, as the bending rigidity of the bundle of sheets as the object of the folding process becomes high, or the weight of the bundle of sheets as the object of the folding process becomes large, the operation of pressing the bundle of sheets by the folding blade 100 becomes hard to perform, and accordingly, the folding position adjustment unit 1102 lowers the position where the folding blade is brought into contact with the bundle of sheets as the object of the folding process.

Incidentally, it is desirable that the acquisition of various information by the information acquisition unit 1101 is performed on the sheet positioned at the side (side not close to the folding blade) closest to the pair of folding rollers 89 among the sheets constituting the bundle of sheets as the object of the folding process by the folding blade 100, which has especially a large influence on the relation to the pair of folding rollers 89 in the folding process.

The CPU 801 has a role to perform various processes in the sheet processing apparatus 1F, and has a role to realize various functions by executing programs stored in the memory 802. The memory 802 includes, for example, a ROM and a RAM, and has a role to store various information and programs used in the sheet processing apparatus 1F.

Further, according to the first embodiment, for example, the sheet processing apparatus having the structure as described below can be provided.

(1) In the sheet processing apparatus having the structure as described above, based on the information acquired by the information acquisition means, as the bending rigidity of the bundle of sheets as the object of the folding process becomes high, the folding position adjustment means lowers the position where the folding blade is brought into contact with the bundle of sheets as the object of the folding process.

(2) In the sheet processing apparatus having the structure as described above, based on the information acquired by the information acquisition means, as the weight of the bundle of sheets as the object of the folding process becomes high, the folding position adjustment means lowers the position where the folding blade is brought into contact with the bundle of sheets as the object of the folding process.

(3) In the sheet processing apparatus having the structure as described above, the information acquisition means acquires the information relating to the number of sheets constituting the bundle of sheets as the object of the folding process, and as the number of sheets constituting the bundle of sheets as the object of the folding process becomes large, the folding position adjustment means lowers the position where the folding blade is brought into contact with the bundle of sheets as the object of the folding process.

(4) In the sheet processing apparatus having the structure as described above, the information acquisition means acquires the information relating to the friction coefficient of a sheet constituting the bundle of sheets as the object of the folding process, and as the friction coefficient of the sheet constituting the bundle of sheets as the object of the folding process becomes low, the folding position adjustment means lowers the position where the folding blade is brought into contact with the bundle of sheets as the object of the folding process.

(5) In the sheet processing apparatus having the structure as described above, the information acquisition means acquires the information relating to the type of a sheet constituting the bundle of sheets as the object of the folding process, and as the size of the sheet constituting the bundle of sheets as the object of the folding process becomes large, the folding position adjustment means lowers the position where the folding blade is brought into contact with the bundle of sheets as the object of the folding process.

(6) In the sheet processing apparatus having the structure as described above, the information acquisition means acquires the information relating to a sheet positioned at the side farthest from the folding blade among the sheets constituting the bundle of sheets as the object of the folding process by the folding blade.

(7) In the sheet processing apparatus having the structure as described above, a stacker is provided which holds the bundle of sheets when the folding blade is brought into contact with the bundle of sheets in the folding process and can move substantially in parallel to a surface direction of the sheet at a time when the folding blade is brought into contact, and the folding position adjustment means changes the position of the stacker and adjusts the position where the folding blade is brought into contact with the bundle of sheets as the object of the folding process.

As described above, according to the embodiment, the high precision folding process can be stably realized irrespective of the number of sheets and the material of sheets constituting the bundle of sheets as the object of the folding process.

Second Embodiment

Next, a second embodiment of the invention will be described.

This embodiment is a modified example of the first embodiment. Hereinafter, a portion having the same function as a portion already described in the first embodiment is denoted by the same reference numeral and its description will be omitted.

(Assist by an Assist Roller at the Time of Transport of a Bundle of Sheets)

Hitherto, in a sheet processing apparatus for performing a specified process, such as a staple process or a folding process, to a sheet, after the staple process to a bundle of sheets is executed, the bundle of sheets is moved to a position where the folding process is performed.

In the movement of the bundle of sheets at this time, a structure is known in which a sheet bundle positioning stopper used at the time of the staple process is moved, and the bundle of sheets is made to follow the stopper by its own weight, and is moved to a specified folding process waiting position.

However, as in the related art, in the structure in which the retracting operation of the bundle of sheets from the stapler after the staple process is performed using the weight of the bundle of sheets, in the case where the number of sheets constituting the bundle of sheets to which the staple process is performed is large or in the case where the transport resistance of the bundle of sheets is large due to static electricity or the like, there is a case where the bundle transport can not be performed normally.

Then, in the sheet processing apparatus according to the second embodiment of the invention, in order to solve the problem as stated above, the following structure is adopted.

Figure 22:
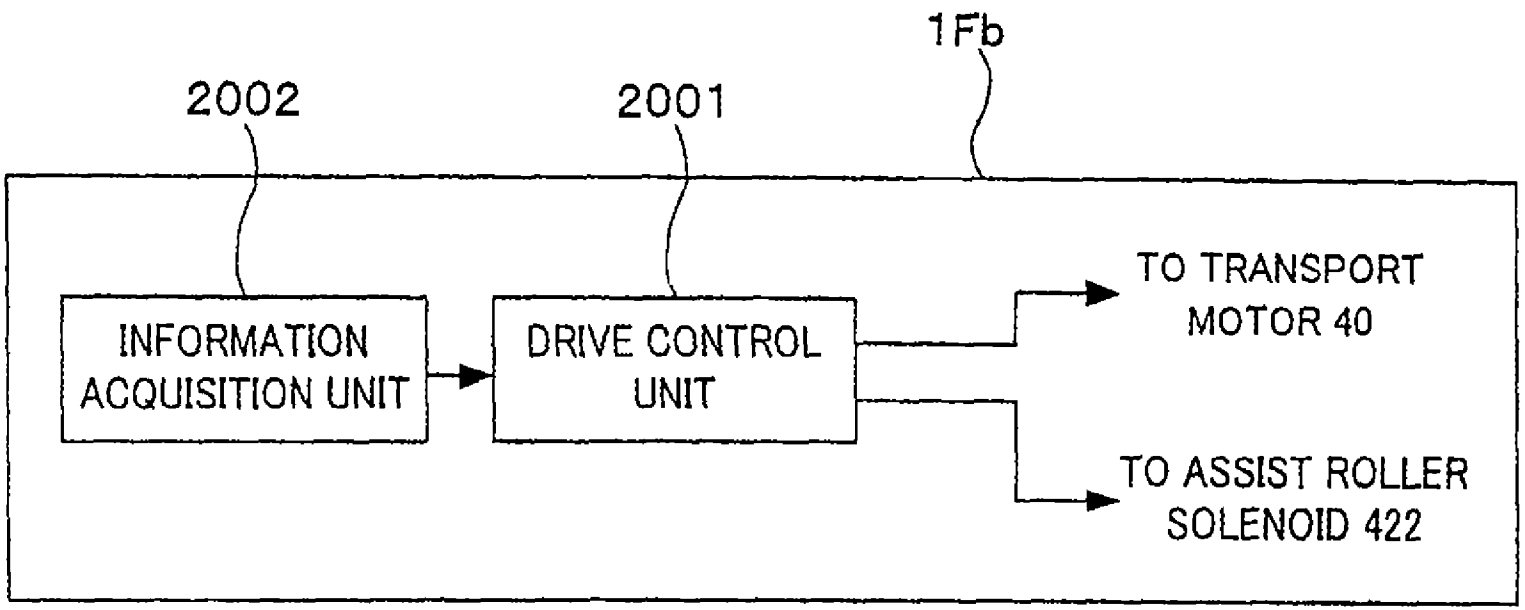
FIG. 22 is a functional block diagram of a sheet processing apparatus of a second embodiment of the invention.
Figure 23:
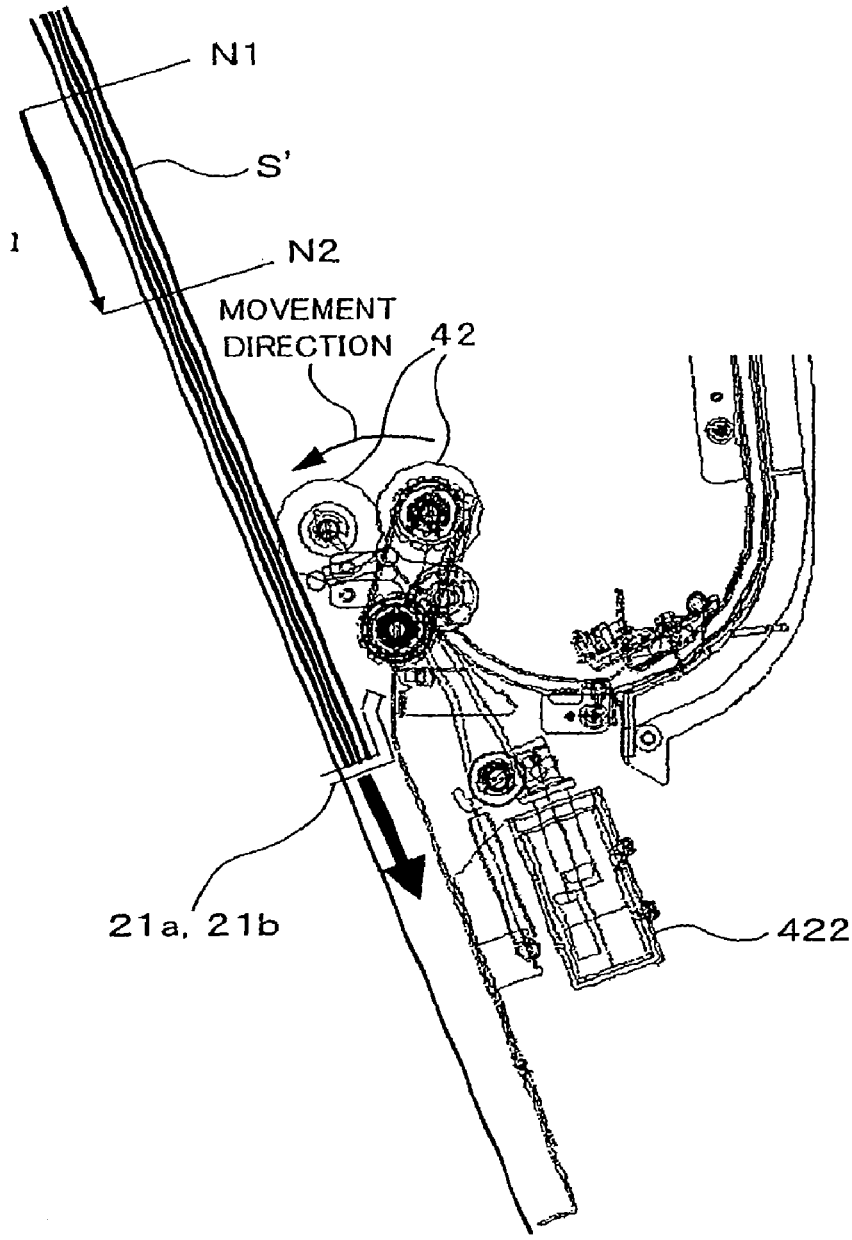
FIG. 23 is view for explaining an operation in the second embodiment of the invention.
Figure 24:
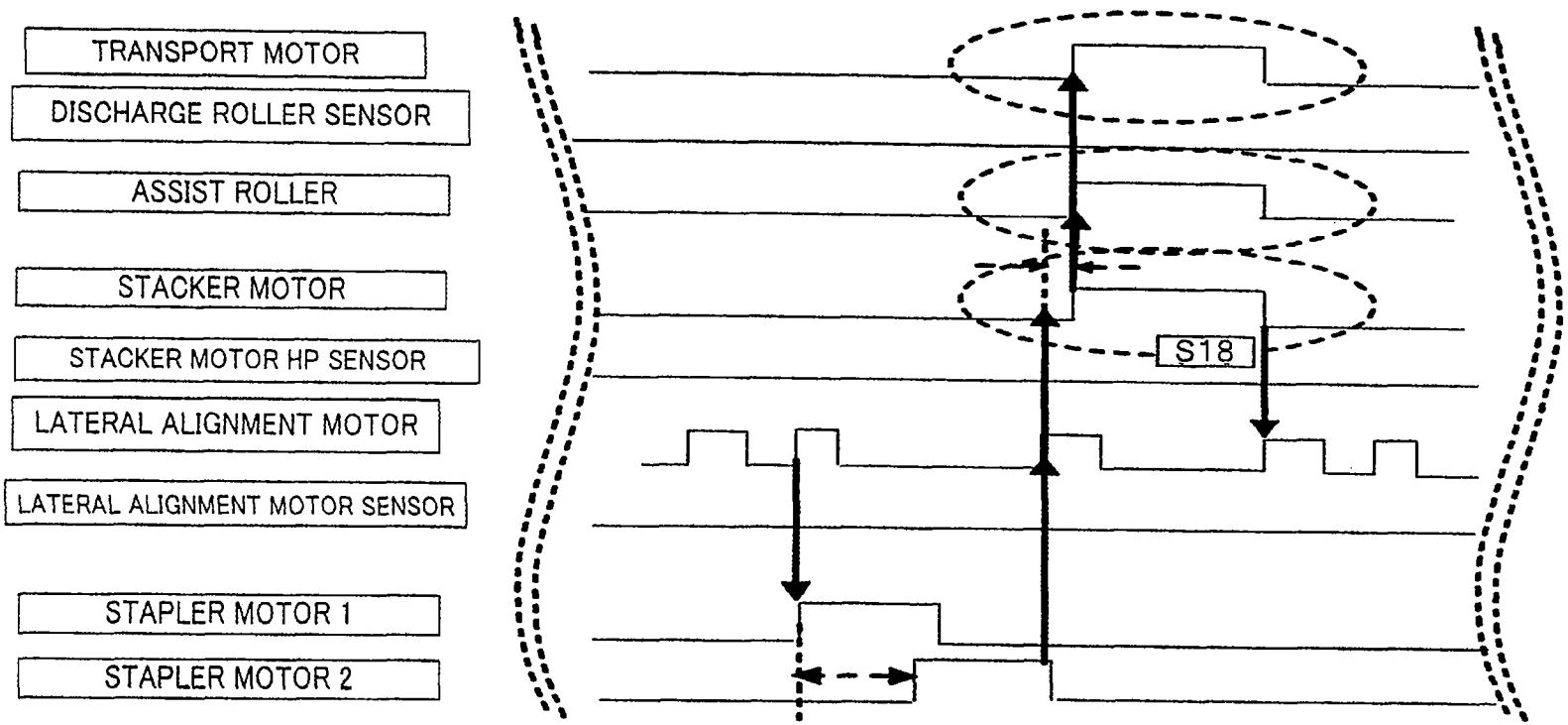

FIG. 22 is a functional block diagram in the sheet processing apparatus according to the second embodiment, FIG. 23 is a view for explaining an operation in the second embodiment, and FIG. 24 is a timing chart showing drive timings of an assist roller and the like. Incidentally, in FIG. 23, in a stack tray 1, the center position of a bundle of sheets at the time of execution of a staple process is N1, the center position of the bundle of sheets at the time of execution of a folding process is N2, and the distance of transport of the bundle of sheets from the position N1 to the position N2 is 1.

A sheet processing apparatus 1Fb of the embodiment includes a drive control unit 2001 and an information acquisition unit 2002. Incidentally, the drive control unit 2001 may be hardware independent of the CPU 801, may be a combination of the CPU 801 and software, or may be a combination of a processor different from the CPU 801 and software. For example, although the drive control unit 2001 may be one realized such that the CPU 801 executes a program stored in the MEMORY 802, no limitation is made to this.

Similarly to the case of the foregoing embodiment, an assist roller 42 (alignment roller) can come in contact with and separate from the sheet surface of a sheet held by a stacker 2, and has a function to strike the sheet against a reference position in the stacker 2 and to align it by bringing a rotating roller surface into contact with the sheet.

When a bundle of sheets S' subjected to the staple process is moved in a direction of retracting from a stapler 5 (direction of movement to a position where the folding process is performed) by the stacker 2, the drive control unit 2001 causes a transport motor 40 to rotate and drive and causes the assist roller 42 to have a driving force, and further, turns on an assist solenoid 422 and causes the assist roller 42 to come in contact with the bundle of sheets S' held by the stacker 2 and to assist the movement of the bundle of sheets S'.

The information acquisition unit 2002 acquires at least one of information (acquired from, for example, an image forming apparatus 1P) relating to the number of sheets constituting the bundle of sheets as the object of the staple process by the stapler 5, information (acquired from, for example, a discharge roller sensor 41) relating to the thickness of a sheet constituting the bundle of sheets as the object of the staple process by the stapler 5, and information (acquired from, for example, the image forming apparatus 1P) relating to the size, in the movement direction of the stacker 2, of a sheet constituting the bundle of sheets as the object of the staple process by the stapler 5.

In the case where the number of sheets constituting the bundle of sheets as the object of the staple process is a specified number or more, when they are moved in the direction of retracting from the stapler 5 by the stacker 2, the drive control unit 2001 brings the assist roller 42 into contact with the bundle of sheets held by the stacker 2. In general, when the number of sheets constituting the bundle of sheets is large, the thickness of the whole bundle of sheets becomes large, and there is a tendency that the friction force between the wall surface of the stack tray or the like and the bundle of sheets becomes high (transport resistance of the bundle of sheets becomes large). Thus, in the case where the number of sheets constituting the bundle of sheets is large, transport assist by the assist roller is performed, and the movement of the bundle of sheets in the direction of retracting from the stapler 5 can be stably performed.

Besides, the structure can also be made such that as the thickness of a sheet constituting the bundle of sheets as the object of the staple process becomes large, the drive control unit 2001 prolongs the time in which the assist roller 42 is in contact with the bundle of sheets held by the stacker 2 when the bundle of sheets subjected to the staple process is moved in the direction of retracting from the stapler 5 by the stacker 2.

This is because, when the thickness of the sheet constituting the bundle of sheets is large, the thickness of the whole bundle of sheets becomes large, and there is a tendency that the friction force between the wall surface of the stack tray or the like and the bundle of sheets becomes high (transport resistance of the bundle of sheets becomes large), and accordingly, the time in which the transport of the bundle of sheets is assisted by the assist roller 42 is made long.

In addition, when the bundle of sheets subjected to the staple process is moved in the direction of retracting from the stapler 5 by the stacker 2 (that is, the direction in which the bundle of sheets is transported to the sheet waiting position where the folding process is performed), it is desirable that as the size of a sheet constituting the bundle of sheets as the object of the staple process becomes large, the assist roller 42 is brought into contact with the bundle of sheets held by the stacker 2 at an early timing. In the case where the size of the sheet constituting the bundle of sheets is large, the lower edge of the sheet held by the stack tray is positioned below as compared with the sheet of a small size, it is preferable that the timing when the assist roller 42 is brought into contact with the bundle of sheets is advanced.

Besides, the drive control unit 2001 causes the assist roller 42 to come in contact with the bundle of sheets held by the stacker 2 until a timing later than the completion of the retracting operation of the bundle of sheets, which is subjected to the staple process, in the retracting direction from the stapler 5 by the stacker 2. By this, at the time of the completion of the retracting operation, the edge of the bundle of sheets can be aligned to the reference position of the stacker 2 without fail.

Besides, the drive control unit 2001 controls the transport motor 40 and the assist roller solenoid 422 so that after the assist roller 42 is brought into contact with the bundle of sheets held by the stacker 2, the assist roller 42 is separated from the bundle of sheets in the state where it remains rotated. By this, clearance for the sheet whose transport is assisted by the assist roller 42 is ensured, and it is possible to prevent a wrinkle or buckling from occurring in the bundle of sheets.

Besides, when the bundle of sheets subjected to the staple process is moved in the direction of retracting from the stapler 5 by the stacker 2, it is preferable that the drive control unit 2001 rotates and drives the roller 42, which is brought into contact with the bundle of sheets, at a peripheral speed faster than the retracting speed of the stacker 2. By doing so, it is possible to avoid such a situation that the assist roller 42 contrarily hinders the transport of the bundle of sheets by the stacker 2 in the case where the transport speed by the assist roller 42 is lower than the retracting speed (speed at which the bundle of sheets is moved) of the stacker 2.

Incidentally, it is preferable that the assist roller 42 of this embodiment is disposed at the position where it can come in contact with the downstream side position with respect to the center, in the retracting direction, of the bundle of sheets held by the stacker at the timing when the retracting operation, in the retracting direction from the stapler 5 by the stacker 2, of the bundle of sheets subjected to the staple process is started. This is because, when the movement of the bundle of sheets is assisted by the assist roller 42 which is brought into contact with the upstream side in the retracting direction, there is a fear that the bundle of sheets whose rear edge is pressed is bent.

As described above, according to the second embodiment of the invention, even in the case where the number of sheets constituting the bundle of sheets is large or in the case where the transport of the bundle of sheets is difficult due to the influence of static electricity or the like, when the bundle of sheets subjected to the staple process is moved in the direction of retracting from the stapler by the stacker, the transport of the bundle of sheets can be normally performed.

Further, according to the second embodiment of the invention, for example, the sheet processing apparatus having the following structure can be provided.

(1) In the sheet processing apparatus having the structure as described above, a folding process unit is further provided which is positioned on a movement path of the stacker and performs a folding process to a bundle of sheets transported to a specified folding position, and when the bundle of sheets subjected to the staple process is moved by the stacker from the specified position to the specified folding position, the drive control unit causes the alignment roller to come in contact with the bundle of sheets held by the stacker and causes it to assist the movement of the bundle of sheets.

(2) In the sheet processing apparatus having the structure as described above, folding process means is further provided which is positioned on a movement path of the stacker and performs a folding process to a bundle of sheets transported to a specified folding position, and when the bundle of sheets subjected to the staple process is moved by the stacker from the specified position to the specified folding position, the drive control means causes the alignment roller to come in contact with the bundle of sheets held by the stacker and causes it to assist the movement of the bundle of sheets.

(3) In the sheet processing method having the structure as described above, the sheet processing apparatus further includes a folding process unit which is positioned on a movement path of the stacker and performs a folding process to a bundle of sheets transported to a specified folding position, and when the bundle of sheets subjected to the staple process is moved by the stacker from the specified position to the specified folding position, the alignment roller is brought into contact with the bundle of sheets held by the stacker to assist the movement of the bundle of sheets.

As described above, according to this embodiment, it is possible to provide the technique in which the retracting operation of the bundle of sheets subjected to the staple process from the stapler can be stably performed irrespective of the number of sheets constituting the bundle of sheets, the transport resistance and the like.

Third Embodiment

Next, a third embodiment of the invention will be described.

This embodiment is a modified example of the foregoing respective embodiments. Hereinafter, a portion having the same function as a portion already described in the foregoing embodiments is denoted by the same reference numeral and its description will be omitted.

(Occurrence of Sheet Jam in the Vicinity of a Staple Unit is Prevented by an Elastic Sheet)

In general, it is preferable that a stapler 5 to perform a staple process to a bundle of sheets and a pair of folding rollers 89 are close to each other in view of the reduction in size of an apparatus.

In the structure in which both are close to each other, it is difficult to provide a transport guide and a shutter constituting the wall surface of a sheet transport path between the stapler 5 and the pair of folding rollers 89, and a jam is very liable to occur in the sheet transport between the transport surface and the stapler.

Then, in a sheet processing apparatus according to the third embodiment, in order to solve the problem as stated above, the following structure is adopted.

Figure 25:
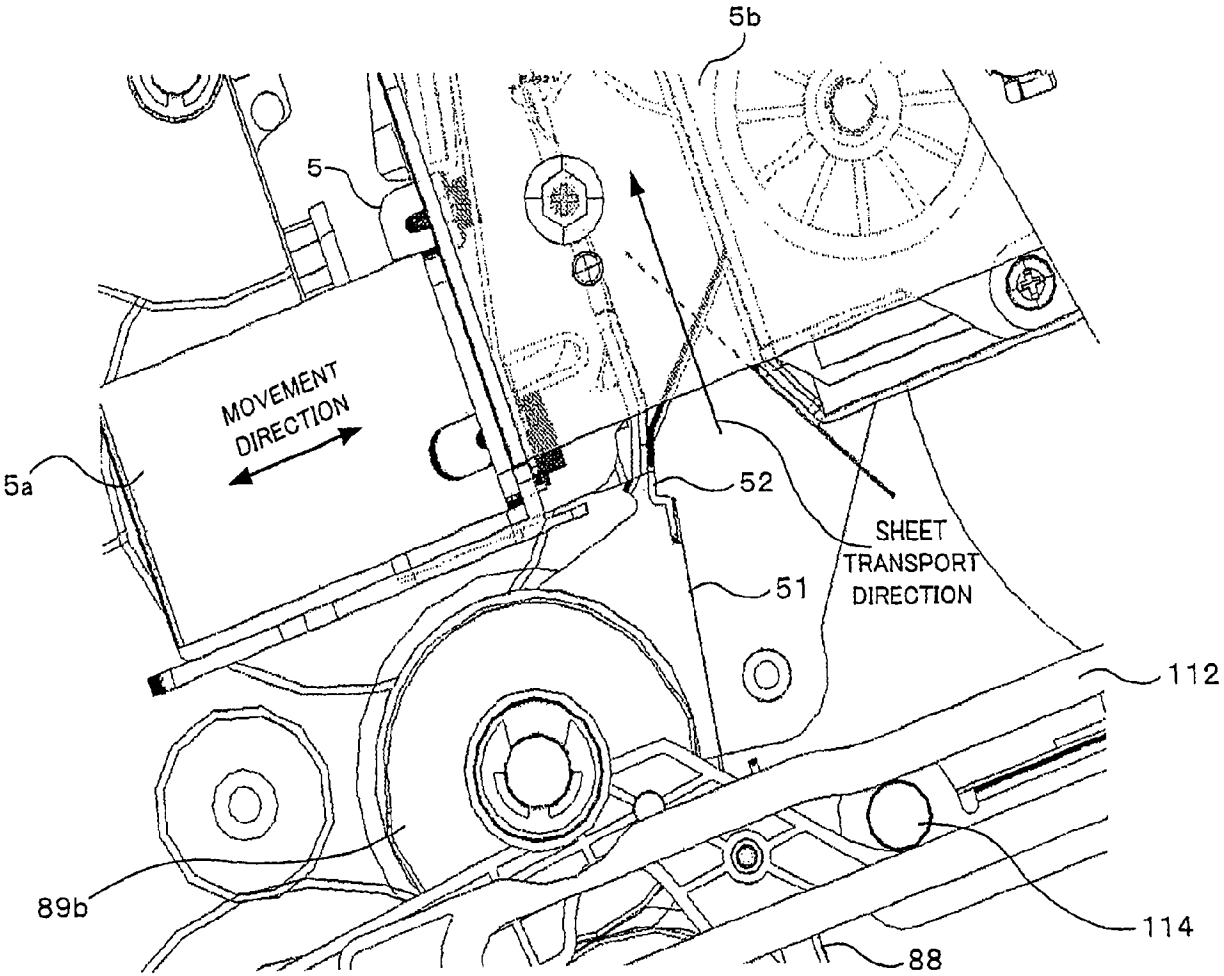
FIG. 25 is a view showing the details of a structure in the vicinity of a pair of folding rollers 89 in a third embodiment of the invention.
Figure 26:
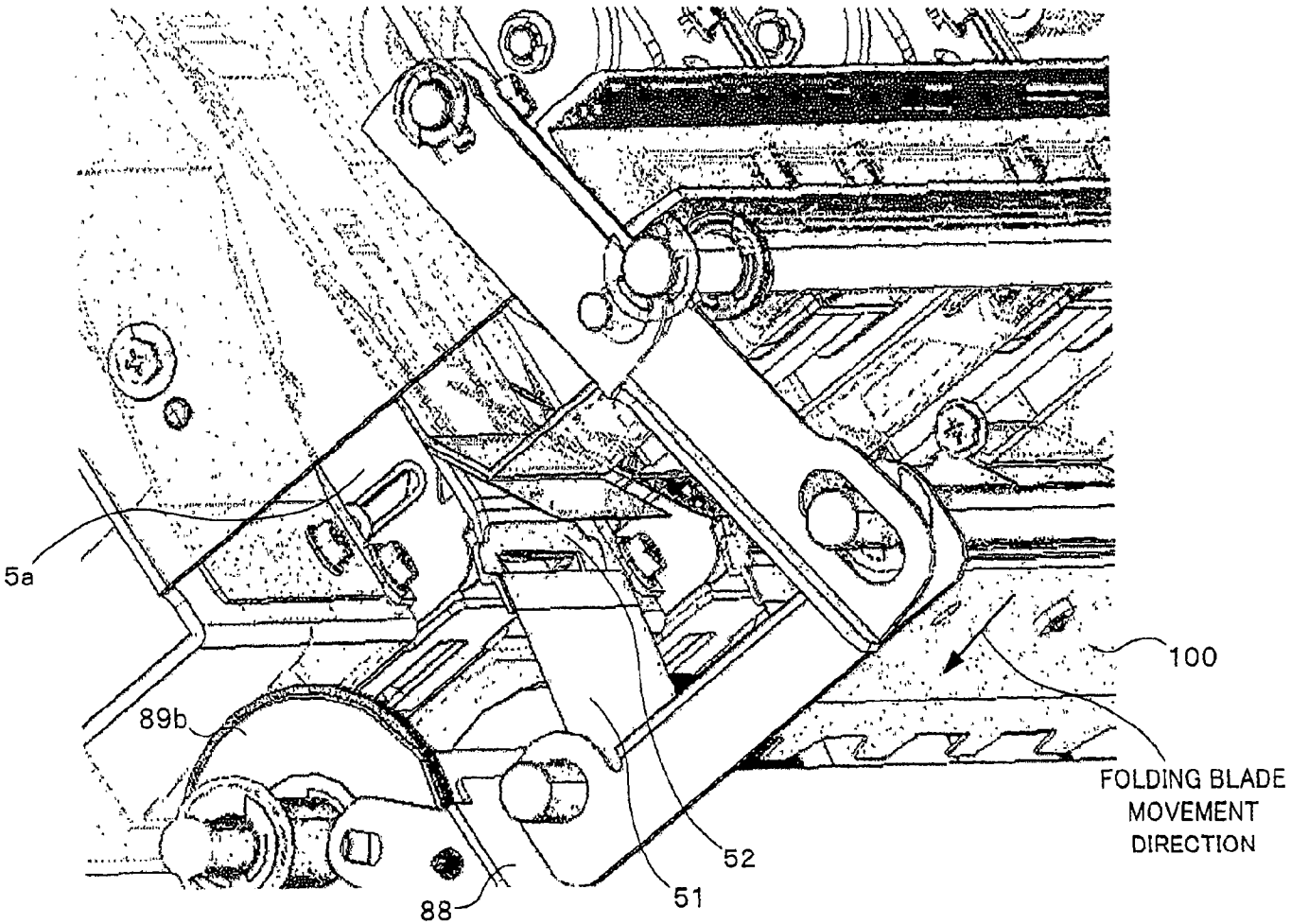
FIG. 26 is a view showing the details of the structure in the vicinity of the pair of folding rollers 89 in the third embodiment of the invention.

FIG. 25 and FIG. 26 are views showing the details of the structure in the vicinity of the pair of folding rollers 89 in the third embodiment of the invention.

The stapler 5 in the sheet processing apparatus of this embodiment includes a clincher (press unit) 5*b* and a driver (reception unit) 5*a*.

The clincher 5*b* has a role to press the sheet surface of a bundle of sheets to a sheet loading reference surface of the driver 5*a* when the staple process is performed and to bend the leading edge of a needle stapled into the bundle of sheets by the driver 5*a*.

Besides, the driver 5*a* is disposed to face the inside of the sheet transport path from a hole provided in the inner wall of the sheet transport path, and has a role to elastically receive the bundle of sheets pressed by the clincher 5*b* and to supply a staple.

The clincher 5*b* and the driver 5*a* cooperate with each other in this way, and the staple process to the bundle of sheets is performed.

Besides, in the sheet processing apparatus of this embodiment, in order to guide the leading edge of a sheet transported to the stapler 5 to the sheet loading reference surface of the driver 5*a*, an elastic sheet (corresponding to an elastic member) 51 having flexibility is provided. The elastic sheet 51 is formed of, for example, a film-like member made of resin.

One end of the elastic sheet 51 is supported by a holding member 52 fixed to the driver 5*a* and made of a material having high rigidity (for example, made of metal or resin), and the elastic sheet extends to be inclined toward the inner wall of the sheet transport path on the side where the driver 5*a* is provided or toward the pair of folding rollers 89, and toward the upstream side in the sheet transport direction (to, at least, the position where the vicinity of the downstream side end of the roller surface of the folding roller in the sheet transport direction is covered).

By disposing the elastic sheet 51 as stated above, in the case where the bundle of sheets subjected to the staple process by the stapler 5 is lowered to the folding position of the pair of folding rollers 89 (folding process unit) by the stacker 2, it is possible to prevent the bundle of sheets or the staple from being caught by the elastic sheet 51. Besides, by covering the gap between the stapler 5 and the pair of folding rollers 89 by the elastic sheet 51, it is possible to prevent that the sheet enters the gap and a jam occurs.

Besides, in the sheet processing apparatus of this embodiment, when the sheet transported in the transport path A is loaded on the stack tray 1, in order to prevent the leading edge of the sheet from interfering with the pair of folding rollers 89, a shutter 88 capable of covering the pair of folding rollers 89 is provided. The elastic sheet 51 fixed to the driver 5*a* scoops the leading edge of the sheet having passed through the upper surface of the shutter 88 and guides the leading edge of the sheet to the sheet loading reference surface of the driver 5*a*.

The driver 5*a* in this embodiment can be moved by 10 mm in the direction of retracting from the sheet transport path at the time of the staple process, and the elastic sheet 51 follows the movement of the driver 5*a* without disturbing the loading state of the bundle of sheets positioned on the sheet loading reference surface of the driver 5*a*, and deforms along the outer shape of the folding roller 89*b*.

As described above, according to the third embodiment of the invention, the pair of folding rollers 89 for the folding process and the stapler 5 for the staple process are disposed to be close to each other while the occurrence of a sheet jam is avoided, and a contribution can made to the improvement of productivity.

Besides, since the elastic sheet is adopted as the member for sheet guide to the sheet loading reference surface of the driver 5*a*, flexible handling becomes possible irrespective of whether the sheet as the object of the staple process is a thick paper or a thin paper, and the staple process having no bad influence on the deformation of the sheet at the time of the staple process can be realized.

Fourth Embodiment

Next, a fourth embodiment of the invention will be described.

This embodiment is a modified example of the foregoing respective embodiments. Hereinafter, a portion having the same function as a portion already described in the foregoing embodiments is denoted by the same reference numeral and its description will be omitted.

(Control of Sheet Bundle Transport Speed by a Pair of Folding Rollers at the Time of a Folding Process)

In a sheet processing apparatus for performing a folding process to a bundle of sheets by a pair of folding rollers 89 and a folding blade 100, a large rotation load is applied to the pair of folding rollers 89 from when the bundle of sheets as the object of the folding process is pressed into the pair of folding rollers 89 to when the folding process by the pair of folding rollers 89 is completed. Thus, in order to provide a high torque at the pair of folding rollers 89, it is general that the rotation speed of a motor is reduced by a gear train, and the pair of folding rollers 89 is rotated and driven only in the state of the reduced rotation speed (state of low speed rotation and high torque).

However, the very large torque is required in the folding process of the bundle of sheets only from when the bundle of sheets as the object of the folding process is pressed into the pair of rollers 89 to when the folding process by the pair of folding rollers 89 is completed, and in the rotation driving of the pair of rollers 89 in a period other than that, a high torque is not necessarily required as in the transport of the bundle of sheets to the downstream side after the folding process.

Thus, in view of throughput, there is a problem when the pair of folding rollers 89 is driven at the low speed in order to provide the high torque even in the mere transport of a bundle of sheets in which the high torque is not required as stated above.

Hereinafter, drive control of the pair of folding rollers 89 in the sheet processing apparatus of the embodiment will be described in detail.

Figure 27:
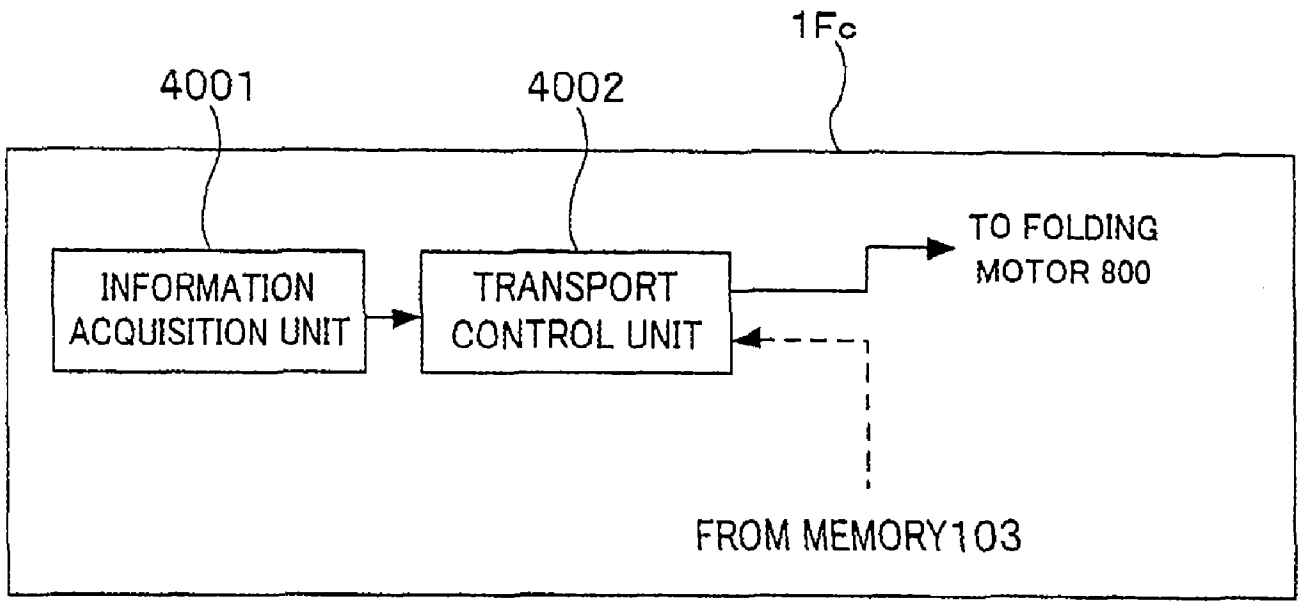
FIG. 27 is a functional block diagram of a sheet processing apparatus of a fourth embodiment of the invention.
Figure 28:
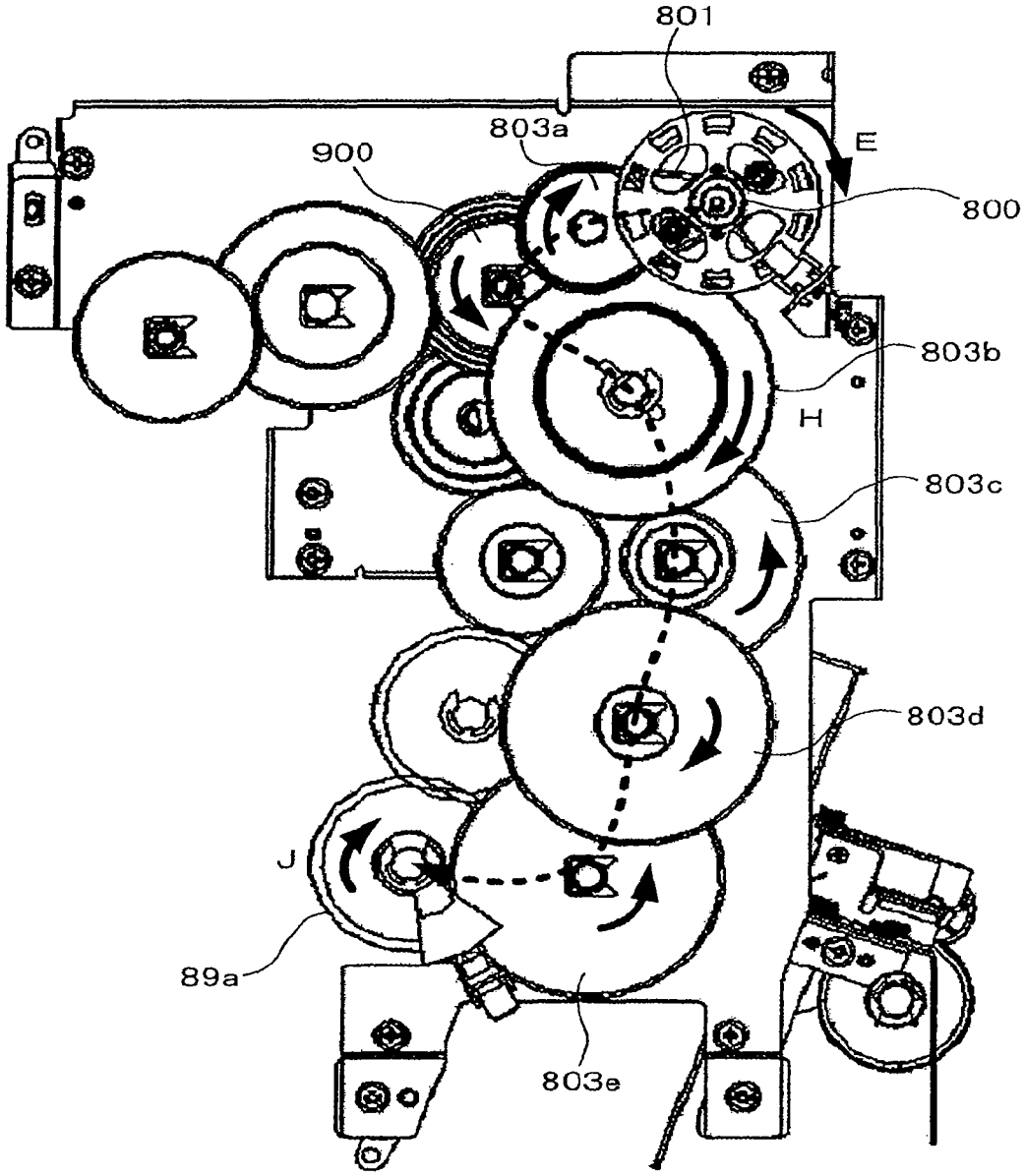
FIG. 28 is a structural view for explaining a drive mechanism to rotate and drive a pair of folding rollers 89 in the fourth embodiment of the invention.
Figure 29:
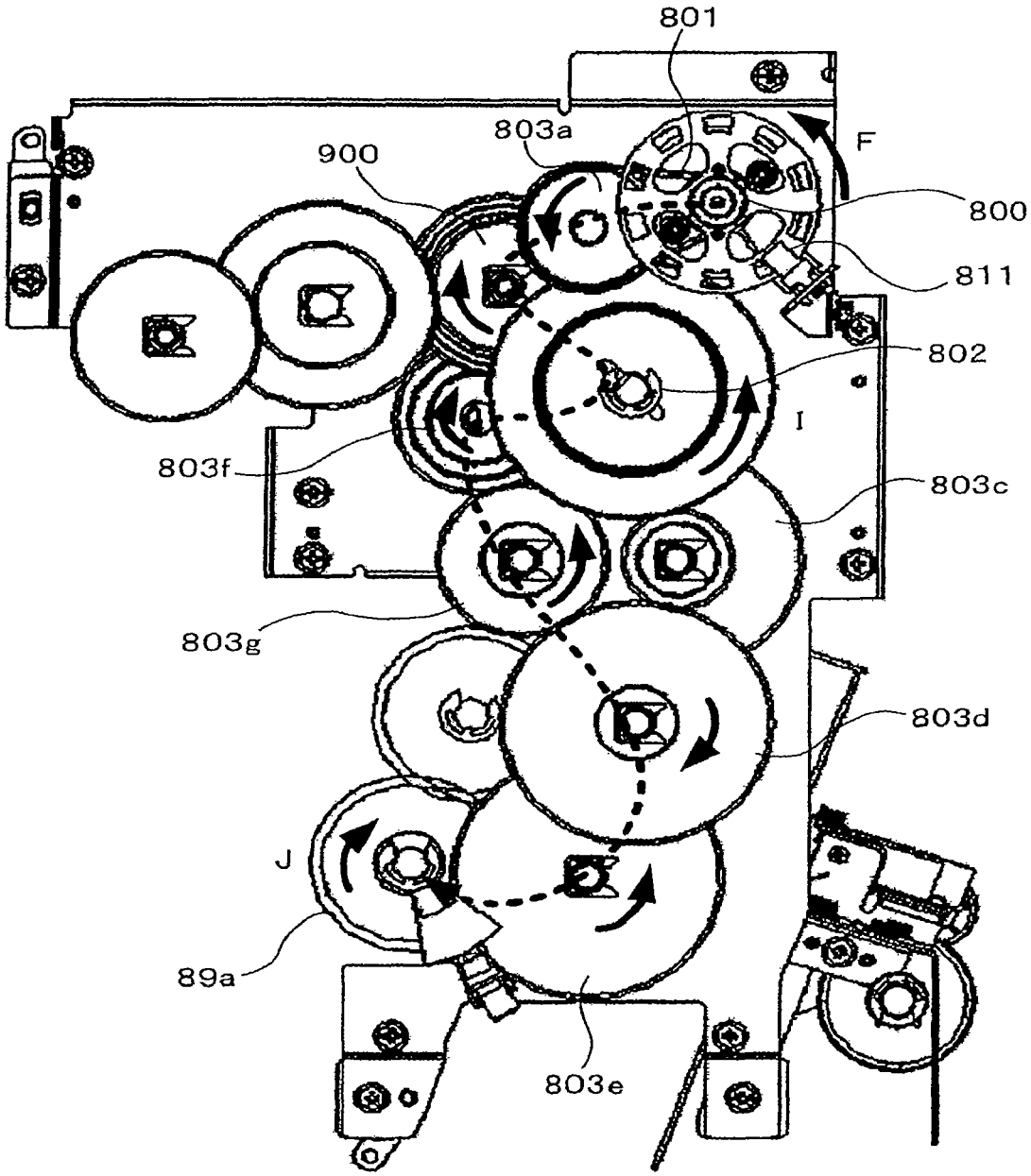
FIG. 29 is a structural view for explaining the drive mechanism to rotate and drive the pair of folding rollers 89 in the fourth embodiment of the invention.
Figure 30:
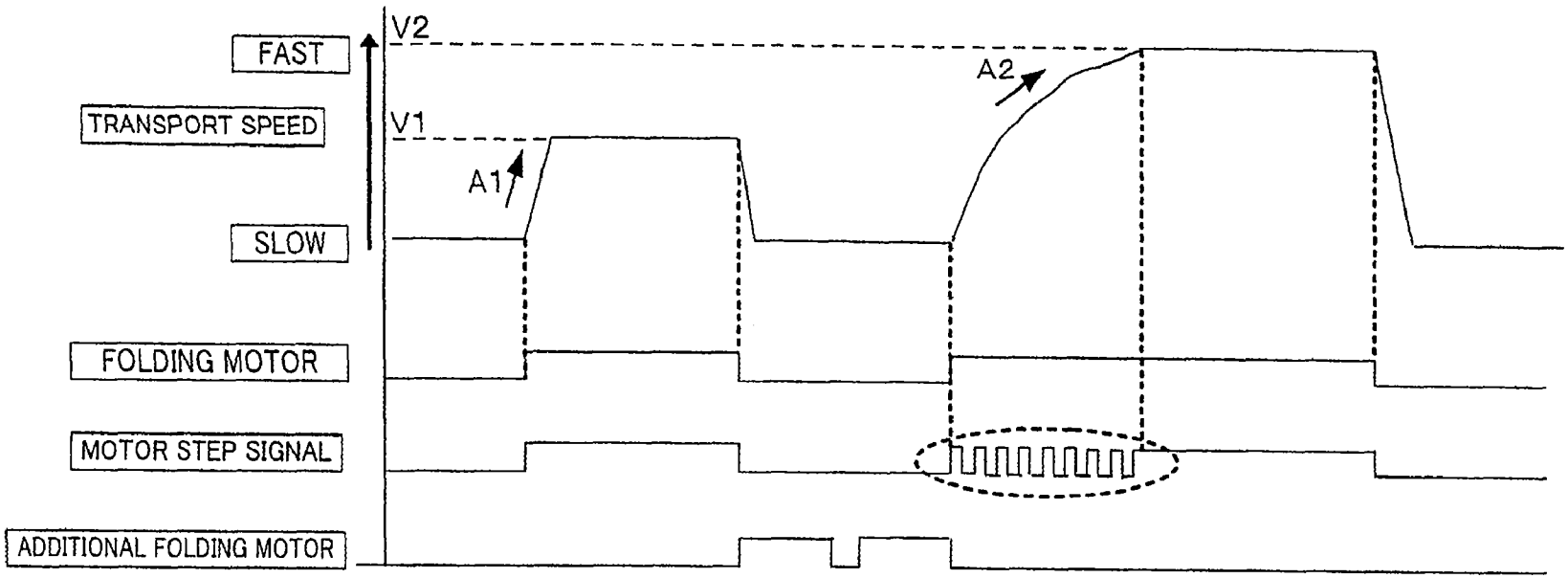
FIG. 30 is a timing chart for explaining the drive control of rotation driving of the pair of folding rollers 89 in the fourth embodiment of the invention.

FIG. 27 is a functional block diagram of the sheet processing apparatus according to the fourth embodiment, FIG. 28 and FIG. 29 are structural views for explaining a drive mechanism to rotate and drive the pair of folding rollers 89 in the fourth embodiment of the invention, and FIG. 30 is a timing chart for explaining the drive control in the rotation driving of the pair of folding rollers 89 in the fourth embodiment.

First, a functional block of the sheet processing apparatus of the embodiment will be described.

The sheet processing apparatus 1Fc of the embodiment includes an information acquisition unit 4001, a transport control unit 4002, a CPU 801 and a memory 802. Incidentally, the transport control unit 4002 may be hardware independent of the CPU 801, may be a combination of the CPU 801 and software, or may be a combination of a processor different from the CPU 801 and software. For example, although the transport control unit 4002 may be one realized such that the CPU 801 executes a program stored in the MEMORY 802, no limitation is made to this.

The information acquisition unit 4001 acquires information (acquired from, for example, an image forming apparatus 1P) relating to the number of sheets constituting the bundle of sheets as the object of the folding process by the folding blade 100, information (acquired from, for example, a discharge roller sensor 41) relating to the thickness of a sheet constituting the bundle of sheets as the object of the folding process by the folding blade 100, and the like.

The transport control unit 4002 controls a folding motor 800 to switch a sheet transport speed of the pair of folding rollers 89 from a first transport speed to a second transport speed at a specified timing between when the folding blade 100 finishes the pressing operation of the bundle of sheets and starts to a return operation to a waiting position and when the rear edge of the bundle of sheets pressed into the nip part of the pair of folding rollers 89 by the folding blade 100 passes through the nip of the pair of folding rollers 89 (preferably, between when the return operation is started and when the folding blade 100 is stopped at the specified waiting position).

The drive control of the folding motor 800 by the transport control unit 4002 as stated above is performed based on information of a data table, a timing chart, a function and the like held in, for example, the transport control unit 4002 or the memory 802.

Next, the details of the drive control of the pair of folding rollers 89 in the sheet processing apparatus of the embodiment will be described.

A one-way clutch 802 is connected to a gear 803*b* to transmit driving from the folding motor 800 to the pair of folding rollers 89.

For example, the folding motor 800 is rotated in an arrow E direction shown in FIG. 28. Then, the gear 803*b* is rotated in an arrow H direction through a timing belt 801, a gear 803*a* and an electromagnetic clutch 900. When the gear 803*b* is rotated in the arrow H direction, the driving is transmitted to a gear 803*c*, and a driving side folding roller 89*a* is rotated and driven in an arrow J direction through a gear 803*d* and a gear 803*e*.

As stated above, when the folding motor 800 is rotated in the arrow E direction, the driving force is transmitted through the gear train using the gear 803*c* having a large speed reduction ratio, and the folding roller 89 can be rotated at low speed (first transport speed) and high torque.

On the other hand, in the case where the folding motor 800 is rotated in an arrow F direction shown in FIG. 29, the timing belt 801, the gear 803*a* and the electromagnetic clutch 900 are driven in the direction opposite to the rotation direction shown in FIG. 28, and the gear 803*b* is rotated in an arrow I direction through the gear 803*a* and the electromagnetic clutch 900. When the gear 803*b* is rotated in the arrow I direction, the driving is transmitted to a gear 803*f* and a gear 803*g*, and the driving side folding roller 89*a* is rotated and driven in the arrow j direction through the gear 803*d* and the gear 803*e*.

As stated above, when the folding motor 800 is driven in the arrow F direction, the transmission of the driving force is performed through the gear train using the gear 803*f* and the gear 803*g* having a small speed reduction ratio, and the folding roller 89 can be rotated at high speed (second transport speed).

Incidentally, according to the mechanism shown in FIG. 28 and FIG. 29, not only in the case where the folding motor 800 is rotated in the E direction, but also in the case where the folding motor 800 is rotated in the F direction, the driving side folding roller 89*a* is always rotated in the arrow J direction, and accordingly, the transport direction of the bundle of sheets by the pair of folding rollers 89 can be made the same direction.

By the mechanism as stated above, at the time of the folding process, the folding motor 800 is rotated in the arrow E direction as the rotation direction in which the speed reduction ratio is high, so that the driving at low speed and high torque is performed, and the bundle of sheets as the object of the folding process is pressed into the nip of the pair of rollers driven at the first transport speed by the folding blade 100 moved from the waiting position to the nip of the pair of rollers. Then, after the folding process of the bundle of sheets is completed, the folding motor 800 is once stopped, and at the time of transport of the bundle of sheets, the folding motor 800 is rotated in the arrow F direction of the reverse direction, so that the bundle of sheets can be transported at high speed.

Specifically, the transport control unit 4002 switches the sheet transport speed of the pair of folding rollers 89 from the first transport speed V1 to the second transport speed V2 at a specified timing between when the folding blade 100 finishes the pressing operation of the bundle of sheets and starts the return operation to the waiting position and when the leading edge of the folding blade 100 starting the movement to the waiting position passes through the downstream side end position (contact surface on which the pair of folding rollers 89 comes in contact with the roller surface) of the pair of folding rollers 89 in the movement direction at the time of the return operation of the folding blade 100. As stated above, immediately after the folding process is completed, the switching is performed from the first transport speed to the second transport speed as soon as possible, so that a contribution can be made to the improvement of the throughput of the whole apparatus.

Besides, as the number of sheets constituting the bundle of sheets as the object of the folding process becomes large, or as the thickness of a sheet constituting the bundle of sheets as the object of the folding process becomes thick, it is desirable that the transport control unit 4002 delays the timing when the sheet transport speed of the pair of folding rollers 89 is switched from the first transport speed to the second transport speed.

As stated above, in the case where the bundle of sheets requiring the high torque for performing the folding process is the object, the time in which the bundle of sheets is transported at the first transport speed (low speed and high torque) is kept to be long, so that the folding process can be performed without fail.

In addition, in the case where the number of sheets constituting the bundle of sheets as the object of the folding process is smaller than a specified number, it is preferable that the transport control unit 4002 drives the pair of folding rollers 89 only at the second transport speed from when the folding blade 100 finishes the pressing operation of the bundle of sheets and starts the return operation to the waiting position to when the rear edge of the bundle of sheets pressed into the nip part of the pair of folding rollers 89 by the folding blade 100 passes through the nip of the pair of folding rollers 89.

In general, in the case where the number of sheets constituting the bundle of sheets as the object of the folding process is smaller than the specified number, since a very large torque is not required for the rotation driving of the pair of folding rollers 89, the transport is performed at the high speed and low torque from the stage where the bundle of sheets is pinched between the pair of folding rollers 89, so that a contribution can be made to the improvement of throughput.

Next, the control of acceleration in the driving of the pair of folding rollers 89 by the transport control unit 4002 will be described.

In general, at the time when the bundle of sheets is nipped and transported by the pair of folding rollers 89, when the transport speed is abruptly changed, there is a case where a wrinkle is formed in the bundle of sheets to which the folding process is performed or the sheet itself is damaged.

Thus, when the number of sheets constituting the bundle of sheets as the object of the folding process is large, the transport control unit 4002 of this embodiment performs PWM control by motor step signals of the folding motor 800 and reduces acceleration A2 at the time of switching of the sheet transport speed of the pair of folding roller 89 from the first transport speed to the second transport speed. This is because, in the case where the number of sheets constituting the bundle of sheets as the object of the folding process is large, when the pair of folding rollers 89 are abruptly accelerated, the bundle of sheets is liable to be wrinkled.

On the other hand, when a sheet constituting the bundle of sheets as the object of the folding process is thick, the transport control unit 4002 of this embodiment performs the PWM control by the motor step signals of the folding motor 800 and increases the acceleration at the time of switching of the sheet transport speed of the pair of folding rollers 89 from the first transport speed to the second transport speed. This is because, in the case where the sheet constituting the bundle of sheets as the object of the folding process is thin, when the pair of folding rollers 89 are abruptly accelerated, the bundle of sheets may be broken, however, in the case where the sheet is thick, it can resist the abrupt acceleration.

Further, according to the fourth embodiment of the invention, for example, the sheet processing apparatus having the following structure can be provided.

(1) In the sheet processing apparatus having the structure as described above, information acquisition means for acquiring information relating to the thickness of a sheet constituting the bundle of sheets as the object of the folding process by the folding blade is provided, and as the sheet constituting the bundle of sheets as the object of the folding process becomes thick, the transport control means increases acceleration at the time of switching of the sheet transport speed of the pair of rollers from the first transport speed to the second transport speed.

As described above, according to the embodiment, since it is possible to greatly improve the throughput at the time when the bundle of sheets subjected to the folding process is transported to the downstream side after the folding process is performed to the bundle of sheets, and the occurrence of a wrinkle of the bundle of sheets at the time of the folding process can be prevented.

Fifth Embodiment

Next, a fifth embodiment of the invention will be described.

This embodiment is a modified example of the foregoing respective embodiments. Hereinafter, a portion having the same function as a portion already described in the foregoing embodiments is denoted by the same reference numeral and its description will be omitted.

(Correction Based on Detection Result of Position where a Bundle of Sheets is Made to Wait by a Stacker)

In general, in the case where a staple process or a folding process is performed to a bundle of sheets, the size of a sheet, in the transport direction, constituting the bundle of sheets as the object of the process is calculated based on the prescribed value (for example, A3, A4, B4, B5, etc.) of the sheet size, and in the case where it is determined that the sheet size deviates from the prescribed value, an error notification is made.

In a conventional sheet processing apparatus, in the case where the user supplies a sheet of a size outside of the regulation as the object of the staple process or the folding process, there is a case where these processes can not be executed.

Hereinafter, the drive control of a stacker 2 at the time of the staple process and the folding process in a sheet processing apparatus of this embodiment will be described in detail.

Figure 31:
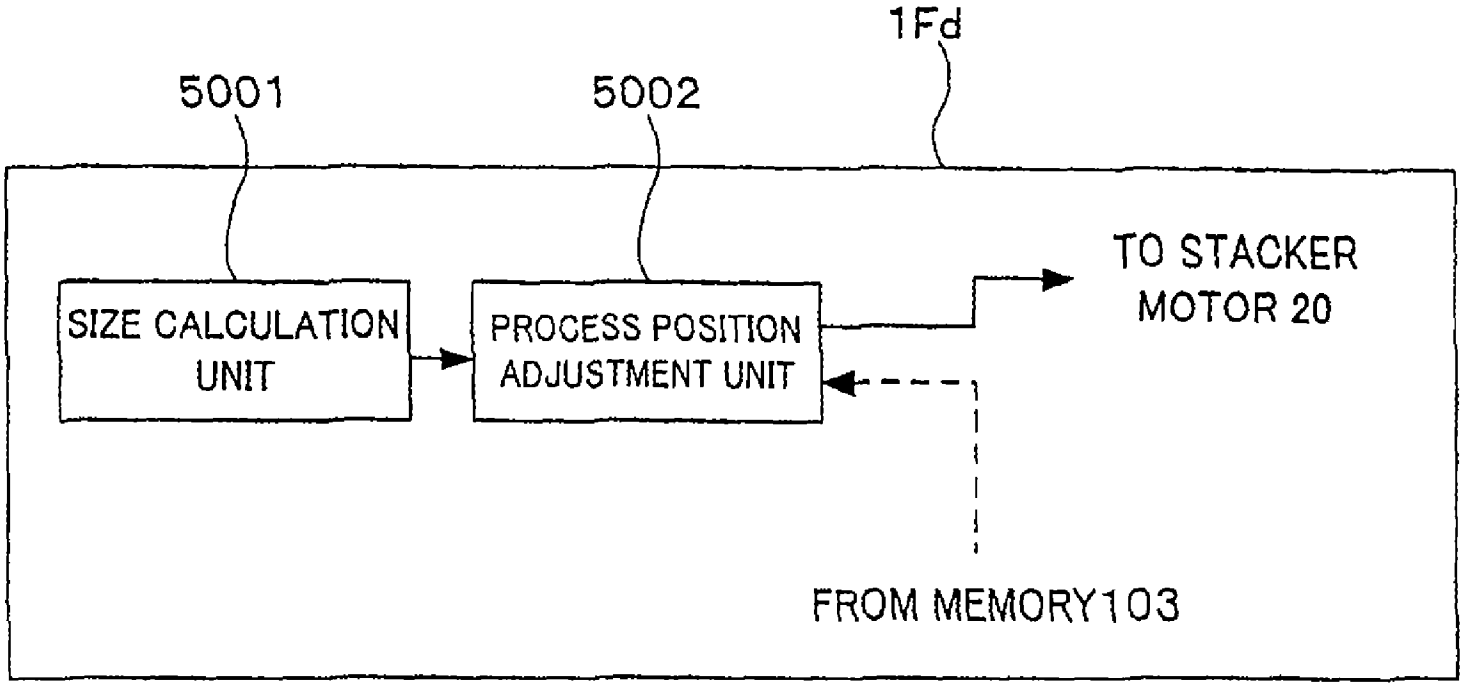
FIG. 31 is a functional block diagram in a sheet processing apparatus of a fifth embodiment of the invention.
Figure 32:
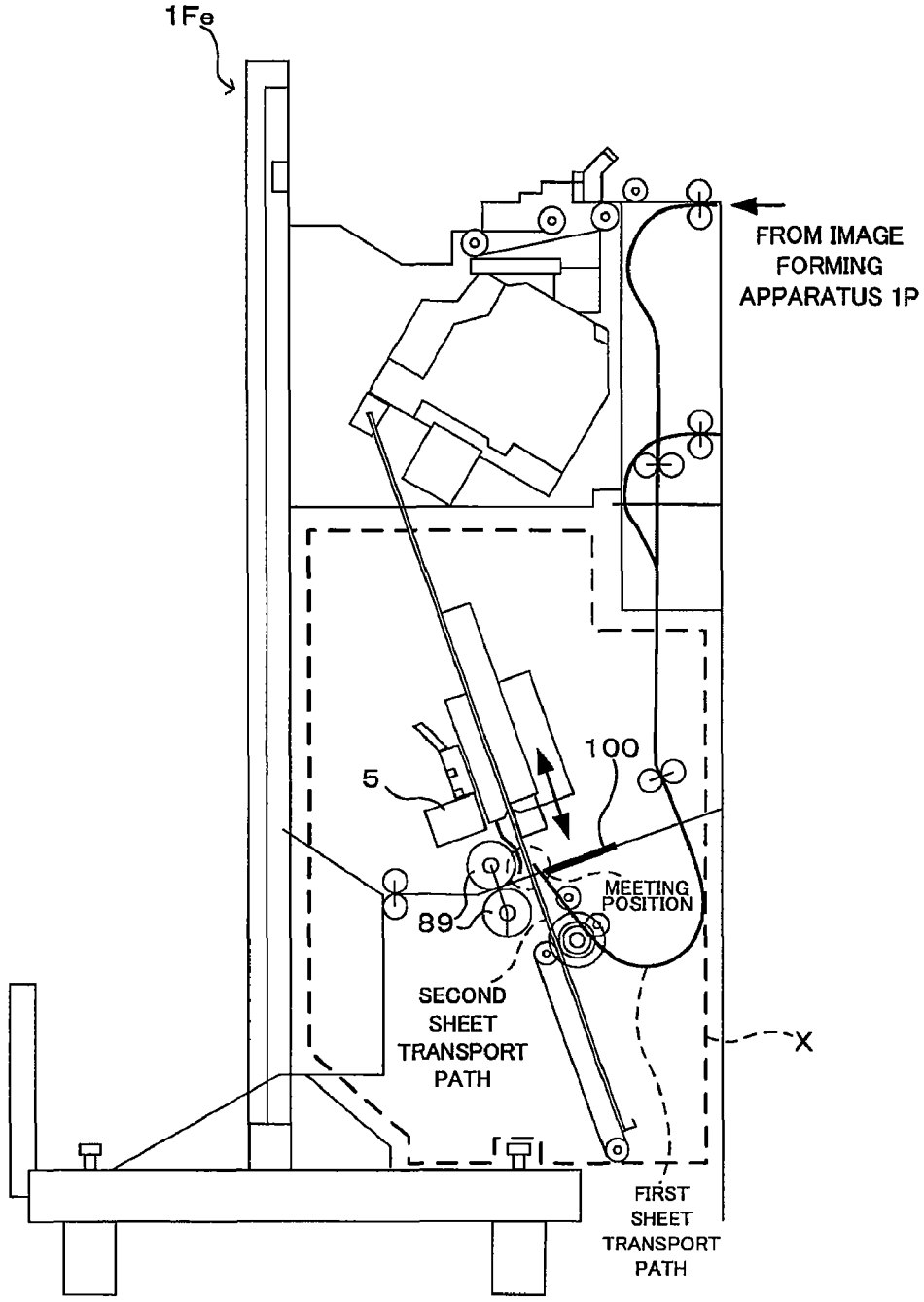
FIG. 32 is a view for explaining a pull-out structure of each unit in a sheet processing apparatus 1Fe of a sixth embodiment of the invention.

FIG. 31 is a functional block diagram of the sheet processing apparatus of the fifth embodiment of the invention.

The sheet processing apparatus 1Fd of the embodiment includes a size calculation unit 5001 and a process position adjustment unit 5002. Incidentally, the processing position adjustment unit 5002 may be hardware independent of the CPU 801, may be a combination of the CPU 801 and software, or may be a combination of a processor different from the CPU 801 and software. For example, although the processing position adjustment unit 5002 may be one realized such that the CPU 801 executes a program stored in the MEMORY 802, no limitation is made to this.

The size calculation unit 5001 calculates the size of a sheet, in the transport direction, passing through a discharge roller sensor 41 based on the detection result of the discharge roller sensor 41. Specifically, the size calculation unit 5001 calculates the sheet length based on the number of drive steps of a transport motor 40 between the detection of the leading edge of the sheet by the discharge roller sensor 41 and the detection of the rear edge of the sheet.

The process position adjustment unit 5002 adjusts the position where the staple process or the folding process is performed to the bundle of sheets as the object of the staple process or the folding process based on the sheet size calculated by the size calculation unit 5001.

Hereinafter, the adjustment of the process position of the bundle of sheets in this embodiment will be described in detail.

A distance between the original staple position in a stapler 5 and a waiting position of a stacker pawl 21 is made L0, a theoretical value of length, in a transport direction, of a specified sheet size is made L1, and a distance from the staple position to a folding position is made L2.

When a sheet length (actually measured value) calculated by the size calculation unit 5001 is made L4, for example, in the case where the actually measured value L4 is "L4>L1", the process position adjustment unit 5002 drives a stacker motor 20 by a distance of "(L1−L4)/2" and lowers the stacker pawl 21.

Sheets are stacked on the stack tray 1 till the final sheet at the above position, and after the staple process is performed to the stacked bundle of sheets, the stacker pawl 21 is driven by "L2", the folding process is performed and the bundle of sheets are ejected.

On the other hand, for example, when the sheet length calculated by the size calculation unit 5001 is made L4, for example, in the case where the actually measured value L4 is "L4<L1", the process position adjustment unit 5002 drives the stacker motor 20 by a distance of "(L1−L4)/2" and raises the stacker pawl 21.

By adopting the structure as stated above, even in the case where the specified sheet size and the actually measured value of the sheet actually supplied from the image forming apparatus 1P are different from each other, the high precision staple process or folding process can be performed by adjusting the process position.

By doing so, the stack pawl 21 is made to wait at the position corresponding to the sheet size as a temporary measure, and the correction has only to be made by the amount of an error, and accordingly, the correction of the error can be performed in a short time, and that is preferable also in the throughput.

Incidentally, here, although the structure is exemplified in which the size of the sheet as the object to which the staple process or the folding process is performed is calculated based on the detection result of the discharge roller sensor 41, a limitation is not always made to this, and for example, the structure can be made such that a not-shown sheet edge detection sensor to detect the edge of a sheet moved by the stacker 2 is provided, and the sheet length is calculated based on the detection result of the sensor.

For example, the correction of a process position of a bundle of sheets is performed based on the flow of a process as described below.

First, the process position adjustment unit 5002 drives the stacker motor 20 to move the stacker pawl 21 to the sheet waiting position, and waits until a bundle of sheets in which the number of sheets is sufficient as the process object are aligned.

Next, the process position adjustment unit 5002 raises the stacker pawl 21 until the sheet edge detection sensor is turned ON.

Here, in the case of

L0=distance from the staple position to the stacker pawl 21 in the sheet waiting state, L1=theoretical value (prescribed value) of the sheet length, L2=distance from the sheet edge detection sensor to the stacker pawl 21 in the sheet waiting state, and L3=distance from a position where the staple process is performed to a position where the folding process is performed, the actually measured length of the sheet can be obtained from the timing when the sheet edge detection sensor is turned ON.

In the case of conditions of $$L0=L1/2+(\text{maximum sheet length}-\text{sheet length theoretical value}) \text{ and}$$

$$L2=L1+(\text{maximum sheet length}-\text{sheet length theoretical value}),$$

the sheet length is obtained by $$\text{sheet length}=L2-\text{the number of steps of sheet edge detection movement}\times\text{movement distance of one step.}$$

The size calculation unit 5001 calculates the actually measured length of the sheet as the process object based on the calculation expression as stated above.

The process position adjustment unit 5002 moves the center position, in the transport direction, of the sheet to the staple position based on a calculation expression as stated below.

$$\text{the number of steps of staple position movement}=(\text{the number of steps of sheet edge detection movement}-(\text{maximum sheet length}-\text{sheet length theoretical value})/\text{movement distance of one step})/2$$

(rising in the case where the calculation result here is plus, and descending in the case of minus).

As stated above, according to the embodiment, in the case where the sheet folding process or the staple process is performed, even in the case where the size precision (length) of the sheet used is not sufficient, the staple process and the folding process with high precision can be performed to the sheet.

Sixth Embodiment

Next, a sixth embodiment of the invention will be described.

This embodiment is a modified example of the foregoing respective embodiments. Hereinafter, a portion having the same function as a portion already described in the foregoing embodiments is denoted by the same reference numeral and its description will be omitted.

(Sheet Processing Apparatus in which a Saddle Unit can be Integrally Pulled Out)

In a conventional sheet processing apparatus for performing a staple process and a folding process, there is known a structure including a stapler to perform the staple process to a sheet, a pair of folding rollers and a folding blade to perform the folding process to the sheet, and a switchback transport unit to transport the sheet to the stapler or the pair of folding rollers.

In the conventional sheet processing apparatus as stated above, for sheet removal in the case where a sheet jam (sheet jamming) occurs and for maintenance, there is known a structure in which only the portion of a transport guide constituting a sheet transport path to hold a sheet at the time when a specified process is performed by the stapler or the pair of folding rollers can be pulled out to the outside of the sheet processing apparatus, or a structure in which only the vicinity of the pair of folding rollers can be pulled out to the outside of the sheet processing apparatus. In the conventional sheet processing apparatus having the structure as stated above, it is general that for example, a transport guide constituting a transport path to perform switchback transport is opened in a state where it remains in the sheet processing apparatus and a jammed sheet is removed.

However, even if the transport guide is opened in the sheet processing apparatus, it cannot be said that a sufficient space for sheet removal is obtained only by that, and there are many cases where the sheet removal is difficult.

Then, in a sheet processing apparatus of the sixth embodiment of the invention, in order to solve the problem, the following structure as described below is adopted.

FIG. 32 to FIG. 37 are views for explaining a pull-out structure of each unit in the sheet processing apparatus 1Fe of the sixth embodiment.

Figure 33:
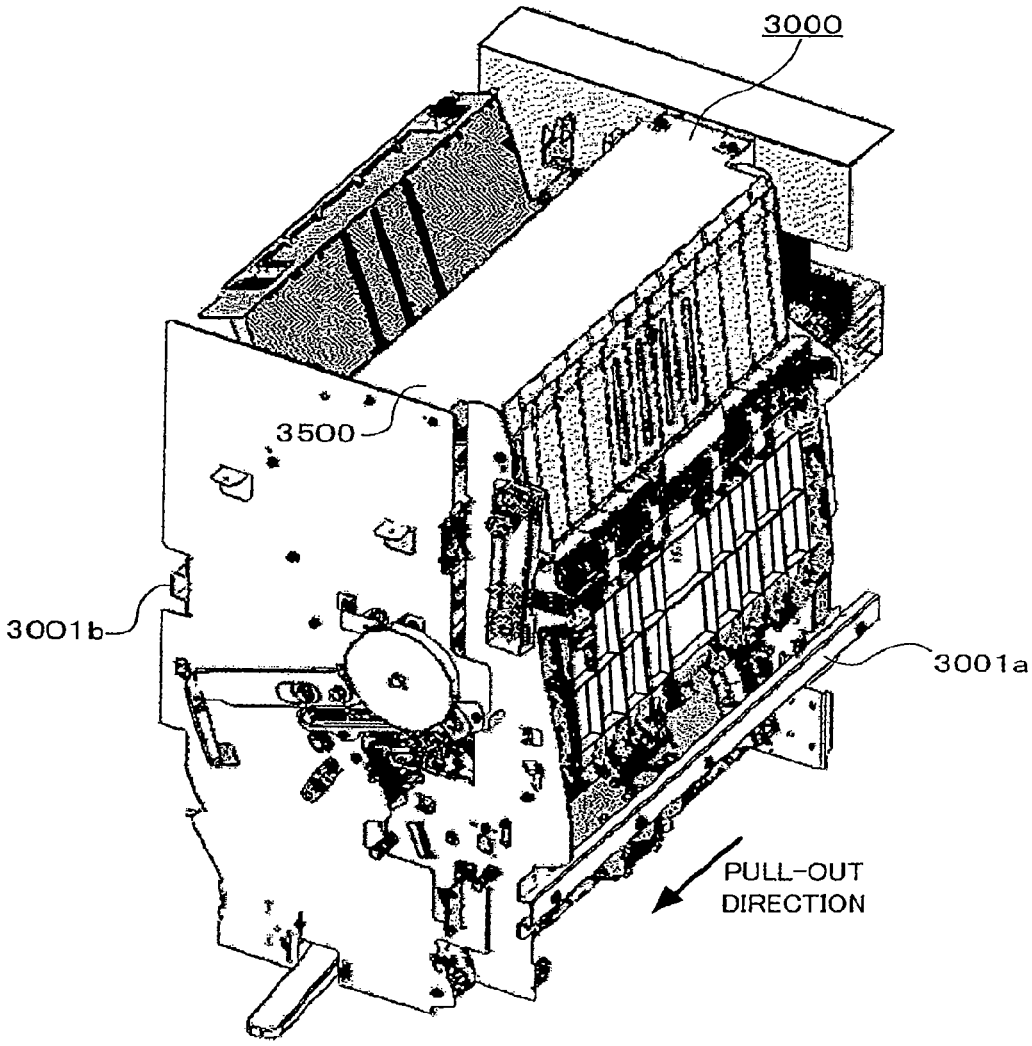
FIG. 33 is a view for explaining the pull-out structure of each unit in the sheet processing apparatus 1Fe of the sixth embodiment of the invention.
Figure 34:
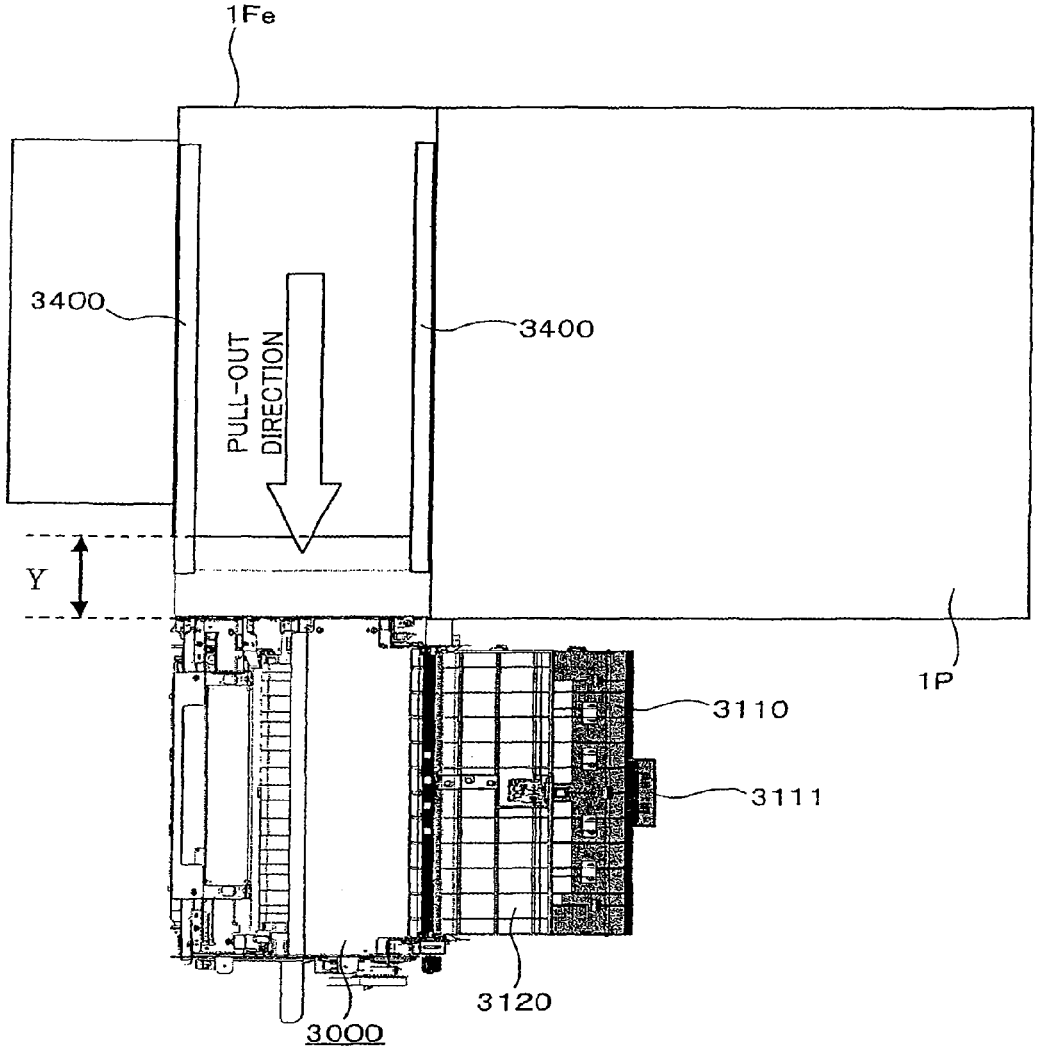
FIG. 34 is a view for explaining the pull-out structure of each unit in the sheet processing apparatus 1Fe of the sixth embodiment of the invention.

A saddle unit 3000 to perform a staple process and a folding process in the sheet processing apparatus 1Fe includes rail units 3001*a* and 3001*b* fixedly connected to the saddle unit 3000 shown in FIG. 33. The rail units 3001*a* and 3001*b* are supported by a guide unit 3400 to a post-processing apparatus main body frame to be capable of sliding in the near side direction vertical to the paper plane of FIG. 32, and by this, the saddle unit 3000 (the whole range surrounded by a broken line X shown in FIG. 32) can be pulled out to the front side of the sheet processing apparatus 1Fe as shown in FIG. 34. Here, a frame (see, for example, FIG. 33) which integrally supports the rail unit 3001*a*, the rail unit 3001*b*, the guide unit 3400, the stapler 5, the pair of folding rollers 89 and the like corresponds to a slide unit.

Here, a first sheet transport path is for transporting a sheet as an object of a staple process or a folding process to a process position, and a second sheet transport path is for performing switchback transport of a sheet, which is transported in the first sheet transport path, to perform the staple process or the folding process. Incidentally, the second sheet transport path here includes at least one of a hole, a projection and a recess (a shape portion by which a sheet is caught) in the vicinity of the meeting position (see FIG. 32) between the second sheet transport path and the first sheet transport path. In general, in the transport guide constituting the second sheet transport path, especially in the case where the shape portion by which the sheet is liable to be caught exists in the transport guide at the downstream side of the first sheet transport path in the sheet traveling direction, the sheet jam is liable to occur.

The pull-out amount of the saddle unit 3000 to the outside of the sheet processing apparatus 1Fe is set such that at least the whole mechanism part of the saddle unit 3000 can be pulled out to the outside of the sheet processing apparatus 1Fe. For example, when the size of the image forming apparatus 1P in the depth direction is large, and there is a difference Y between the front of the sheet processing apparatus 1Fe and the front of the image forming apparatus 1P (see FIG. 34), the structure is made such that the saddle unit can be pulled out to the outside of the sheet processing apparatus 1Fe by the amount obtained by adding the distance Y to the above pull-out amount. As stated above, in the slide unit of the embodiment, the first transport guide and the second transport guide can be pulled out to the position where opening of the first transport guide and the second transport guide is not hindered by the image forming apparatus 1P.

Figure 35:
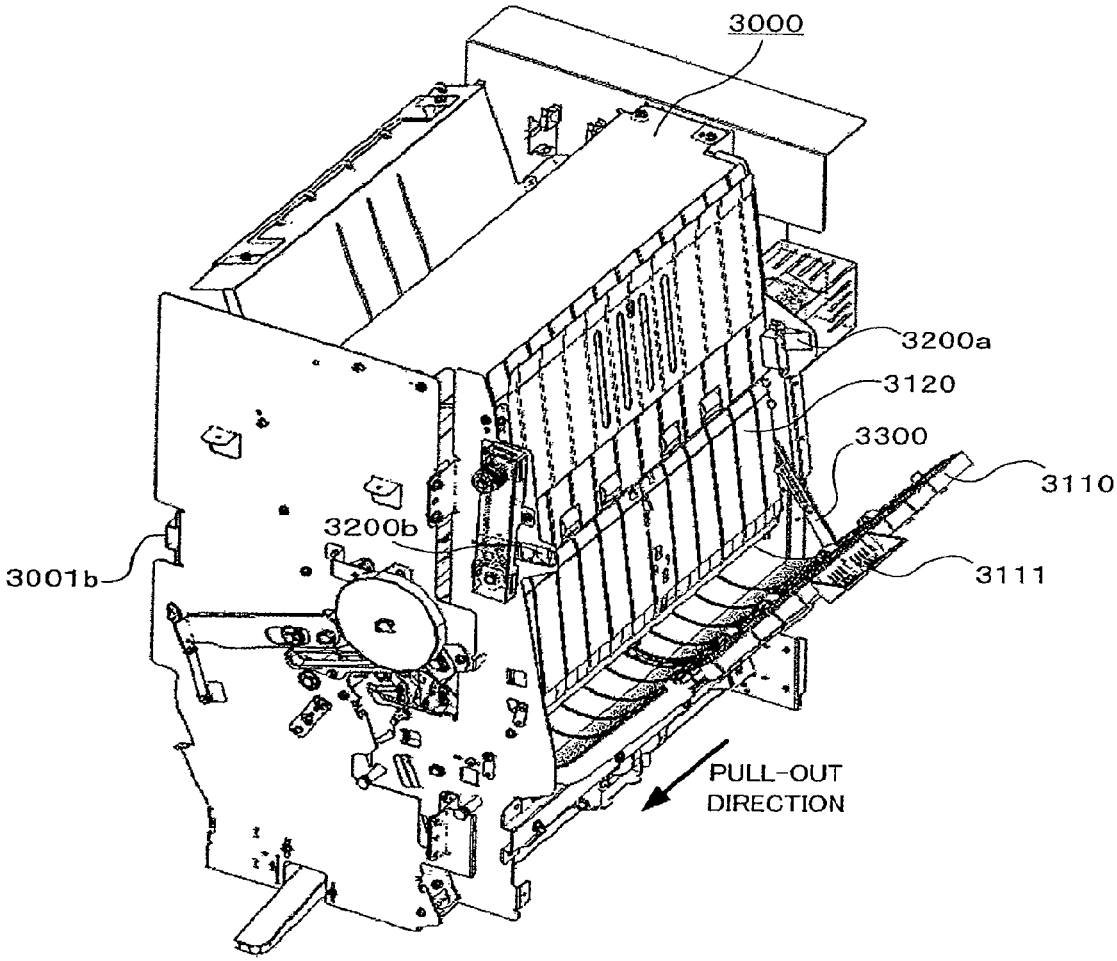
FIG. 35 is a view for explaining the pull-out structure of each unit in the sheet processing apparatus 1Fe of the sixth embodiment of the invention.

In the saddle unit 3000 pulled out to the outside of the sheet processing apparatus 1Fe, a first guide 3110 constituting an outside wall surface of the first sheet transport path in the direction of radius of curvature includes a pull-out knob 3111, and can be rotated around the lower side end as a fulcrum point. The first guide 3110 can be opened by pulling the pull-out knob 3111 to the near side as shown in FIG. 35. A main body frame of the saddle unit 3000 is provided with transport guide support members 3200*a* and 3200*b*, and as shown in FIG. 33, the first transport guide 3110 is generally supported in the closed state.

Figure 36:
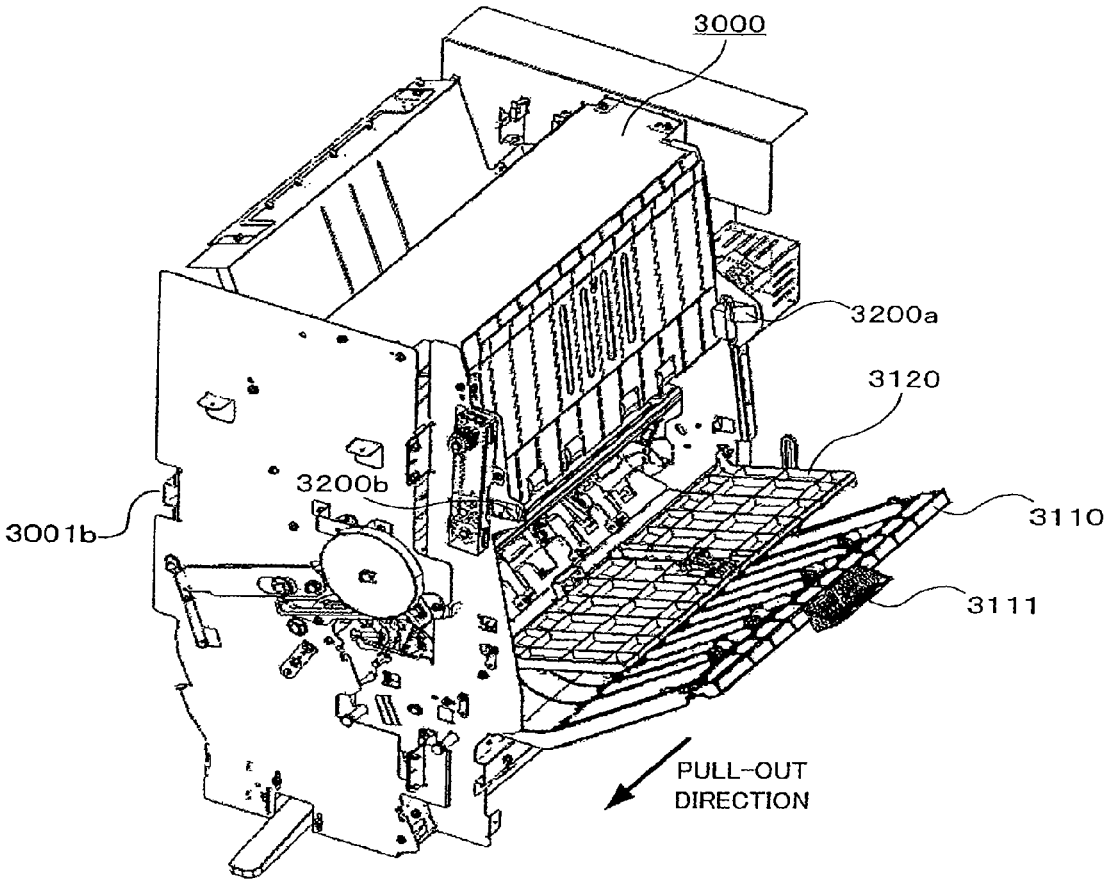
FIG. 36 is a view for explaining the pull-out structure of each unit in the sheet processing apparatus 1Fe of the sixth embodiment of the invention.

Besides, a second transport guide 3120 constituting the inside wall surface of the first sheet transport path in the direction of radius of curvature can also be rotated around the lower side end as the fulcrum point similarly to the first transport guide 3110, and has an openable structure as shown in FIG. 36.

Figure 37:
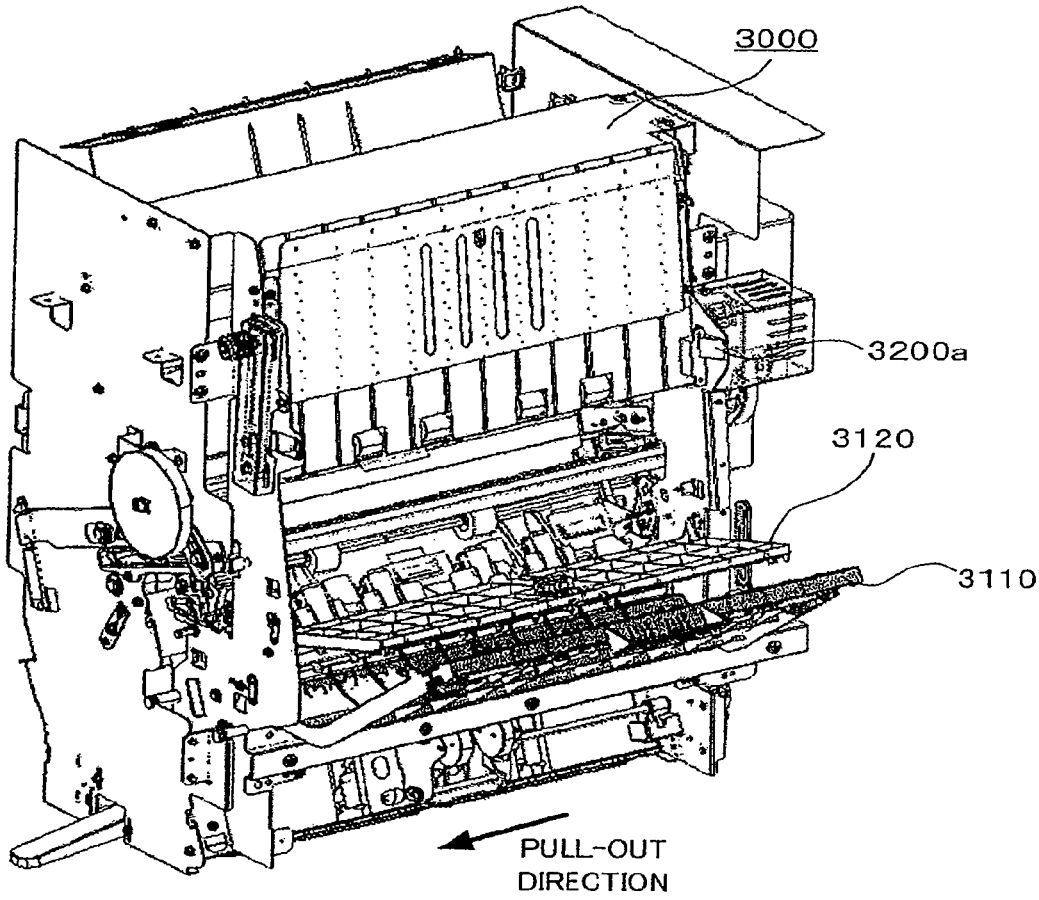
FIG. 37 is a view for explaining the pull-out structure of each unit in the sheet processing apparatus 1Fe of the sixth embodiment of the invention.

The first transport guide 3110 and the second transport guide 3120 are coupled by a coupling member 3300, and has a first state shown in FIG. 35 which is a state where the first transport guide 3110 is opened by a specified angle, and a second state where after the first transport guide 3110 is further opened from the first state, and the first transport guide 3110 is more opened as shown in FIG. 36 and FIG. 37.

In the sheet processing apparatus of the embodiment, by the action of the coupling member 3300, in synchronization with opening of the first transport guide 3110 from the first state to the second state, the second transport guide 3120 is also opened.

As stated above, since the structure is made such that the first transport guide 3110 and the second transport guide 3120 can be opened stepwise, the sheet removal in the sheet transport path naturally becomes easy, and further, as shown in FIG. 37, it is possible to make easy to remove a sheet from the switchback portion and the vicinity of the pair of folding rollers 89 positioned inside of the apparatus with respect to the first sheet transport path.

Besides, in this embodiment, a material having high transparency is used for the first transport guide 3110, and a material having low transparency is used for the second transport guide 3120 and its color is made a color close to black. By doing so, it is possible to raise the visibility of the sheet remaining in the sheet transport path in the state where the saddle unit 3000 is pulled out to the outside of the apparatus and in the state where the transport guide is opened. Incidentally, the form of the first transport guide 3110 is not necessarily limited to the above structure. For example, a hole is formed in the first transport guide 3110, and the jammed sheet may be confirmed through the hole. In this case, it is preferable that the hole formed in the first transport guide 3110 is made, for example, a long hole extending in the sheet transport direction. By this, between the first transport guide 3110 and the second transport guide 3120, a wide range in the sheet transport direction can be visually recognized from the outside of the first transport guide 3110, and a contribution can be made to the improvement of maintenance. Of course, it is needless to say that when the material having high transparency is used for the first transport guide 3110 and the hole is formed, a contribution can be made to the further improvement of maintenance.

Incidentally, here, although the structure is exemplified in which the first sheet transport path, the second sheet transport path, the stapler 5, the pair of folding rollers 89, and the folding blade 100 can be integrally pulled out to the outside of the sheet processing apparatus 1Fe by the slide unit, a limitation is not necessarily made to this.

In the case where the folding blade 100 and the pair of folding rollers 89 for the folding process are disposed in the vicinity of a switchback position (meeting position) for the reduction in size, a jam is liable to occur in the vicinity of the pair of folding rollers 89.

Thus, in such a case, the slide unit is structured such that at least the first sheet transport path, the second sheet transport path, and the pair of folding rollers 89 can be integrally pulled out to the outside of the sheet processing apparatus 1Fe, and it is possible to facilitate dealing with the jam which occurs in the vicinity of the pair of folding rollers 89.

On the other hand, in the case where the stapler 5 is disposed in the vicinity of the switchback position (meeting position) for the reduction in size, a jam is liable to occur in the vicinity of the stapler 5.

Thus, in such a case, the slide unit is structured such that at least the first sheet transport path, the second sheet transport path and the stapler 5 can be integrally pulled out to the outside of the sheet processing apparatus 1Fe, and it is possible to facilitate dealing with the jam which occurs in the vicinity of the stapler 5.

Besides, the sheet processing apparatus 1Fe of the embodiment includes a plate-like member 3500 which extends at least in the slide direction of the slide unit, and covers the outside, in the direction orthogonal to the slide direction of the slide unit, of at least a part of the unit which can be pulled out to the outside of the sheet processing apparatus 1Fe by the slide unit.

As stated above, the outside of the saddle unit in the direction orthogonal to the slide direction is covered with the plate-like member 3500 extending in the slide direction, and it is possible to prevent a member or clothes from being caught when the saddle unit is housed into the sheet processing apparatus 1Fe. Incidentally, although the plate-like member 3500 here is a ceiling portion of the saddle unit, no limitation is made to this, and for example, it may be disposed at the side wall portion of the saddle unit, or may be disposed at the bottom portion.

Further, according to the sixth embodiment of the invention, for example, the sheet processing apparatus having the following structure can be provided.

(1) In the sheet processing apparatus having the structure as described above, the second guide is opened in synchronization with the opening operation of the first guide.

(2) In the sheet processing apparatus having the structure as described above, the first guide is provided with at least one hole which enables visual identification of the inside of the first sheet transport path from the outside in a state where the first guide is not opened.

(3) In the sheet processing apparatus having the structure as described above, a plate-like member is provided which is a plate-like member extending in, at least, a slide direction of the slide means, and covers the outside, in a direction orthogonal to the slide direction of the slide means, of at least a part of a unit which can be pulled out to the outside of the sheet processing apparatus by the slide means.

(4) In the sheet processing apparatus having the structure as described above, the second guide is opened in synchronization with an opening operation of the first guide.

(5) In the sheet processing apparatus having the structure as described above, the first guide is provided with at least one hole which enables visual identification of the inside of the first sheet transport path from the outside in a state where the first guide is not opened.

(6) In the sheet processing method having the structure as described above, the second guide is opened in synchronization with the opening operation of the first guide.

(7) In the sheet processing method having the structure as described above, the first guide is provided with at least one hole which enables visual identification of the inside of the first sheet transport path from the outside in a state where the first guide is not opened.

As described above, according to this embodiment, a contribution can be made to the improvement of maintenance in the case where a sheet jam occurs in the vicinity of the switchback position.

Seventh Embodiment

Next, a seventh embodiment of the invention will be described.

This embodiment is a modified example of the foregoing respective embodiments. Hereinafter, a portion having the same function as a portion already described in the foregoing embodiments is denoted by the same reference numeral and its description will be omitted.

(Control of Movement Timing of a Stacker and a Lateral Alignment Plate to Waiting Position)

Hitherto, positions of a lateral alignment plate which aligns an edge of a sheet in a direction orthogonal to a transport direction and a stack pawl against which an edge of the sheet in the transport direction is struck and is positioned are controlled based on the number of pulses of a stepping motor until all selected processes are completed when a staple process and a folding process are performed, and they do not return to a home position.

Thus, a shift in the position of the lateral alignment plate and the stopper is liable to occur by the influence of an individual difference between parts and an individual difference at the time of assembly of the apparatus. Thus, for example, in the case where a process is performed to a large number of sheets, or a plurality of processes different from each other are continuously performed to a sheet, the position shift is accumulated and resultantly, there is a fear that a large position shift occurs.

In view of the problem, there is known a method in which a bundle of sheets to which a staple process or a folding process is performed is returned once to the home position by movement of a stacker, and the position precision is ensured. However, since the lateral alignment plate and the stacker pawl have also a role to guide the bundle of sheets, there is a problem that when an error occurs in the timing of returning to the home position, an error occurs in the precision of the folding position. Besides, when the driving of the lateral alignment plate and the stacker pawl is started after the folding process is ended, there is a problem that a wasteful waiting time occurs and process time is increased.

Figure 38:
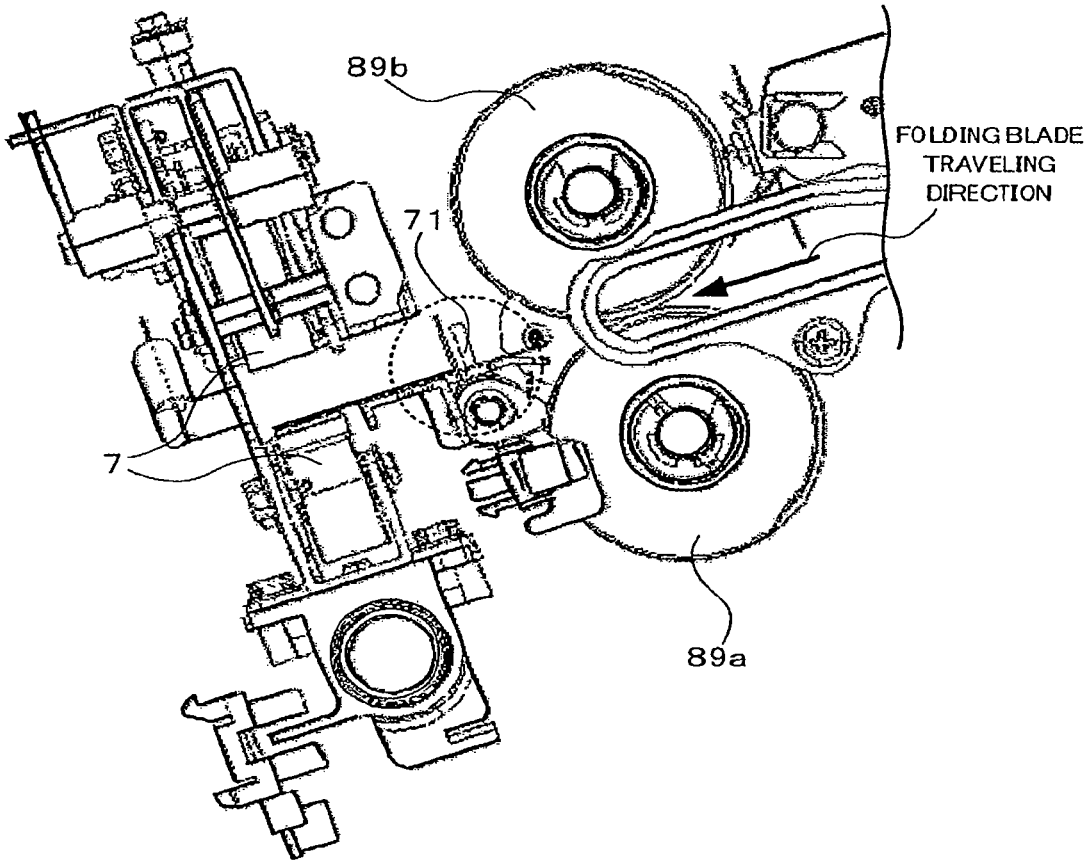
FIG. 38 is a view for explaining a sheet processing apparatus of a seventh embodiment of the invention.

Then, in the sheet processing apparatus of the embodiment, the following structure is adopted. FIG. 38 is a view for explaining the sheet processing apparatus according to the seventh embodiment of the invention.

In the sheet processing apparatus of this embodiment, lateral alignment plates 31*a* and 31*b* to align an edge of a bundle of sheets in a direction orthogonal to a sheet transport direction and a stacker pawl 21 against which an edge of the bundle of sheets in the sheet transport direction is struck and is adjusted to the reference of a staple position or a folding position for each size have a role of positioning in the sheet transport direction and serve as a guide in the width direction until the pair of folding rollers 89 nip the bundle of sheets by the folding process by the pair of folding rollers 89 (see, for example, FIG. 4 and FIG. 5).

In order to perform an additional folding process to the bundle of sheets subjected to the folding process by the pair of folding rollers 89, after the sheet is detected by an additional folding position detection sensor 71 for detecting the position of the bundle of sheets ejected from the pair of folding rollers 89, the lateral alignment plates 31*a* and 31*b* and the stacker pawl 21 are moved to the home position.

In the case where, based on driving pulses at the time when the folding blade 100 is driven, it is determined whether the bundle of sheets is nipped by the pair of folding rollers 89, since it depends on the distance for which the bundle of sheets moves before the bundle of sheets is actually nipped by the pair of folding rollers 89, a variation is large.

On the other hand, when the detection result of the additional folding position detection sensor 71 disposed at the downstream side of the pair of folding rollers 89 in the transport direction is used, it is possible to certainly determine whether the bundle of sheets is nipped by the pair of folding rollers.

As stated above, since the structure is made such that after the sheet is detected by the additional folding position detection sensor 71, the lateral alignment plates 31*a* and 31*b* and the stacker pawn 21 are moved to the home position, the bundle of sheets can be aligned at the suitable position by the lateral alignment plates 31*a* and 31*b* and the stacker pawl 21, and a contribution can be made to the improvement of precision of the folding position and the staple position.

Eighth Embodiment

Next, an eighth embodiment of the invention will be described.

This embodiment is a modified example of the foregoing respective embodiments. Hereinafter, a portion having the same function as a portion already described in the foregoing embodiments is denoted by the same reference numeral and its description will be omitted.

(Control of Movement Timing of a Stacker and a Lateral Alignment Plate to Next Sheet Reception Position)

In a conventional sheet processing apparatus for performing a staple process or a folding process, a lateral alignment plate to align an edge of a sheet in a direction orthogonal to a transport direction and a stacker pawl against which an edge of the sheet in the transport direction is struck and is positioned are moved to a reception position of a sheet to be processed next after the staple process or the folding process is completed.

However, when the driving of the lateral alignment plate and the stacker pawl is started to perform alignment of a next sheet after the folding process to the bundle of sheets is actually completed, a wasteful waiting time occurs and there is a problem in throughput.

On the other hand, when the movement of the lateral alignment plate and the stacker pawl is started before the folding process to the bundle of sheets is completed, for example, in the case where a folding process is performed to a bundle of sheets of a small size after a folding process is performed to a bundle of sheets of a large size, there is a problem that the lateral alignment plate or the stacker pawl whose movement is started early interferes with the bundle of sheets during the folding process, and a defect occurs in the bundle of sheets during the folding process.

Then, in the sheet processing apparatus of this embodiment, the following structure is adopted.

Figure 39:
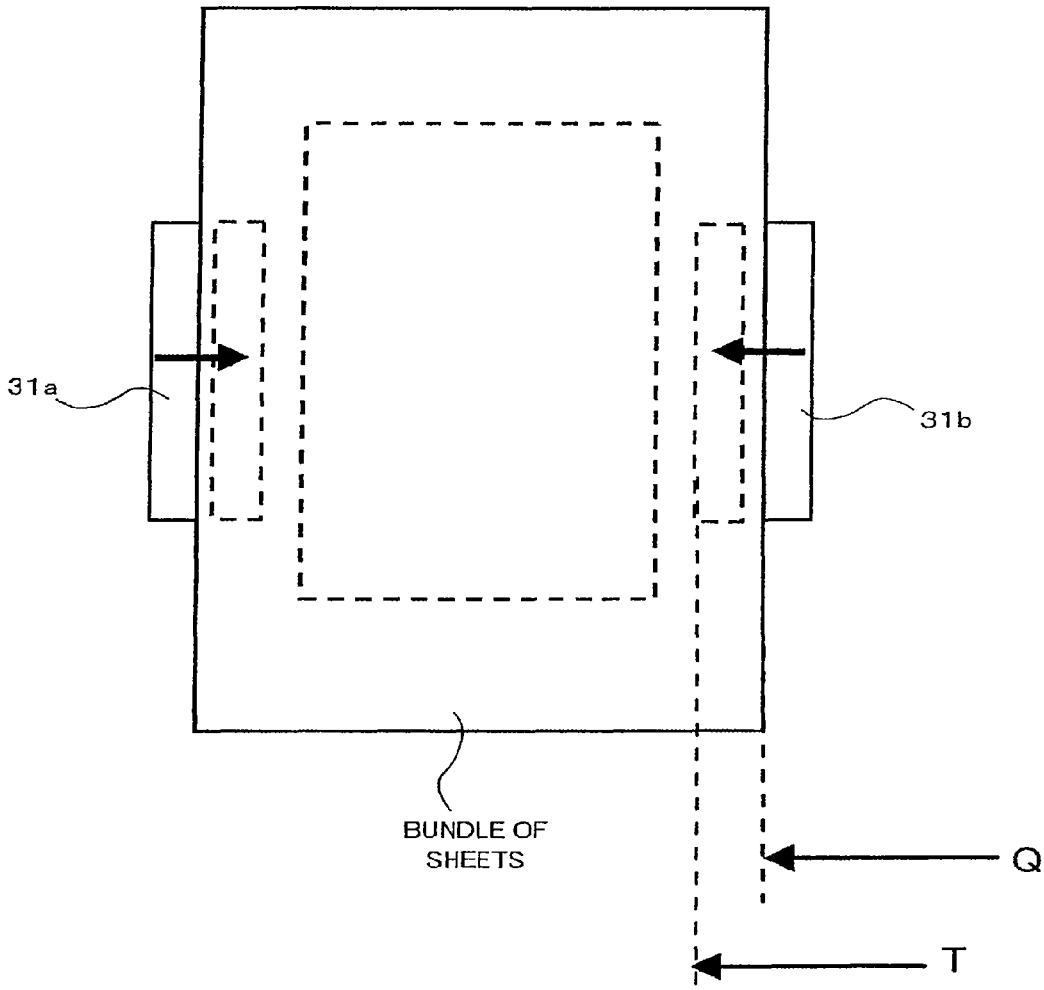
FIG. 39 is a view for explaining a sheet processing apparatus of an eighth embodiment of the invention.
Figure 40:
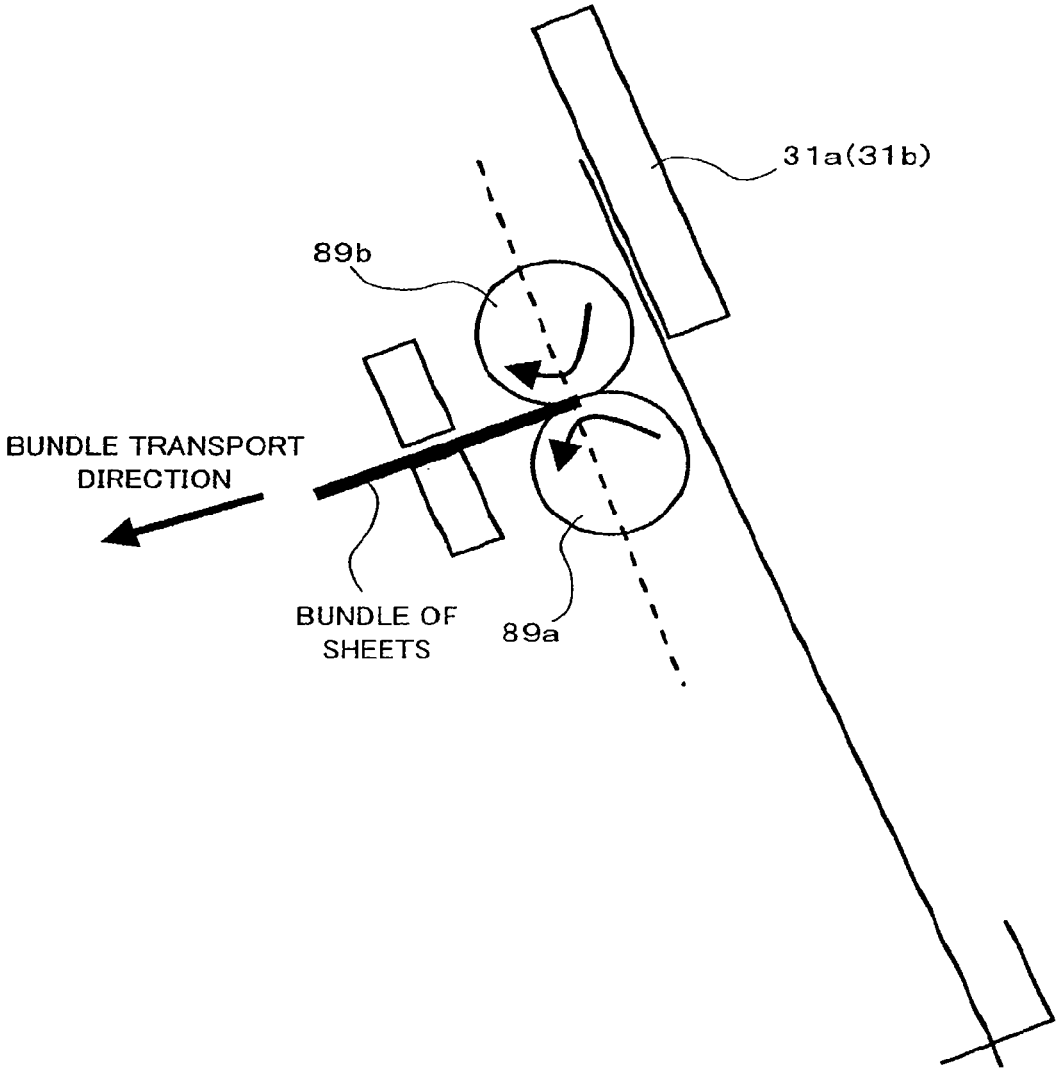
FIG. 40 is a view for explaining the sheet processing apparatus of the eighth embodiment of the invention.

FIG. 39 and FIG. 40 are views for explaining the sheet processing apparatus of the eighth embodiment of the invention.

In general, since a folding process to a bundle of sheets requires a very large torque, the pair of folding rollers 89 are rotated and driven at low speed at the time of the folding process by the pair of folding rollers 89. Besides, since the bundle of sheets is stopped to further perform the additional folding process to the bundle of sheets having passed through the pair of folding rollers 89, when the stacker pawl 21 is moved to the position where a sheet to be processed next is received, the stacker pawl 21 comes in contact with the rear edge of the bundle of sheets during the folding process.

Thus, it is preferable that a timing when the stacker pawl 21 starts to move from the home position or the stop position where the folding process is performed to the position where the sheet to be processed next is received is set to a timing when it does not come in contact with the bundle of sheets during the folding process and the rear edge of the bundle of sheets during transport after the folding process.

Specifically, in this embodiment, a folding motor 800 is stopped after the folding process to the bundle of sheets, and the movement of the lateral alignment plate and the stacker pawl to the position where the sheet to be processed next is received is started between when the execution of the additional folding process to drive the additional folding roller 7 is started and when it is stopped.

Besides, for example, when the stacker pawl 21 starts driving at the timing when the folding blade 100 comes in contact with the bundle of sheets, and is moved at the same movement speed as the sheet bundle transport speed of the pair of folding rollers 89, the edge of the bundle of sheets can be supported by the stacker pawl 21 until the folding blade 100 causes the bundle of sheets to be nipped by the pair of folding rollers 89.

On the other hand, with respect to the lateral alignment plates 31*a* and 31*b*, in the case where the folding process is performed to the sheet of a large size, and the bundle of sheets to be processed next has a small size, as shown in FIG. 39, when the bundle of sheets exists on the stack tray 1, the lateral alignment plate can not be moved from an alignment position Q of the former bundle of sheets to a reception position T of a waiting position. Thus, it is necessary to move the lateral alignment plates 31*a* and 31*b* to the reception position of the sheet to be processed next after the timing when the bundle of sheets is ejected from the stack tray 1.

Thus, it is desirable that the timing when the lateral alignment plates 31*a* and 31*b* move from the home position or the stop position where the folding process is performed to the reception position of the bundle of sheets to be processed next is made the timing when the rear edge of the bundle of sheets subjected to the folding process passes through the vicinity of the center of the nip of the pair of folding rollers 89 (see a broken line shown in FIG. 40).

The respective steps in the process (sheet processing method) of the sheet processing apparatus are realized by causing the CPU 801 to execute a sheet processing program stored in the memory 802.

Although the above description is given to the case where the function to carry out the invention is previously recorded in the inside of the apparatus, no limitation is made to this, and the same function may be downloaded from a network to the apparatus, or a recording medium storing the same function may be installed into the apparatus. The recording medium may have any form as long as the recording medium, like a CR-ROM, can store a program and can be read by the apparatus. Besides, the function obtained by the previous installation or download may realize the function in cooperation with an OS (Operating System) in the inside of the apparatus.

Although the invention is described in detail while using the specific mode, it would be apparent for one of ordinary skill in the art that various modifications and improvements can be made without departing from the sprit and the scope of the invention.

As described above in detail, according to the invention, it is possible to provide the technique in which in the case where the sheet folding process or the staple process is performed, even in the case where the size precision of the sheet used is not satisfactory, the high-precision staple process and folding process can be performed to the sheet.

What is claimed is:

1. A sheet processing apparatus, comprising:

an information acquisition unit configured to acquire a sheet size of a relatively moved sheet;

a process position adjustment unit configured to adjust, based on the sheet size acquired by the information acquisition unit, a position where a specified process is performed to a bundle of sheets as an object of the specified process;

a stacker configured to hold the bundle of sheets as the object of the specified process and configured to move substantially parallel to a sheet surface direction at a time when the specified process is performed;

an alignment member configured to come into contact with the sheet as the sheet is being stacked in the stacker to cause the sheet to be struck against a reference position in the stacker and to be aligned, and come in contact with and separate from the bundle of sheets held by the stacker; and a drive control unit configured to cause the alignment member to come in contact with the bundle of sheets held by the stacker based on the sheet size acquired by the information acquisition unit, and cause, if the sheet size acquired by the information acquisition unit is larger than a predetermined sheet size, the alignment member to come in contact with the bundle of sheets at an earlier timing compared to the timing at which the alignment member is caused to come in contact with the bundle of sheets when the sheet size acquired by the information acquisition unit is not larger than the predetermined sheet size.

2. The sheet processing apparatus according to claim 1, wherein the specified process is at least one of a staple process to staple the bundle of sheets and a folding process to fold the bundle of sheets by a folding blade.

3. The sheet processing apparatus according to claim 1, wherein the alignment member includes an alignment roller.

4. The sheet processing apparatus according to claim 1, wherein the drive control unit causes the alignment member to rotate, if the alignment member comes into contact with the bundle of sheets held by the stacker.

5. The sheet processing apparatus according to claim 4, wherein the drive control unit causes the alignment member to continue to rotate, if the alignment member separates from the bundle of sheets held by the stacker.

6. The sheet processing apparatus according to claim 4, wherein the drive control unit causes a moving speed of the alignment member to be faster than a moving speed of the stacker.

7. A sheet processing apparatus, comprising:

sheet size acquisition means for acquiring a sheet size of a relatively moved sheet;

process position adjustment means for adjusting, based on the sheet size acquired by the sheet size acquisition means, a position where a specified process is performed to a bundle of sheets as an object of the specified process;

hold means for holding the bundle of sheets as the object of the specified process, the hold means being configured to move substantially parallel to a sheet surface direction at a time when the specified process is performed;

alignment means for coming into contact with the sheet as the sheet is being stacked in the hold means to cause the sheet to be struck against a reference position in the hold means and to be aligned, and coming in contact with and separate from the bundle of sheets held by the hold means; and drive control means for causing the alignment means to come in contact with the bundle of sheets held by the hold means based on the sheet size acquired by the sheet size acquisition means and causing, if the sheet size acquired by the sheet size acquisition means is larger than a predetermined sheet size, the alignment means to come in contact with the bundle of sheets at an earlier timing compared to the timing at which the alignment means is caused to come in contact with the bundle of sheets when the sheet size acquired by the sheet size acquisition means is not larger than the predetermined sheet size.

8. The sheet processing apparatus according to claim 7, wherein the specified process is at least one of a staple process to staple the bundle of sheets and a folding process to fold the bundle of sheets by a folding blade.

9. A sheet processing method of a sheet processing apparatus to perform a specified process to a sheet, the sheet processing method comprising:

acquiring a sheet size of a relatively moved sheet;

adjusting, based on the acquired sheet size, a position where the specified process is performed to a bundle of sheets as an object of the specified process;

holding the bundle of sheets as the object of the specified process with a stacker that can move substantially parallel to a sheet surface direction at a time when the specified process is performed;

contacting the sheet with an alignment member as the sheet is being stacked to cause the sheet to be struck against a reference position in the stacker and to be aligned; and causing the alignment member to contact with the bundle of sheets held by the stacker based on the acquired sheet size, and causing, if the acquired sheet size is larger than a predetermined sheet size, the alignment member to come in contact with the bundle of sheets at an earlier timing compared to the timing at which the alignment member is caused to come in contact with the bundle of sheets when the acquired sheet size is not larger than the predetermined sheet size.

10. The sheet processing method according to claim 9, wherein the specified process is at least one of a staple process to staple the bundle of sheets and a folding process to fold the bundle of sheets by a folding blade.

11. The sheet processing method according to claim 9, further comprising rotating the alignment member if the alignment member comes into contact with the bundle of sheets held by the stacker.

12. The sheet processing method according to claim 11, further comprising continuing to rotate the alignment member if the alignment member separates from the bundle of sheets held by the stacker

13. The sheet processing method according to claim 11, further comprising rotating the alignment member at a moving speed that is faster than a moving speed of the stacker.

* * * * *